US010716357B2

(12) United States Patent
Kim

(10) Patent No.: US 10,716,357 B2
(45) Date of Patent: Jul. 21, 2020

(54) UNIBODY CONSTRUCTION FOOTWEAR AND METHOD FOR MAKING THE SAME

(75) Inventor: Daniel Kim, Busan (KR)

(73) Assignee: Applied FT Composite Solutions Inc., Las Vegas, NV (US)

( * ) Notice: Subject to any disclaimer, the term of this patent is extended or adjusted under 35 U.S.C. 154(b) by 694 days.

(21) Appl. No.: 13/008,841

(22) Filed: Jan. 18, 2011

(65) Prior Publication Data

US 2011/0277349 A1 Nov. 17, 2011

Related U.S. Application Data

(63) Continuation-in-part of application No. PCT/US2011/000009, filed on Jan. 4, 2011.

(60) Provisional application No. 61/292,130, filed on Jan. 4, 2010.

(51) Int. Cl.

| | |
|---|---|
| ***A43B 9/00*** | (2006.01) |
| ***A43B 23/02*** | (2006.01) |
| ***A43B 13/18*** | (2006.01) |
| ***A43B 13/12*** | (2006.01) |
| ***A43D 8/00*** | (2006.01) |
| ***A43B 7/14*** | (2006.01) |
| ***A43D 8/08*** | (2006.01) |
| ***A43B 3/00*** | (2006.01) |
| ***A43D 111/00*** | (2006.01) |
| ***A43B 23/04*** | (2006.01) |

(52) U.S. Cl.

CPC ..... *A43B 9/00* (2013.01); *A43B 3/0005* (2013.01); *A43B 7/1405* (2013.01); *A43B 13/12* (2013.01); *A43B 13/186* (2013.01); *A43B 23/028* (2013.01); *A43B 23/0215* (2013.01); *A43B 23/0235* (2013.01); *A43B 23/042* (2013.01); *A43D 8/00* (2013.01); *A43D 8/08* (2013.01); *A43D 111/00* (2013.01)

(58) Field of Classification Search

CPC ... A43B 9/00; A43B 23/0235; A43B 23/0215; A43B 23/028; A43B 23/042

USPC ... 36/105, 103, 28, 30 R, 47, 48, 45, 97, 15, 36/101

See application file for complete search history.

(56) References Cited

U.S. PATENT DOCUMENTS 2,513,005 A * 6/1950 Crawford ..... 36/11.5
RE26,340 E * 2/1968 Dassler ..... A43B 5/06 36/129
3,545,105 A * 12/1970 Mayer-Rieckh ..... A43B 5/0486 36/117.1
3,605,294 A * 9/1971 Cunningham et al. ..... A43B 1/0072 12/146 C
3,762,075 A * 10/1973 Munschy ..... 36/97
4,136,468 A * 1/1979 Munschy ..... A43B 3/26 36/97
4,267,650 A * 5/1981 Bauer ..... A43B 13/36 36/101
4,420,894 A * 12/1983 Glassman ..... 36/12
4,751,784 A * 6/1988 Petker ..... A43B 3/106 36/11.5
5,345,638 A * 9/1994 Nishida ..... A41H 3/08 12/146 C
5,946,737 A * 9/1999 Fleege ..... A41D 13/06 2/16

(Continued)

*Primary Examiner* — Ted Kavanaugh

(74) *Attorney, Agent, or Firm* — Nixon & Vanderhye P.C.

(57) ABSTRACT

The present application discloses footwear comprising a body structure in which at least upper is made of one continuous folded composite material comprised of layered sheets of material.

14 Claims, 54 Drawing Sheets

(56) References Cited

U.S. PATENT DOCUMENTS

| | | | | |
|---|---|---|---|---|
| 6,848,202 | B2 * | 2/2005 | Berggren | A43B 1/0081 36/15 |
| 6,931,766 | B2 * | 8/2005 | Greene | A43B 3/122 36/100 |
| 7,047,668 | B2 * | 5/2006 | Burris | A43B 5/02 36/133 |
| 7,204,043 | B2 * | 4/2007 | Kilgore | 36/68 |
| 7,644,517 | B2 * | 1/2010 | Gerber | A43B 3/0047 36/100 |
| 8,333,021 | B2 * | 12/2012 | Johnson | A43B 3/14 36/11 |
| 8,434,245 | B2 * | 5/2013 | Bell | A43B 1/0081 36/105 |
| 2002/0012784 | A1 | 1/2002 | Norton | |
| 2002/0174569 | A1 * | 11/2002 | Tsai | 36/101 |
| 2005/0028402 | A1 | 2/2005 | Miller | |
| 2005/0076537 | A1 | 4/2005 | Clark | |
| 2008/0047167 | A1 * | 2/2008 | Pawlus et al. | 36/101 |
| 2009/0288317 | A1 * | 11/2009 | Forbes | 36/136 |
| 2010/0154256 | A1 * | 6/2010 | Dua | A43B 1/04 36/25 R |

* cited by examiner

Prior Art

Prior Art

UNIBODY CONSTRUCTION FOOTWEAR AND METHOD FOR MAKING THE SAME

CROSS-REFERENCE TO RELATED APPLICATIONS

The present application is a continuation-in-part of International Application No. PCT/US11/00009, filed Jan. 4, 2011, which claims the benefit of priority to U.S. Provisional Application No. 61/292,130, filed Jan. 4, 2010, the contents of which are incorporated by reference herein in their entirety.

BACKGROUND OF THE INVENTION

The invention relates to footwear made by cutting, folding, and assembling sheets of composite or composite-like materials, and the method for making the same. As described in greater detail below, this "unibody" construction footwear is lightweight and requires fewer individual parts that have to be separately sewn, stitched, or glued together, and can be fabricated in less time and at lower cost.

SUMMARY OF THE INVENTION

In one aspect the present invention is directed to footwear comprising a body structure in which at least upper may be made of at least one, two or three or more continuous folded composite material comprised of layered sheeting structures. A sheeting structure may include without limitation, at least one layer of sheeting material, at least two, at least three layers, at least four layers, at least five layers, at least six layers, at least seven layers, at least eight layers, and so forth, so long as the assembled composite material is capable of being folded into the shape of the complete form the footwear body structure, or a portion thereof. Different materials may be inserted or incorporated into the sheeting structures, so as to create non-uniform planar structure that may be folded to form the body structure of the footwear. The composite material may include cushioning pod elements or pod fitting apertures. One or more cushioning pod elements may be joined with one or more pod fitting apertures in the body of the footwear. A layered sheeting structure may be made of resilient foam, rubber, other resilient material, or combinations thereof, or leather, fabric, mesh, or other sheeting material, or combinations of any of the foregoing. The layered sheeting structures, and the assembled footwear, may also include one or more locking pod elements and locking pod apertures. The layered sheeting structures may also include a full layer, a partial layer, or a combination thereof. The layered sheeting structures may include a tongue section, one or more cushioning padding elements, folding lines, and/or reinforcing structures. The layered sheeting structures may also include one or more electronic, mechanical, or electro-mechanical device.

The footwear may include an upper, which may be attached to a prefabricated outsole assembly. The outsole assembly may include sole pod elements. The sole pod elements may be exposed to the inside of the footwear so as to be in contact with the wearer of the footwear. The outsole assembly may include an outsole layer, which may be in contact with the bottom of the upper. The outsole layer may be extended so as to wrap around the sole pod elements. The outsole assembly may include a midsole.

The body structure of the footwear may include an upper and outsole, which may be composed of one or more continuous folded composite materials comprising layered sheeting structures. In one aspect, the composite material may be joined in one seam on the body structure. The body structure of the footwear may be non-uniform across different zones or areas of the footwear, and may include varying thicknesses, textures, stiffness, hardness, color, breathability, shock absorption, resistance to abrasion, flexibility of regions, or other performance characteristics in different areas of the footwear. The footwear may include without limitation, athletic shoes, casual shoes, sandals, formal shoes, industrial protective shoes, shoes suitable for use by medical personnel, and military footwear.

In another aspect, the invention is directed to a process for making footwear described above including the steps of (i) providing a composite material comprising at least one layer of sheeting structure; and (ii) folding the composite so that a body structure comprising one or more continuous folded composite footwear may be made. The composite material may be composed of at least one full layer of sheeting structure, or at least one partial layer of sheeting structure, or any combinations thereof. A sheeting structure may be internally pre-cut to produce cushioning pod elements or pod fitting apertures. Further in the process, after folding the composite material, edges, ends, vertices, or corners of the composite material may be shaped and held in place by engaging locking pod elements and locking pod apertures. In another aspect, the composite material may be joined in one seam. The process may further include inserting or incorporating different materials or differently dimensioned materials into the sheeting structures, so as to create non-uniform body structure of the footwear.

In another embodiment, the invention is directed to footwear comprising an upper and insole made of one or more contiguous pieces or sheeting structures, which may be folded. The shoe upper may be made of one or more contiguous pieces or sheeting structures with different materials in different areas of the shoe, which pieces or sheeting structures may be folded. In another embodiment, the invention is directed to footwear comprising an upper and midsole and outsole made of one or more contiguous pieces or sheeting structures, which may be folded. The upper may be made of one or more contiguous pieces or sheeting structures, but with different materials or differently dimensioned materials located in different areas of the shoe, which pieces or sheeting structures may be folded.

These and other objects of the invention will be more fully understood from the following description of the invention, the referenced drawings attached hereto and the claims appended hereto.

BRIEF DESCRIPTION OF THE DRAWINGS

The present invention will become more fully understood from the detailed description given herein below, and the accompanying drawings which are given by way of illustration only, and thus are not limitative of the present invention, and wherein;

FIG. 119 shows underneath view of shoe last or a suitable mold inserted into the folded shoe upper assembly.

FIG. 120 shows side view of folded shoe upper assembly positioned in relation to an outsole element.

FIG. 121 shows side view of assembled shoe.

FIG. 122 shows side view of assembled shoe.

DETAILED DESCRIPTION OF THE INVENTION

As used in the present application, "unibody" footwear refers to the construction of at least the upper portion, preferably the entire shoe, including the outsole portion, of a footwear using a pre-cut assembly of two-dimensionally placed layers of sheets of varying materials, which are folded into the shape of a footwear and are joined or stitched together to form a permanent shape. The layers of sheets incorporate various objects of suitably varying dimensions and shapes and/or comprised of different types of material at strategically placed sites on the sheets, so that when the assembly is folded in the shape of a shoe, the combination of different sheets of materials and the objects in the same imbue particular "character" and performance characteristics to different areas or zones of the foldably constructed shoe. The "unibody" footwear does not require piecemeal stitching together of various components or swatches of different materials to form the shoe upper. Rather the entirety of the upper is pre-cut and laid out along a two-dimensional plane, and is folded three-dimensionally to take on the shape of a shoe.

As used herein, "non-uniform" or "asymmetric" footwear refers to the use of various objects or materials of varying color, thickness, texture, resilience, flexibility, breathability, and so forth that are strategically incorporated into the sheets, so that different areas, zones, or regions of the sheets have different characteristics. By providing such zonal variation into the sheets, the folded constructed shoe shows varying characteristics in the different areas of the shoe, even though the shoe is assembled from a substantially contiguous sheet of composite material, as the objects or different types of materials that were strategically incorporated into the sheets manifest their varying "characteristics" once the assembly of sheets is folded into the shape of a show.

Figure 1:
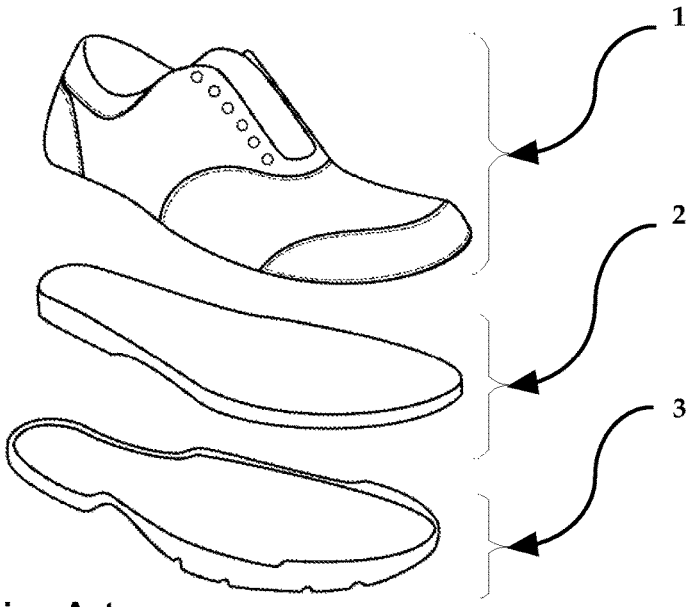
FIG. 1 shows an exploded view of conventionally made shoes.

Footwear production is traditionally a labor and time intensive process, and requires the cutting, stitching, gluing, and assembly of many separate parts and subcomponents. FIG. 1 depicts the traditional steps for making footwear by assembling three major components: The shoe upper 1, customarily made of fabric, leather, or other suitable synthetic material; the shock-absorbing midsole 2; and the outsole 3, customarily made of rubber, plastic, leather, or other durable material.

Figure 2:
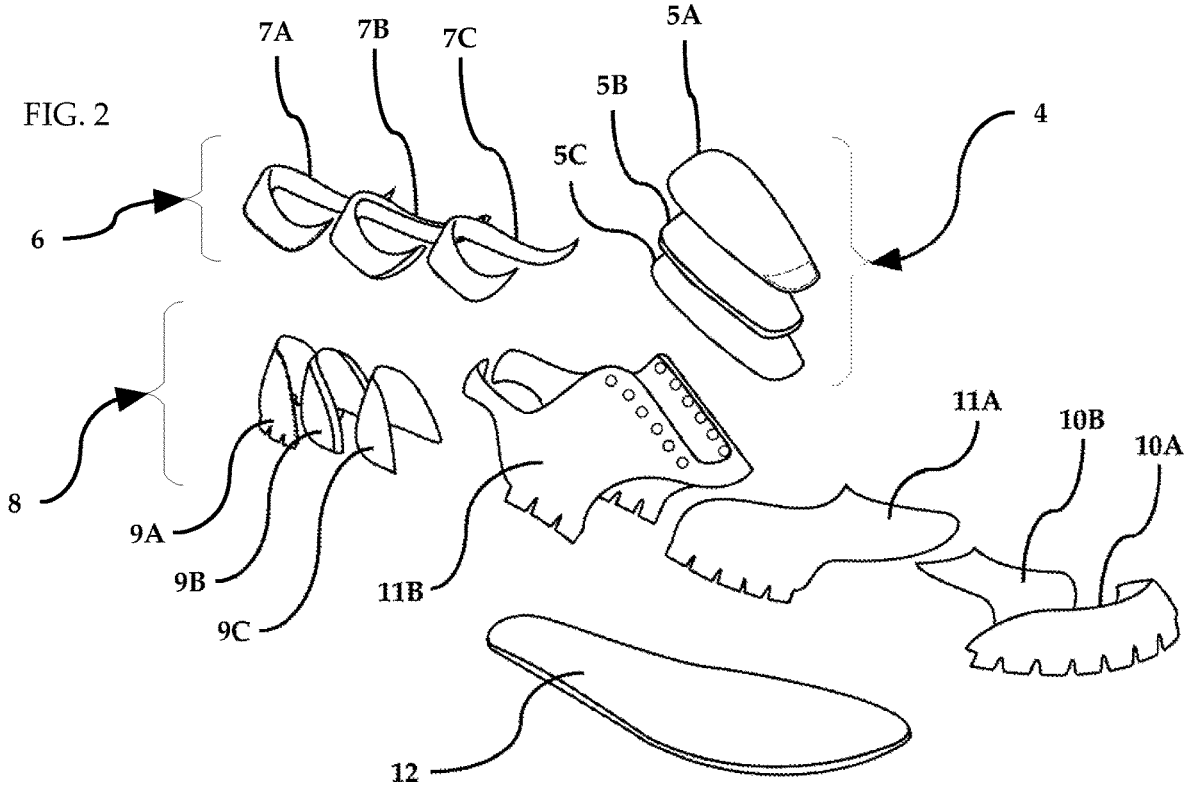
Prior Art FIG. 2
FIG. 2 shows an exploded view of conventionally made shoes.

As depicted in FIG. 2, shoe upper 1 is customarily made by cutting and assembling numerous subcomponents, and sewing, stitching, and gluing those subcomponents together.

Conventionally, the heel quarter 8 is made by separately cutting and gluing or sewing heel quarter component outer layer 9A to a heel quarter component padding 9B and heel quarter component inner lining 9C. Likewise, the shoe "tongue" component 4 is made by separately cutting and gluing or sewing a tongue outer layer 5A to tongue padding 5B and tongue inner lining 5C. The heel counter 6 is made by cutting and gluing or sewing together heel counter outer layer 7A, heel counter component 7B, and heel counter inner lining 7C. A toe cap component 10A and toe cap reinforcement 10B may be glued or sewn together, and then glued or sewn to shoe vamp 11A. Other subcomponents similarly require assembly, stitching, or gluing of discrete parts or swatches of materials in separate steps.

Conventionally, the various subcomponents must be glued or sewn together to form the shoe upper 1. By way of example only, the toe cap component 10A must be glued or sewn to shoe vamp 11A and to toe cap reinforcement 10B; the shoe vamp 11A must be glued or sewn to front quarter component 11B; the shoe tongue component 4 must be glued or sewn to shoe vamp 11A; and the heel counter 6 and heel quarter 8 must be glued or stitched to the front quarter component 11B, in separate steps.

The partially assembled shoe upper 1 is then stitched or glued to innersole board 12, to form shoe upper 1.

Figure 3:
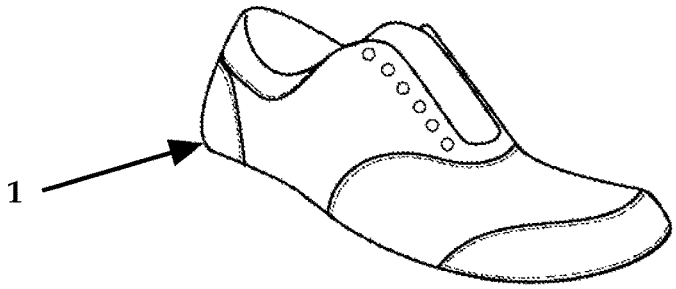
FIG. 3 shows a conventionally made shoe upper.

The completed or fully assembled shoe upper 1 is depicted in FIG. 3.

Figure 4:
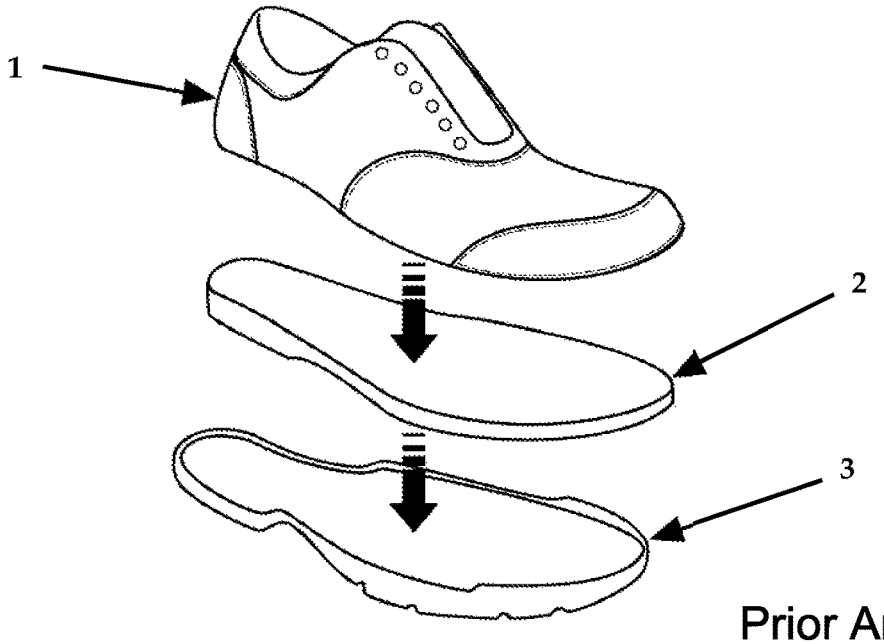
Prior Art FIG. 4
FIG. 4 shows an exploded view of conventionally made shoes.

Thereafter, as depicted in FIG. 4, shoe upper 1 is stitched or glued to midsole 2, and to outsole 3, with midsole 2 being "sandwiched" between shoe upper 1 and outsole 3.

Figure 5:
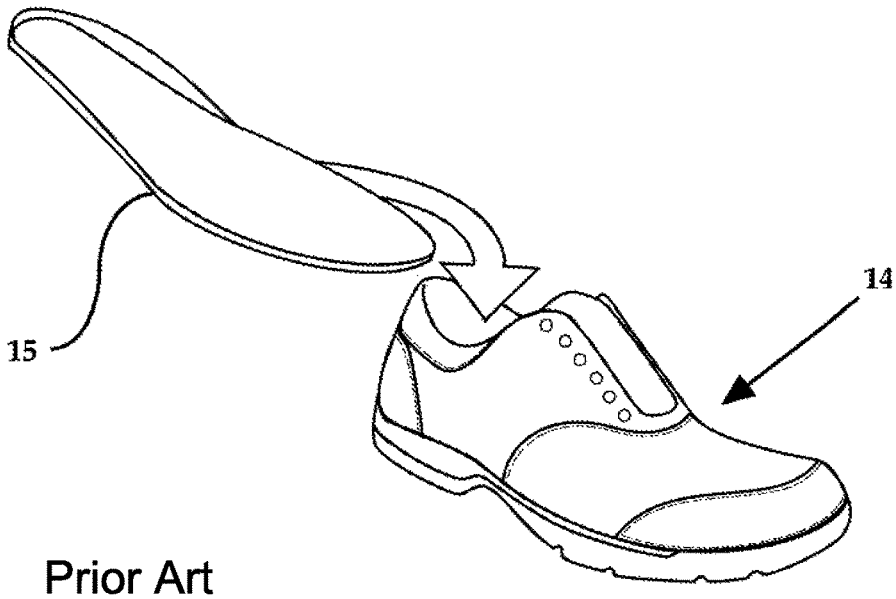
Prior Art FIG. 5
FIG. 5 shows insertion of a sockliner into conventionally made shoe upper-midsole-outsole assembly.

Finally, a sockliner 15 shown in FIG. 5 is inserted, positioned, or glued to the completed shoe upper-midsole-outsole assembly 14.

As demonstrated above, the conventional process for assembling and making a shoe requires the cutting, stitching, gluing, and assembling of many separate parts and subcomponents, and it is relatively time consuming and labor intensive. In order to provide different or additional qualities to certain sections or parts of the shoe (for instance, additional cushioning or shock absorption to the toe cap area, or greater rigidity to the heel area, or greater flexibility or breathability to the vamp area), the manufacturer must make additional parts and stitch, glue, or assemble those parts to the shoe upper or outsole assembly, further adding to the cost and complexity of the finished product.

The present invention relates to footwear made by overlaying sheets of materials along a plane and cutting or shaping the same; attaching, fitting, welding, or gluing them; and folding and assembling the overlapping sheets of the resulting complex composite or composite-like materials in a three dimensional shape to form the body structure of the footwear. As further described in greater detail below, this unibody construction footwear is lightweight and requires fewer individual parts that have to be separately sewn, stitched, or glued together, and can be assembled in less time and at lower cost. Furthermore, because components of unibody construction footwear is fabricated by laying out flat sheets of various materials, and components may be laid out and engaged or adhered to such materials, various electronic, mechanical, or electro-mechanical devices and components may be integrated to the footwear assembly with greater ease.

It is conventionally known that uniformly thick body structure of footwear can be made such as by injection molding. For example, rubber galoshes or rubber shoe covers may fit this description. However, these types of footwear are not made of composite material that has several layers of sheets. The present invention introduces incorporation of non uniformity of materials, such as materials with different performance characteristics in different parts of the shoe. For instance, discrete parts or areas of the unibody shoe may have non-uniform thickness, or have uniform thickness, but may have different characteristics, because they may be made of different composites, i.e., foam and mesh, versus foam and leather, or foam with foam cage sandwiched between two fabric or mesh substrates, and so forth.

Asymmetry of thickness or other characteristics of construction of conventionally made footwear is introduced by taking the additional step of gluing or stitching together swatches or components comprised of different types of materials, or by gluing or stitching on to the footwear the additional component or swatches that are desired, such as additional components made of plastic or thermoplastic polyurethanes, in additional and separate steps, which steps add to the cost, time, and complexity of assembling the footwear.

Thus conventionally, it is possible to make a shoe by stitching or gluing swatches of different materials, so that different parts of the shoe have different characteristics (e.g., elastic toe area versus rigid heel area, and so forth). However, footwear that includes a body structure in which at least upper is made of one contiguous folded composite material comprised of layered sheets of component materials with different thicknesses and performance characteristics across or throughout the material has not been known. In a preferred embodiment, the invention is directed to a unibody footwear construction in which at least the upper is made of one continuous folded composite material comprised of layered sheets of component materials, and the layered sheets of material are "asymmetrical" in thickness and/or performance characteristics, wherein the single contiguous sheet of composite material has a non-uniform composition, thickness, and component materials in various areas of the footwear.

By manipulating the shape and type of component materials to be used in the composite material, and the pattern to be cut on each individual layer of the composite material, the invention provides a way of introducing a variety of non-uniformity or asymmetry to the desired areas or parts of the shoe, such as in, without limitation, varying thickness, texture, stiffness, flexibility, hardness, color, breathability, shock absorption, and resistance to abrasion at various designated regions or areas of the footwear. Using conventional means, control of these aspects of the footwear would require stitching or gluing together a plurality of additional swatches or parts made of different materials and sizes, or stitching or gluing different materials or varied textured materials to the outer body of the footwear in separate or additional steps. Conventional ways of making shoes would typically require additional stitching or gluing of the different material or varied textured material to the body of the footwear. This means at least two different things: (1) Stitch or glue different swatches made of different materials or combination of materials, or (2) stitch or glue additional pieces of materials (such as some type of plastic trimmings) onto the outer surface of the shoe in separate steps, all of which add to the cost, time, and complexity of assembling footwear.

In this aspect, while it is contemplated that such trimmings and additional material may optionally be tacked, taped, glued or stitched on to the unibody shoe after the unibody shoe has been folded and constructed, the unibody shoe itself is contemplated to incorporate asymmetric or additional material in the layers, which are folded to construct the unibody shoe.

In another aspect of the invention, the unibody shoe requires just one joining event to join the layers together after the layers have been folded to make the shoe. Such joining of the layers may occur through a variety of ways, including without limitation one time stitching, Velcro®, gluing and so forth.

The invention is also directed to a shoe with upper and insole (or upper and midsole or outsole) made of a single contiguous construction that is folded and joined together at one seam. In particular, the upper of the shoe may be made of a single contiguous piece but with different materials in different areas of the shoe, and therefore, such material may be made of a composite of layers and as such the composite may be termed to be "complex".

As described above, the present invention is distinguished from conventionally known shoe constructs such as a composite with fabric and foam that is blended together that is made of a single piece of a uniform composite material that forms the body and is stitched together in a single seam, and a separate tongue, made of the same material, stitched to the upper.

Unibody Shoe Upper Assembly

FIGS. 6 through 9 depict the major components of the unibody construction footwear.

Figure 6:
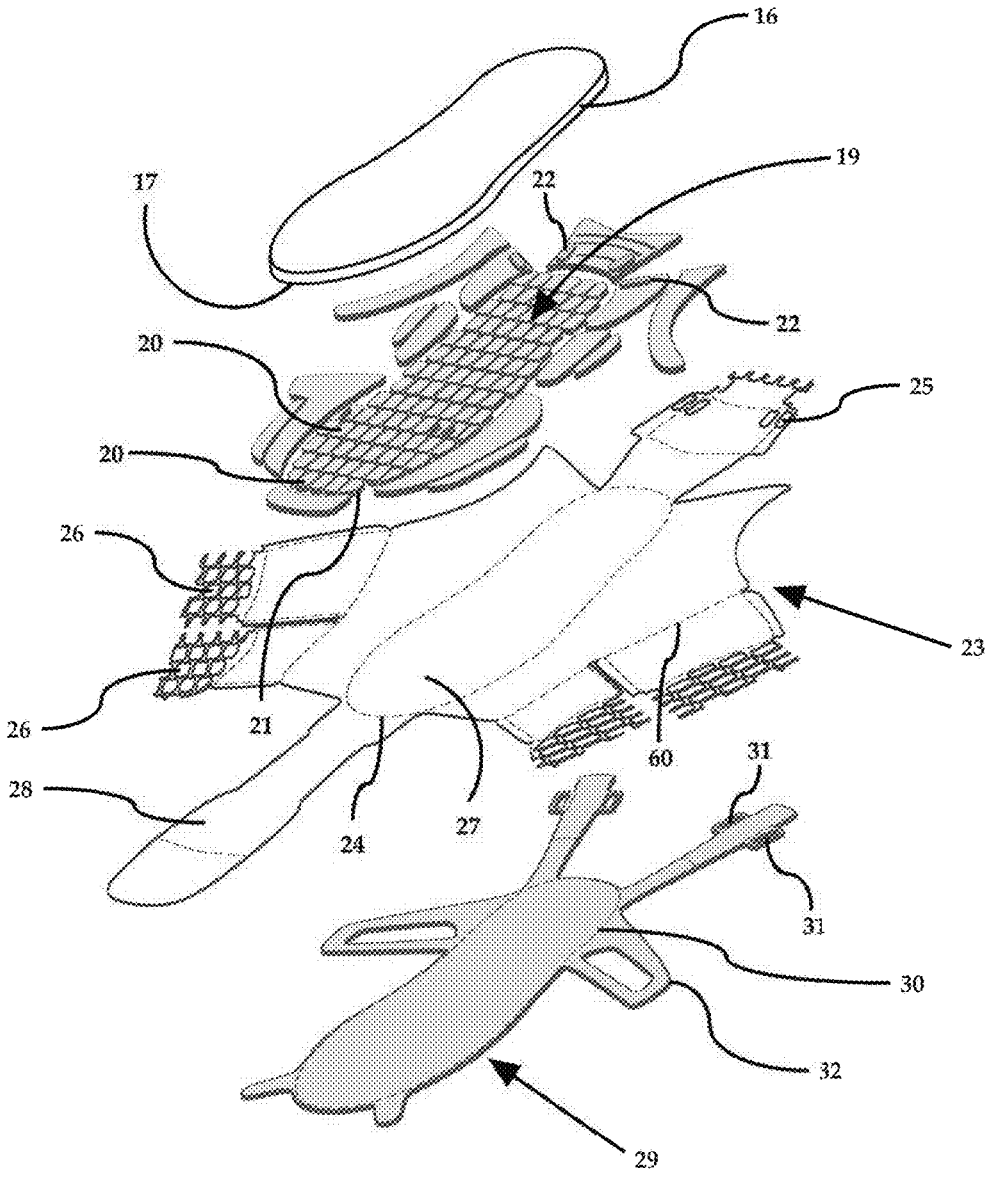
FIG. 6 shows an exploded view of unibody shoe upper.
Figure 7:
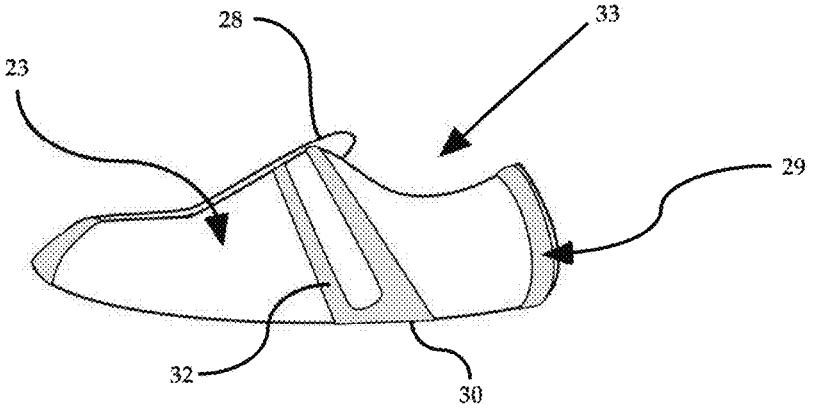
FIG. 7 shows a side view of assembled unibody shoe upper.
Figure 8:
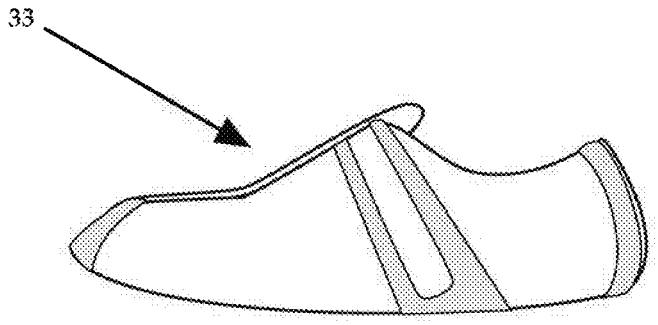
FIG. 8 shows a side view of assembled unibody shoe upper.

FIGS. 6 through 7 depict the various optional components of unibody shoe upper 33. FIG. 8 depicts the assembled unibody shoe upper 33.

More specifically, FIG. 6 depicts, among other things, components of unibody shoe upper 33, such as sheets of various materials cut, overlaid, and stacked, and positioned, fitted, glued, or sewn in layers to form a composite or composite-like material.

The components of unibody shoe upper 33 depicted in FIG. 6 optionally include insole element 16; individual cushioning pod elements 20, an array of which form cushioning padding element 19; full layer 23; and partial layer 29.

The unibody shoe upper 33 is assembled by layering sheets of materials cut or pre-cut in various shapes, and then folding them along folding lines, such as bottom folding line 24 and top folding line 60, to construct a three dimensional unibody shoe upper 33.

FIGS. 7 and 8 depicts unibody shoe upper 33 assembled from the various components shown in FIG. 6.

Figure 9:
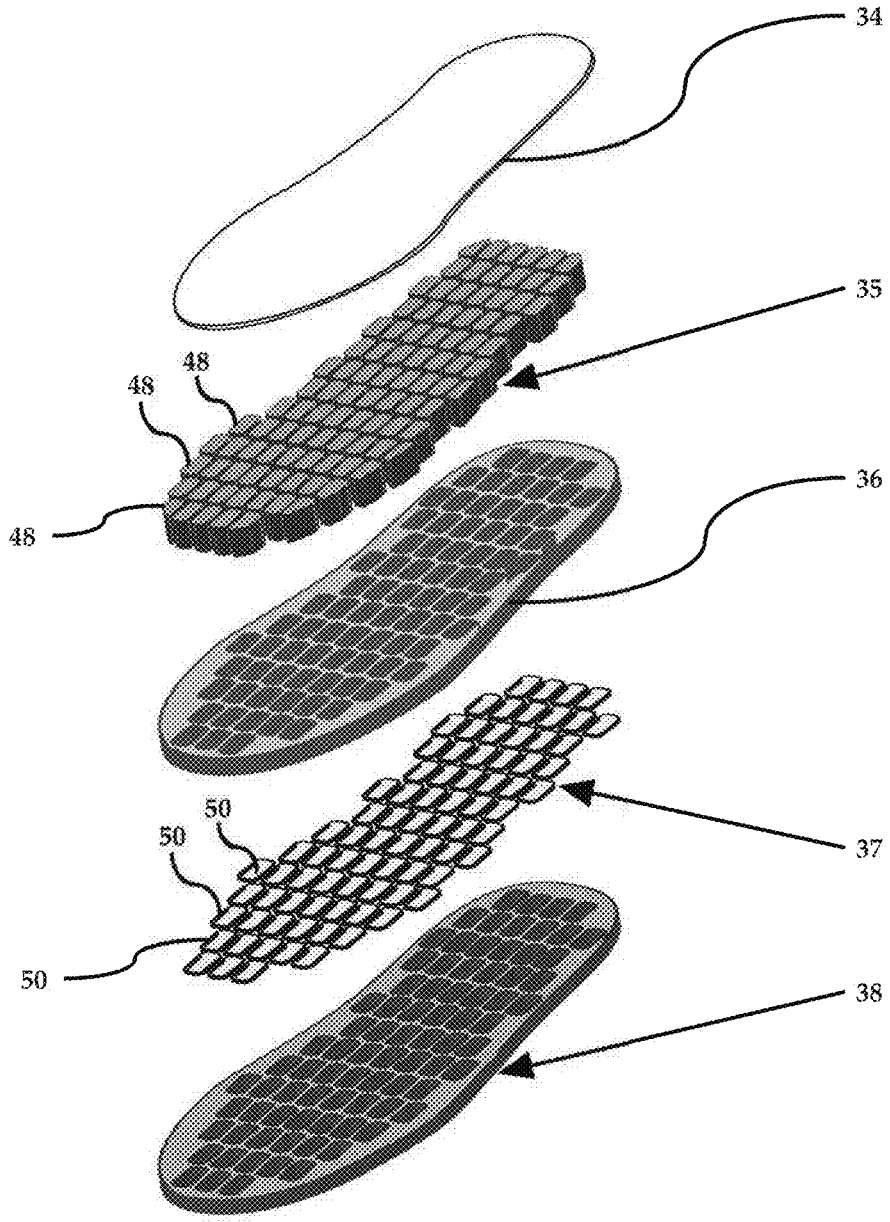
FIG. 9 shows various optional components of the unibody shoe outsole assembly.

FIG. 9 depicts various optional components of the unibody shoe outsole assembly. The components of unibody outsole assembly depicted in FIG. 9 optionally include outsole layer 34; sole pod elements 48 depicted in FIG. 23, an array of which form outsole padding element 35; midsole element 36; partial outsole caps 50 depicted in FIG. 27, an array of which form partial outsole element 37; and full outsole element 38.

Insole Element

Figure 16:
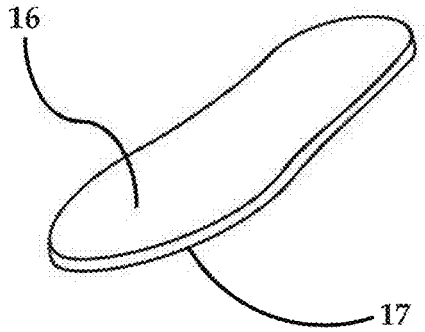
FIG. 16 shows a perspective view of an optional insole element, with bottom surface.

FIG. 16 depicts optional insole element 16, with bottom surface 17.

Figure 17:
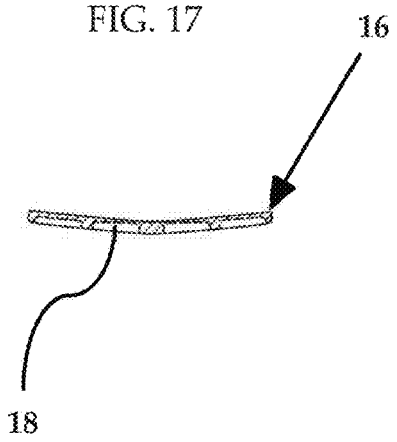
FIG. 17 shows a cross-sectional view of insole element.
Figure 18:
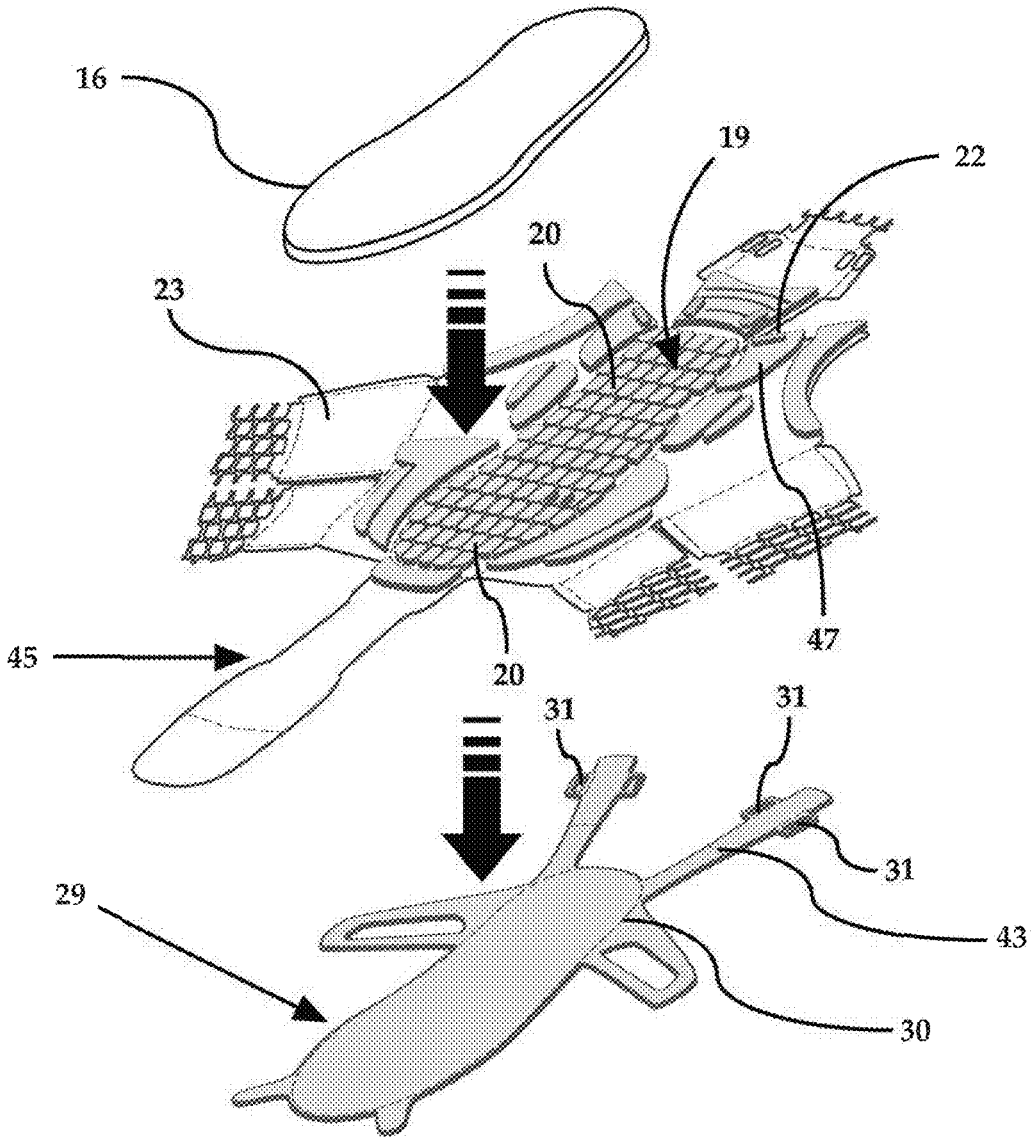
FIG. 18 shows an exploded view of partial layer, full layer and insole engaged together.

FIG. 17 depicts the cross-section of insole element 16. As shown in FIG. 17, optionally the bottom surface 17 of insole element 16 may include apertures 18. The apertures 18 may be shaped or sized to optionally engage or fit one or more cushioning pod elements 20, also as seen in FIG. 18.

Figure 74:
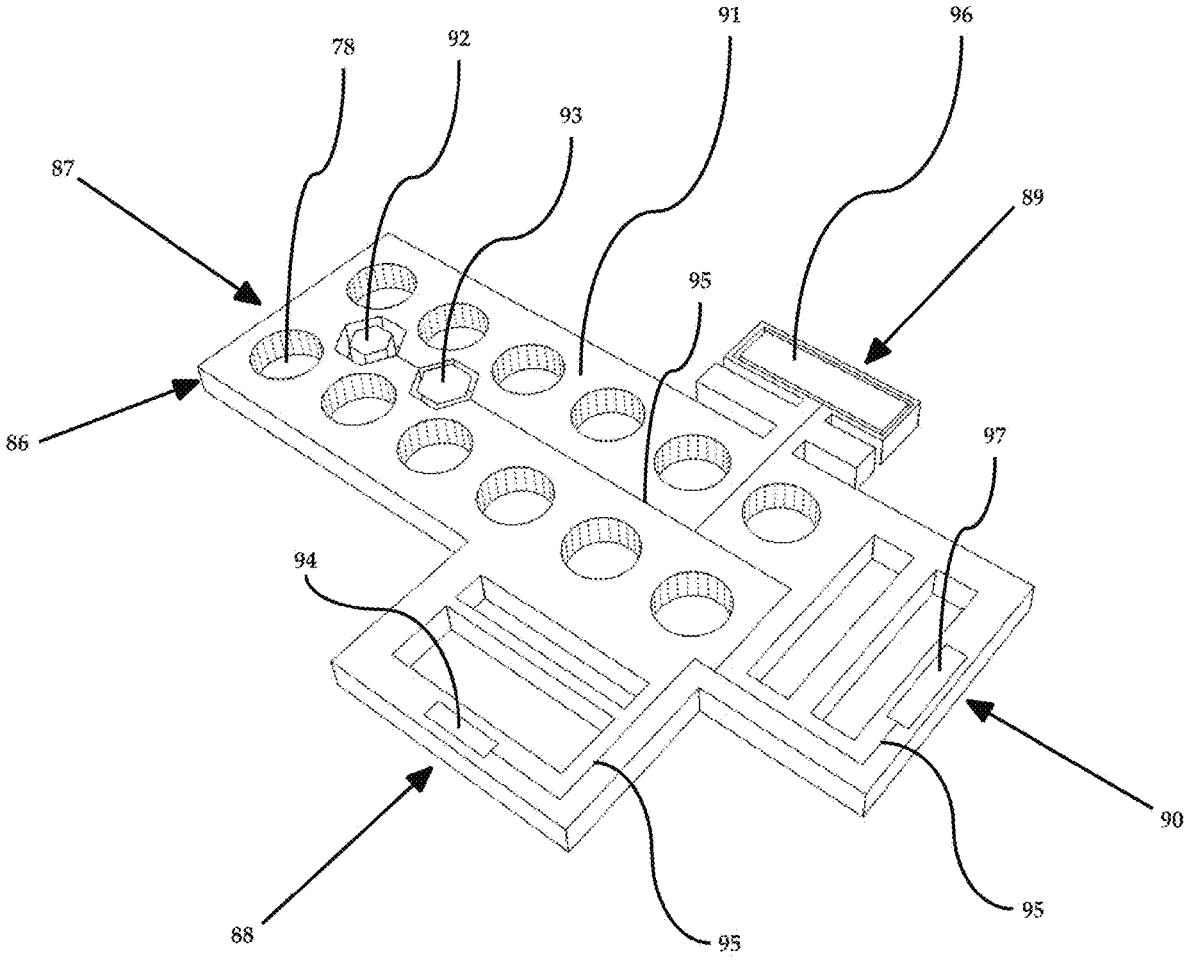
FIG. 74 shows a perspective view of laminate cut and shaped to make a device substrate. Structures shown are represented in a stylized and simplified rendering.
Figure 75:
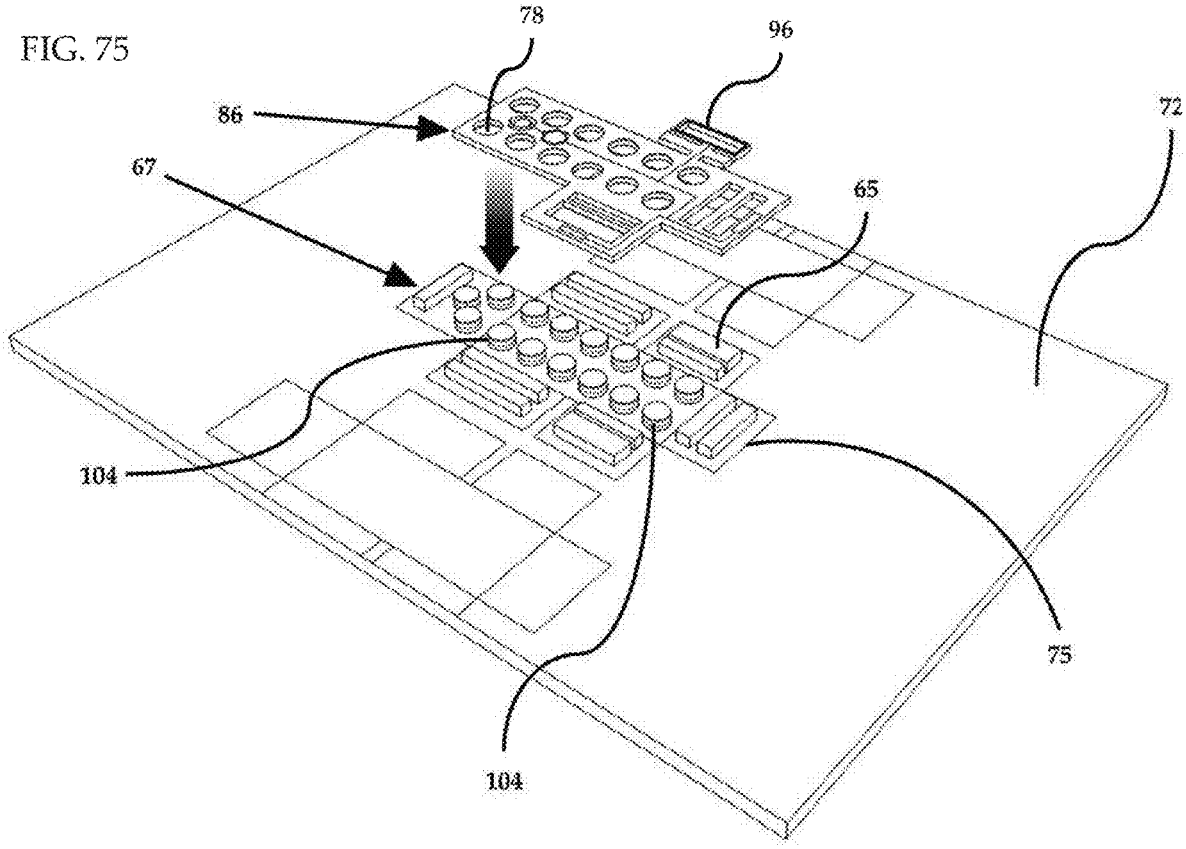
FIG. 75 shows a perspective view of device substrate fitted onto cushioning substrate assembly. Structures shown are represented in a stylized and simplified rendering.
Figure 76:
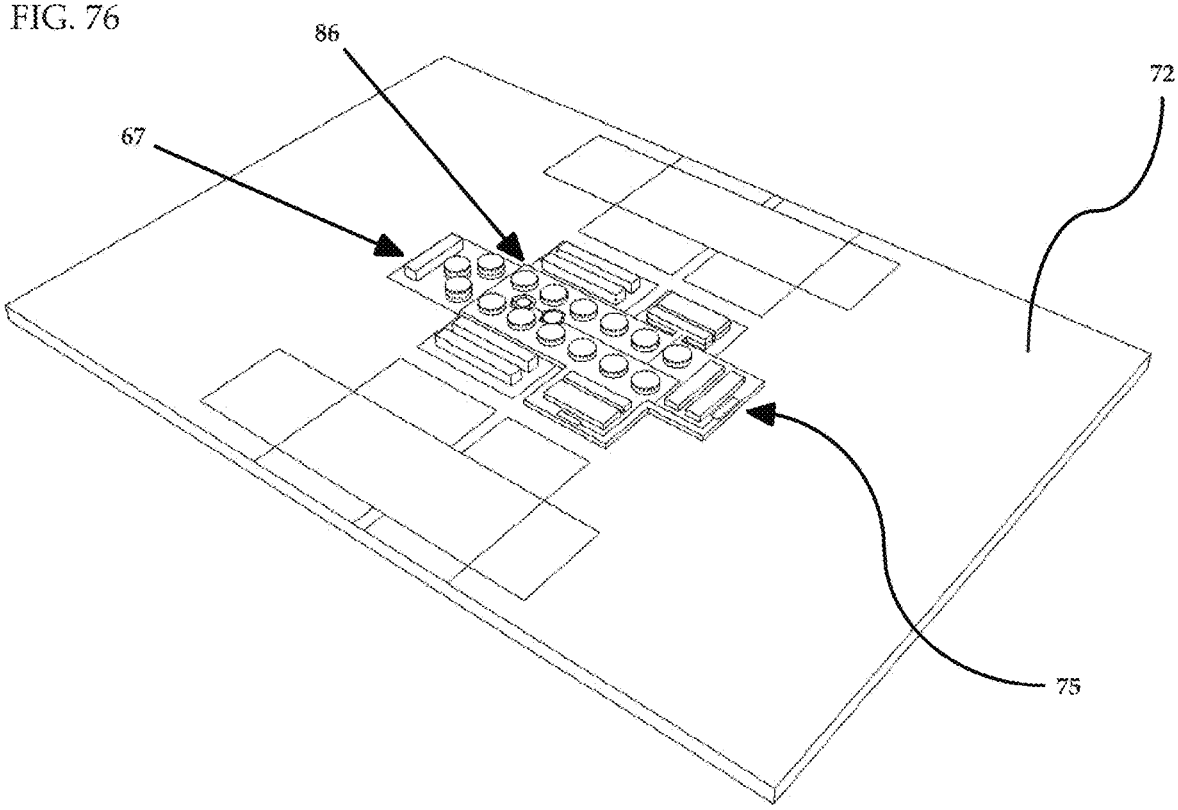
FIG. 76 shows a perspective view of device substrate fitted onto cushioning substrate assembly. Structures shown are represented in a stylized and simplified rendering.

Insole element 16 may optionally be made of cushioning or shock absorbing materials, or materials intended to give structural rigidity to the sole or the entire shoe. Although FIGS. 6, 16, and 17 depict insole element 16 as being flat, it may optionally be arched, sloping, or made of varying shapes, thicknesses, and forms. Alternatively, and optionally, insole element 16 may have embedded or adhered onto them electronic, mechanical, or electro-mechanical devices as depicted in FIGS. 74 through 76.

Although FIG. 16 depicts a single insole element 16, the unibody footwear may optionally include multiple insole elements, in layers or sandwiched between other components.

Moreover, although FIG. 17 depicts apertures 18 on the bottom surface 17, the apertures may optional be located on the top part of insole element 16.

Cushioning Pod Elements and Cushioning Padding Element

Figure 10:
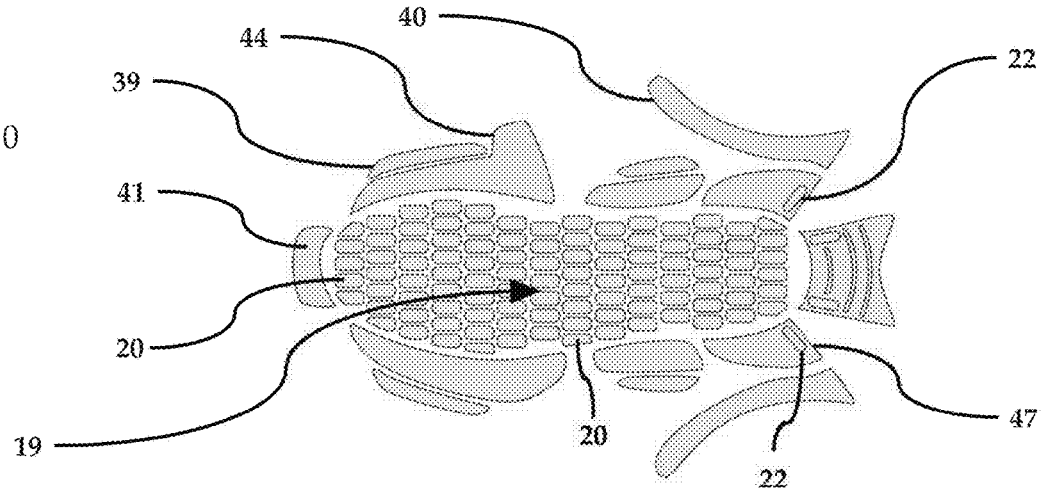
FIG. 10 shows an exploded view highlighting the individual cushioning pod elements, an array of which forms cushioning padding element.

FIG. 10 depicts in greater detail the individual cushioning pod elements 20, an array of which forms cushioning padding element 19.

The cushioning pod elements 20 are preferably made of resilient foam or rubber. Optionally, the cushioning pod elements 20 may also be made of other shock absorbing materials, such as plastic, elastomer, and so forth, and including any combination of such materials. It is understood that a wide variety of materials may be used for this purpose, including, without limitations, ethylene vinyl acetate ("EVA") foam, olefin or polyolefin foam, polyurethane ("PU") foam, urethane based foam, thermoplastic foam, or other material with suitable shock absorbing characteristics, suitably rigidity, or resistant to puncture or abrasion, and the like (including a combination of any such materials). The cushioning pod elements 20 may optionally be solid or perforated. Functionally, the cushioning pod elements may act as a cushion against impact, or provide insulation to heat or cold, or provide ventilation or air circulation, or provide varying rigidity or flexibility to the entire assembly, depending on the types and materials of the cushioning pod elements, the shapes of the cushioning pod elements, their size (including thickness), their number, their placement, and their closeness in relation to each other or other components.

Figure 68:
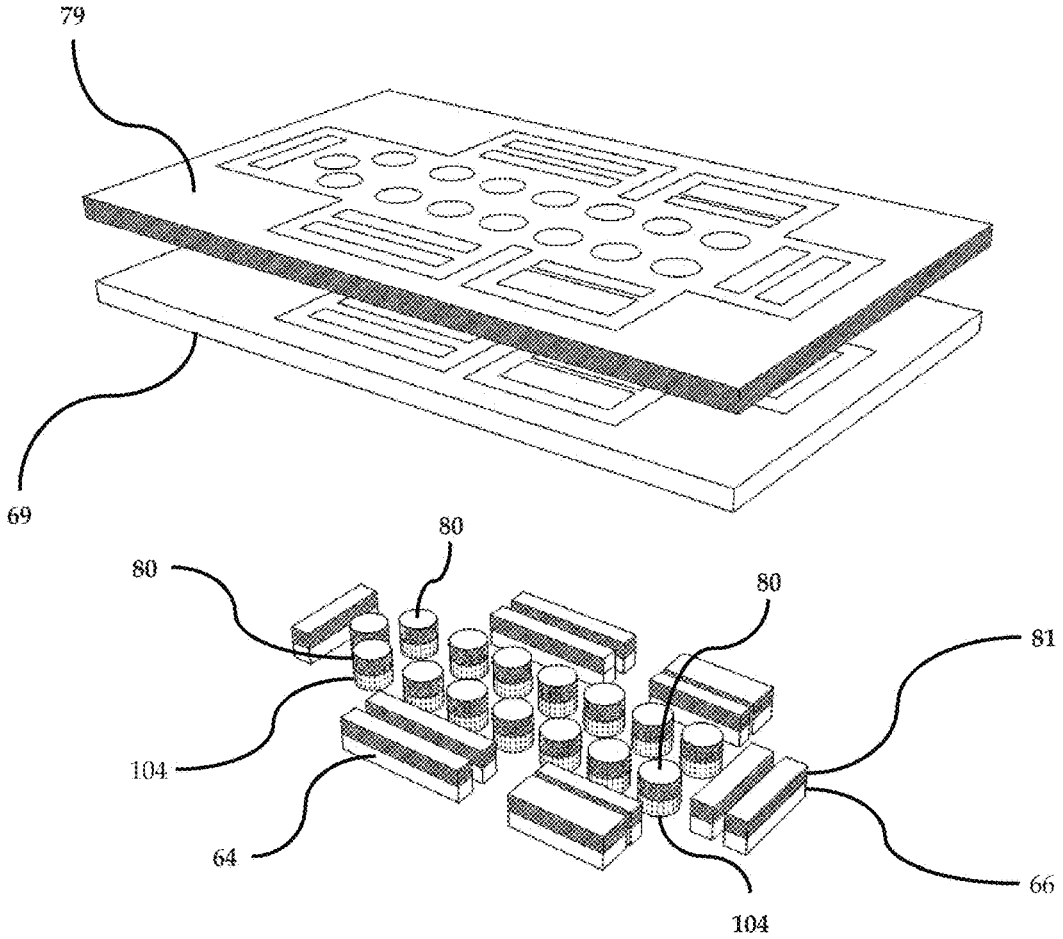
FIG. 68 shows a perspective view of a cushioning substrate combined with an alternative cushioning substrate in order to create an array of cushioning substrate elements made of two different types of materials. Structures shown are represented in a stylized and simplified rendering.
Figure 69:
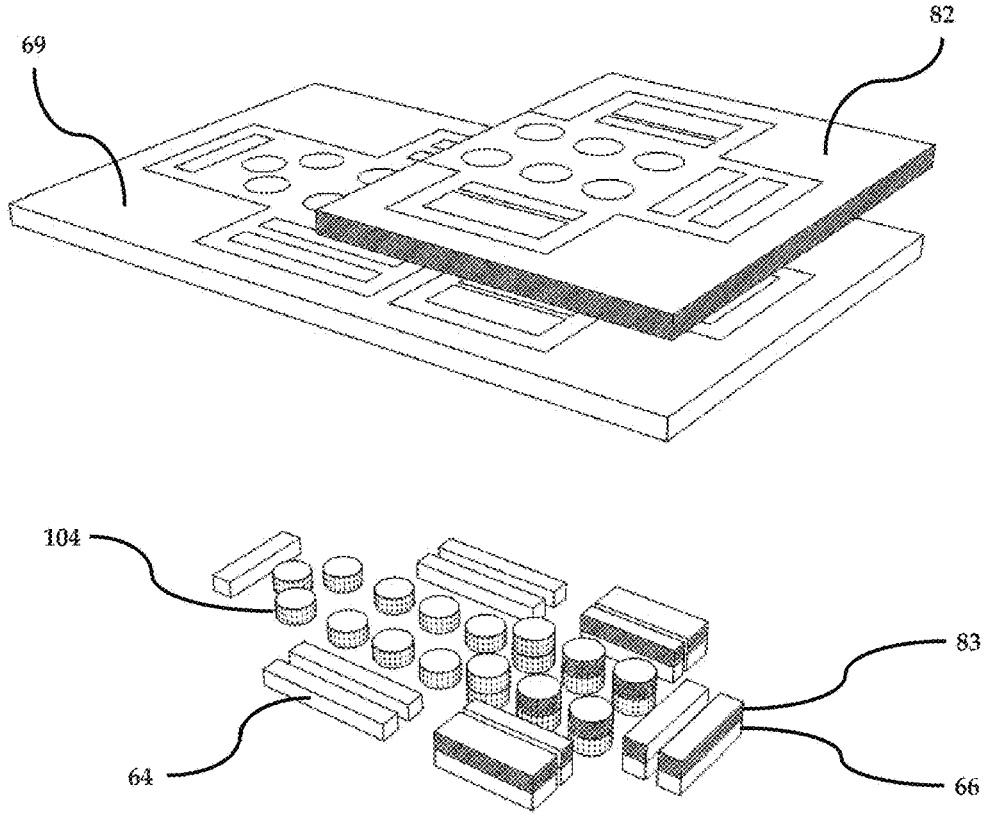
FIG. 69 shows a perspective view of a cushioning substrate combined with an alternative partial cushioning substrate in order to create an array of cushioning substrate elements made of two different types of materials. Structures shown are represented in a stylized and simplified rendering.

It must be understood that cushioning pod elements 20 may be made of different combinations of materials, and combinations of subcomponents with varying sizes and shapes, including, by way of example only, in combinations such as those depicted in FIGS. 68 and 69. By way of example only, cushioning pod elements may be made by bonding or joining two or more different types of materials.

Figure 11:
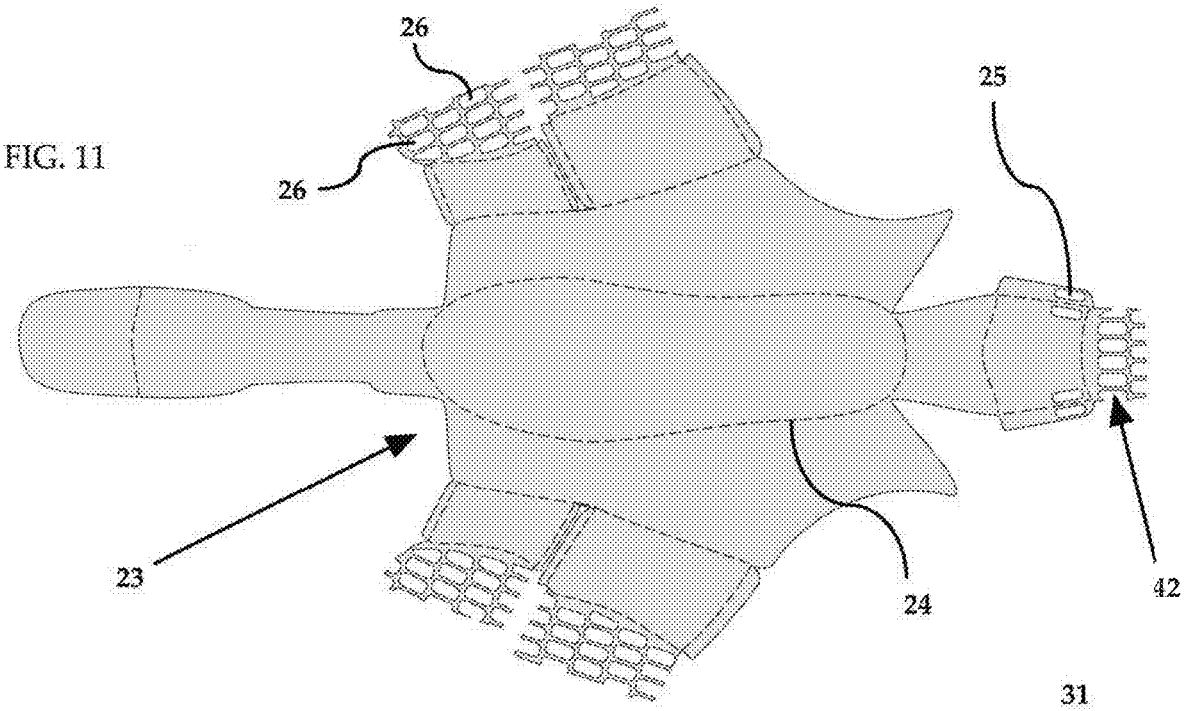
FIG. 11 shows an open view of a full layer used to make an unibody shoe assembly.

FIGS. 6 and 10 depict locking pod elements 22, which may be sized, shaped, and positioned to engage locking pod apertures 25 depicted in FIGS. 6 and 11. Although FIG. 6 depicts locking pod elements 22 attached to one or more cushioning pod elements 20, locking pod elements may optionally be self-standing and adhered or fitted to one or more full layers, partial layers, or insole elements. Furthermore, locking pod apertures 25 may optionally be located in one or more full layer elements, partial layer elements, or insole elements.

Optionally, one or more cushioning pod elements 20 may be sized, shaped, and positioned to engage pod fitting apertures 26, depicted in FIGS. 6 and 11. Although FIGS. 6 and 11 depict pod fitting apertures 26 placed or cut out in full layer 23, pod fitting apertures may optionally be located in one or more full layers, secondary outer layers, or insole elements. Optionally, pod fitting apertures 26 may even be placed or cut out in other cushioning pod elements or cushioning padding elements, if the unibody footwear optionally includes more than one layer of cushioning padding elements, layered or positioned on top of each other.

As depicted in FIG. 6, in one embodiment of the invention, bottom surface 21 of one or more cushioning pod element 20 is placed adjacent to the top surface 27 of full layer 23, and one or more cushioning pod elements 20 may optionally be bonded, glued, sewn, fitted, or made to adhere to top surface 27. Alternatively, and as discussed above, one or more cushioning pod element 20 may also be made to engage pod fitting apertures 26.

It is understood that cushioning pod elements such as, by way of example only, cushioning pod elements 20 depicted in FIG. 10, may be sized, shaped, and positioned in various ways, and made of different materials, to provide varying qualities and characteristics (such as, by way of example only, different degree of shock absorption, structural rigidity, ventilation, coverage, and the like) to different parts or sections of the footwear following completed assembly. Cushioning pod elements 20 are depicted in FIG. 10 as elliptic cylinders in shape. However, it is understood that cushioning pod elements may take on a variety of shapes and dimensions (including irregular or asymmetric shapes), and may be positioned in different areas of the composite materials that form the body structure of the shoe. By way of example only, heel collar cushioning element 40 may optionally be shaped and positioned appropriately, so that once the entire assembly is folded, it provides the intended amount of rigidity, structural integrity, appropriate shape, or cushioning to the "heel collar" area (such as the heel quarter or heel counter) of the completed shoe. Likewise, and optionally, heel cushioning element 47, side cushioning element 44, and toe cap cushioning element 41 may be included, individually or in different combinations, to provide varying amount of rigidity, structural integrity, appropriate shape, or cushioning to the heel, side wall, or toe cap areas of the shoe, respectively. Although FIG. 10 depicts heel collar cushioning element 40, heel cushioning element 47, side cushioning element 44, and toe cap cushioning element 41 as being made of single pieces, they may optionally be made of multiple subcomponents, such as side cushioning subcomponent 39.

Full Layer

FIGS. 6 and 11 depict full layer 23, which may optionally be made of different types of materials, such as natural or synthetic fabric, natural or synthetic leather, mesh, flexible or pliable plastic, latex, silicone, other rubber material, synthetic fiber or composite, or any combination of the foregoing, which may optionally impart different degree of breathability, stretchability, shock absorption, weight, and structural integrity to the assembly. Optionally, the full layer element may also be made of sheets of EVA foam, olefin or polyolefin foam, PU foam, urethane based foam, thermoplastic foam, elastomer, or other material with suitable shock absorbing characteristics, suitably rigidity, or resistant to puncture or abrasion, and the like (including a combination of any such materials).

While FIG. 6 depicts a single full layer 23, it is understood that more than one full layer may be used, layered on top of or above each other, sandwiched or layered with or between different subcomponents (such as cushioning pod elements 20 or cushioning padding element 19, or partial layer 29), or positioned adjacent to each other. By way of example only, full layer 23 may optionally be stacked with another full layer, with partial layers or cushioning pod elements sandwiched between the two full layers; alternatively, and optionally, full layer 23 may be stacked and layered with one or more partial layers.

By way of example only, appropriate material or combination of materials for full layer 23 may optionally be selected depending on the number of full layer elements and partial layer elements to be incorporated into the shoe assembly, and depending on whether the full layer element faces the outer surface of the shoe, or the inner surface of the shoe (that is, makes contact with the foot or the skin).

Alternatively, and optionally, full layer 23 may have embedded or adhered onto them electronic, mechanical, or electro-mechanical devices as depicted in FIGS. 74 through 76.

It is understood that one or more sheets of full layer 23 may optionally be cut into a shape that permits it to be folded along the bottom folding line 24, so as to form a three-dimensional structure appropriately shaped for unibody shoe upper 33. Optionally, full layer 23 may include additional folding lines, such as, and by way of example, top folding line 60, as depicted in FIG. 6.

By way of example only, FIG. 6 depicts optional full layer tongue element 28 as part of full layer 23 laid flat in one embodiment of the invention. FIG. 7 depicts the same full layer tongue element 28 in the same optional embodiment, after full layer 23 has been folded into a three-dimensional structure appropriately shaped for unibody shoe upper 33.

As discussed above, and as depicted in FIG. 11, full layer 23 may optionally include pod fitting apertures 26 sized and positioned to engage one or more cushioning pod elements 20, and locking apertures 25 sized and positioned to engage one or more locking pod elements 22. Pod fitting aperture elements and locking aperture elements may be located in various areas of full layer 23, including, by way of example only, the heel area 42, areas corresponding to the innersole or "bottom" of the shoe, the heel quarter or counter, or the vamp area.

Once full layer 23 has been folded along the folding lines, the seams may optionally be welded or fused, glued, or stitched; alternatively, and optionally, another piece of material (such as fabric, leather, rubber, thermoplastic, and the like) may be placed over the seams and fused, glued, or stitched.

Partial Layer

Figure 12:
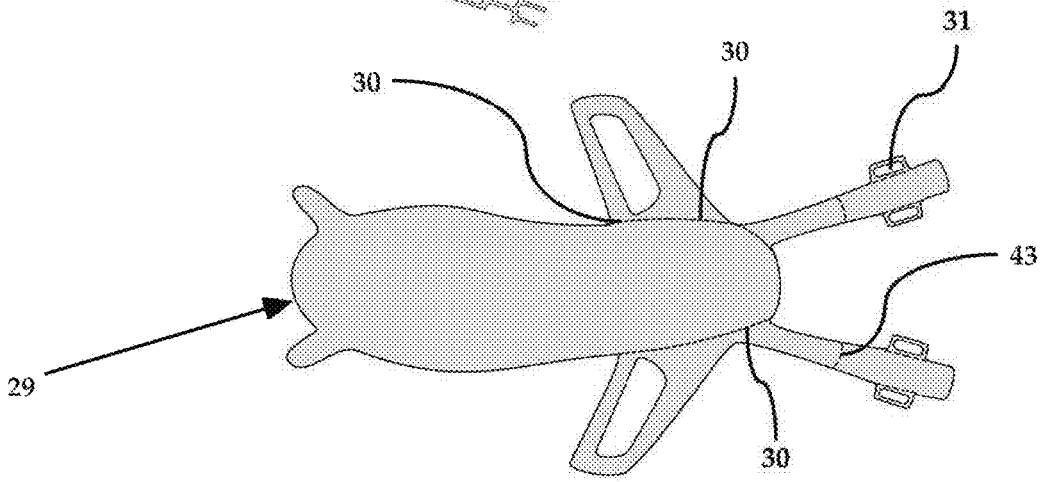
FIG. 12 shows an open view of a partial layer used to make an unibody shoe assembly.

FIGS. 6 and 12 depict partial layer 29, which optionally may also be made of different types of materials, such as natural or synthetic fabric, natural or synthetic leather, mesh, flexible or pliable plastic, latex, neoprene, silicone, other rubber material, synthetic fiber or composite, or any combination of the foregoing, which may optionally impart different degree of breathability, stretchability, shock absorption, weight, and structural integrity to the assembly. Also optionally, the partial layer element may also be made of sheets of EVA foam, olefin or polyolefin foam, PU foam, urethane based foam, thermoplastic foam, elastomer, or other material with suitable shock absorbing characteristics, suitably rigidity, or resistant to puncture or abrasion, and the like (including a combination of any such materials).

FIG. 6 depicts a single partial layer 29. However, it is understood that more than one partial layer may be used, layered on top of or above each other, sandwiched or layered with or between different subcomponents (such as cushioning pod elements 20 or cushioning padding element 19, or full layer 23), or positioned adjacent to each other. By way of example only, partial layer 29 may optionally be stacked with a full layer, with additional full or partial layers or cushioning pod elements sandwiched between the layers of materials; alternatively, and optionally, partial layer 29 may be stacked and layered with one or more partial layers.

Appropriate material or combination of materials for partial layer 29 may optionally be selected depending on the number of full layer elements and partial layer elements to be incorporated into the shoe assembly, and depending on whether the partial layer element faces the outer surface of the shoe, or the inner surface of the shoe (that is, makes contact with the foot or the skin).

Alternatively, and optionally, partial layer 29 may have embedded or adhered onto them electronic, mechanical, or electro-mechanical devices as depicted in FIGS. 74 through 76.

It is understood that one or more sheets of partial layer 29 may optionally be cut into a shape that permits it to be folded along partial layer top folding line 43 and partial layer bottom folding line 30, so as to form a three-dimensional structure appropriately shaped for unibody shoe upper 33.

Partial layer 29 may also include, optionally, partial layer locking pod apertures 31, which may also be sized, shaped, and positioned to engage locking pod elements 22. Although not depicted in FIGS. 6 and 12, partial layer 23 may also include openings similar to pod fitting apertures 26, sized, shaped, and positioned to engage one or more cushioning pod elements 20. Partial layer locking pod aperture elements and pod fitting aperture elements may be located in various areas of partial layer 29.

Optionally, partial layer 29 may be positioned or layered so as to face the outer surface of the shoe while making contact to full layer 23. Also optionally, partial layer 29 may be sized, shaped, positioned, folded, and welded, stitched, or glued so as to cover the "seams" on full layer 23 after it has been folded. In this regard, partial layer 29 may be shaped to optionally include extensions such as partial layer side element 32, depicted in FIG. 6. Optionally, partial layer side element 32 may, in part or in its entirety, be folded over full layer 23 or other instances of partial layer 29, and cover or seal the "seams," or be welded, stitched, glued, or attached over the same.

FIG. 7 depicts one optional embodiment of assembled unibody shoe upper 33, in which partial layer 29 is positioned below full layer 23, and portions of partial layer 29 (such as, for example, partial layer side element 32) are folded over and made to seal the "seams" created in the assembly when full layer 23 is folded into a three-dimensional structure.

Additionally, and optionally, partial layer side element 32 may also be made of a suitably resilient or stretchable material, including composite materials, and be sized, shaped, positioned, and made to adhere to unibody upper shoe assembly so as to provide additional structural integrity to the unibody shoe upper assembly, and to the fully assembled unibody construction footwear.

Examples of Shoe Upper Assembly

Figure 13:
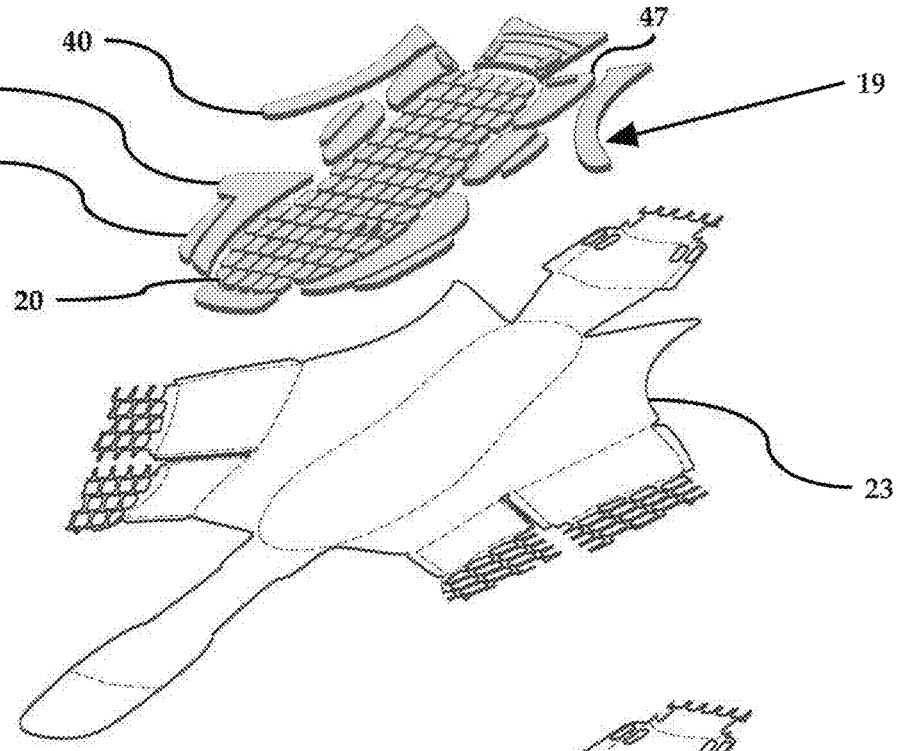
FIG. 13 shows an exploded perspective view of an optional embodiment of the invention, in which cushioning padding element is positioned in relation to full layer.

FIG. 13 depicts one optional embodiment of the invention, in which cushioning padding element 19, incorporating, among other things, multiple cushioning pod elements 20, heel collar cushioning element 40, side cushioning element 44, and side cushioning subcomponent 39, is positioned in relation to full layer 23.

Figure 14:
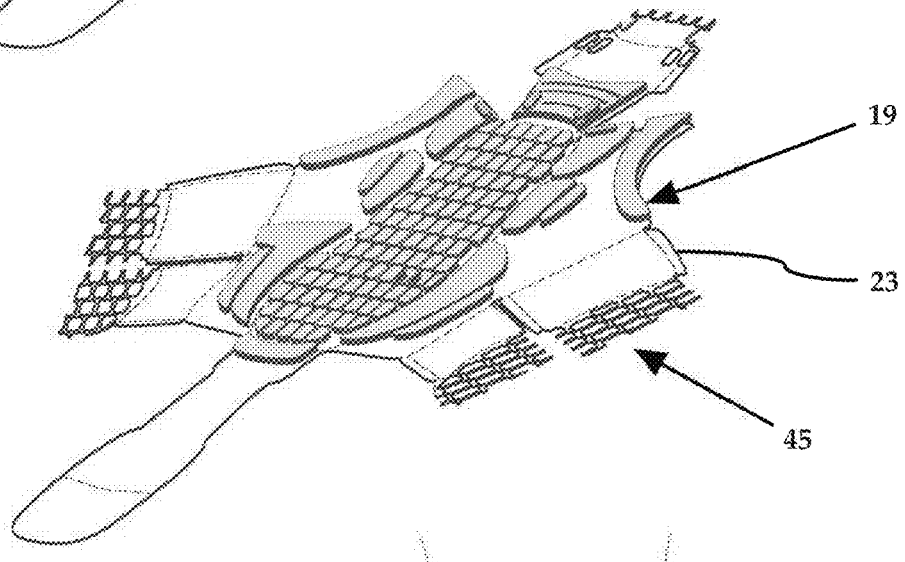
FIG. 14 shows an exploded perspective view of an optional embodiment of the invention, in which cushioning padding element is engaged, glued, or made to adhere to full layer.

FIG. 14 depicts one optional embodiment of the invention, in which cushioning padding element 19 is engaged, glued, or made to adhere to full layer 23.

Figure 15:
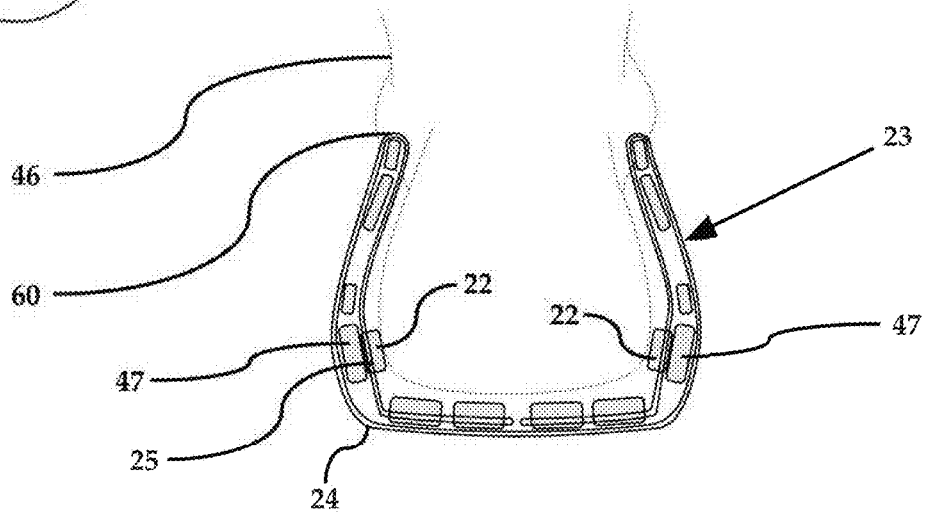
FIG. 15 shows an exploded perspective view of an optional embodiment of the invention, in which cushioning padding element is engaged, glued, or made to adhere to full layer, which is folded into a three-dimensional structure appropriately shaped for unibody shoe upper.

FIG. 15 depicts one optional embodiment of the invention, in which after cushioning padding element 19 is engaged, glued, or made to adhere to full layer 23, full layer 23 is folded into a three-dimensional structure appropriately shaped for unibody shoe upper 33, along top folding line 60 and bottom folding line 24, among others. More specifically, FIG. 15 depicts the cross-section of a person's foot 46 in relation optionally to the folded cushioning padding element and full layer assembly. FIG. 15 also depicts the cross-sectional views of heel cushioning element 47, and locking pod elements 22 engaged to locking pod apertures 25.

FIG. 18 depicts one optional embodiment of the invention, in which insole element 16 is positioned adjacent to the folded cushioning padding element and full layer assembly. FIG. 18 also depicts another aspect of the optional embodiment of the invention, in which partial layer 29 is positioned adjacent to the folded cushioning padding element and full layer assembly.

Figure 19:
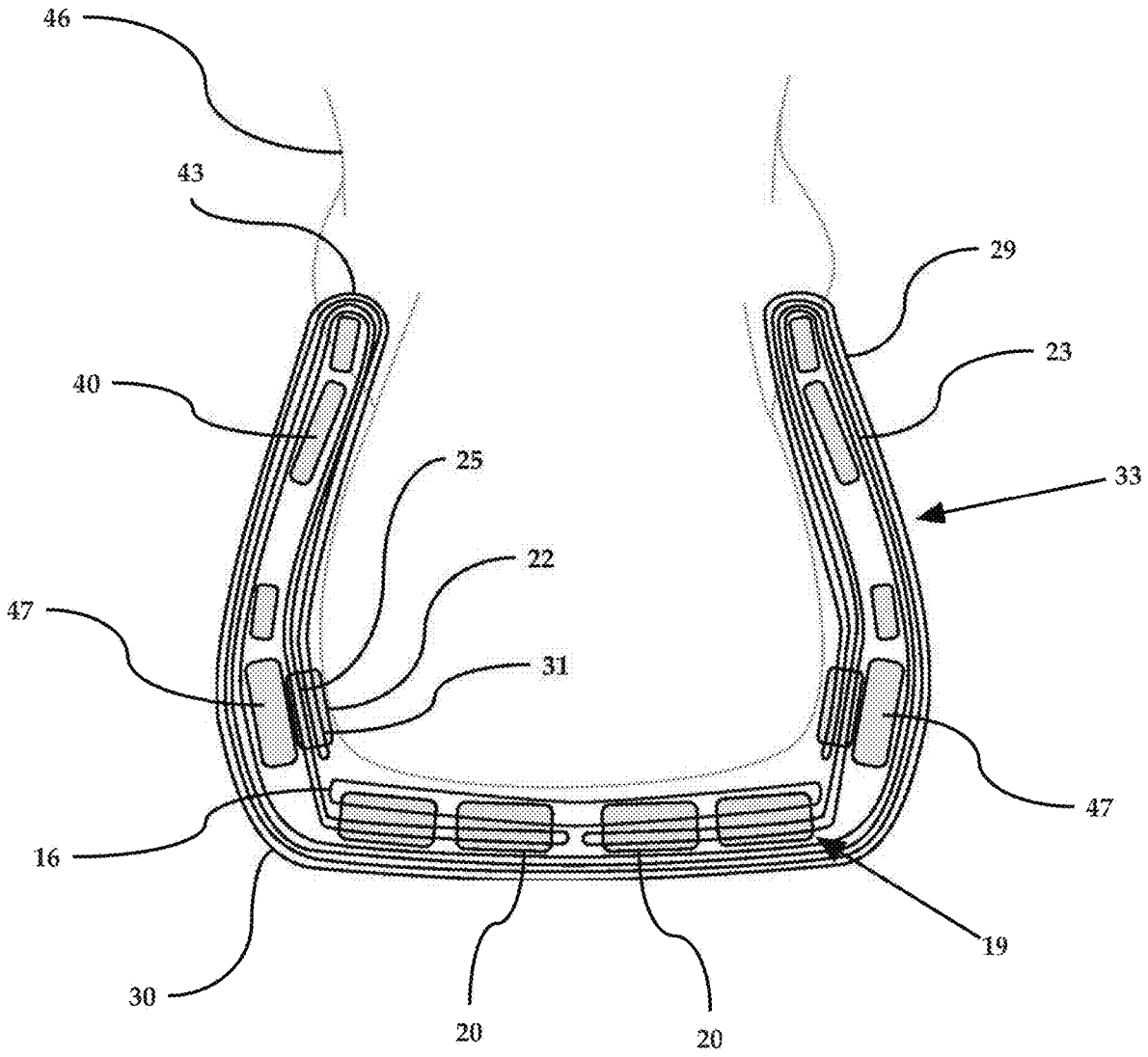
FIG. 19 shows a rear side view of optional embodiment of the invention, in which a layered composite assembly of insole element, an array of cushioning pod elements, full layer, and partial layer is folded into a three-dimensional structure appropriately shaped for unibody shoe upper, in conjunction with the cross-section of a person's foot.

FIG. 19 depicts one optional embodiment of the invention, in which a layered composite assembly of insole element 16, an array of cushioning pod elements 20, full layer 23, and partial layer 29 is folded into a three-dimensional structure appropriately shaped for unibody shoe upper 33, in conjunction with the cross-section of a person's foot 46 in relation optionally to the folded layered composite assembly. FIG. 19 also depicts the cross-sectional views of insole element 16 optionally engaged to multiple cushioning pod elements 20; heel cushioning element 47; and locking pod elements 22 optionally engaged to partial layer locking pod apertures 31 and to locking pod apertures 25. FIG. 19 further depicts the cross-sectional views of heel collar cushioning element 40, and the folding of the entire assembly along partial layer top folding line 43 and partial layer bottom folding line 30.

Figure 20:
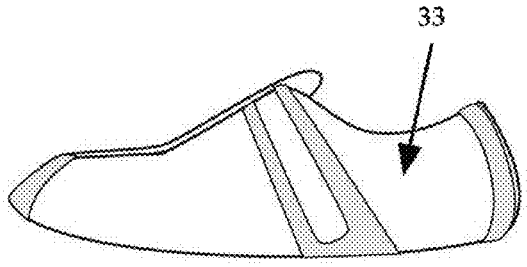
FIG. 20 shows a side view of an assembled unibody shoe upper.

FIG. 20 depicts the assembled unibody shoe upper 33. After the unibody shoe upper 33 has been assembled, optionally the assembly may be stitched or glued to midsole or outsole fabricated using traditional processes.

Alternatively, and optionally, unibody shoe upper 33 may be further assembled with the unibody shoe outsole assembly described below, to make the unibody construction footwear.

Unibody Shoe Outsole Assembly

As described above, FIG. 9 depicts various optional components of the unibody outsole assembly, such as outsole layer 34; sole pod elements 48, an array of which form outsole padding element 35; midsole element 36; partial outsole caps 50, an array of which form partial outsole element 37; and full outsole element 38. Unibody shoe outsole assembly may be made by using one or more of the foregoing components, or a combination of the same.

Figure 21:
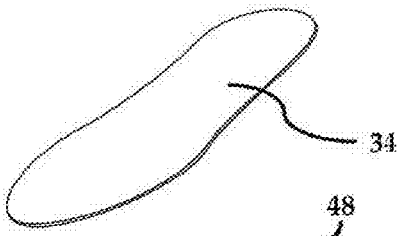
FIG. 21 shows a perspective view of outsole layer.
Figure 22:
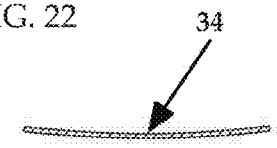
FIG. 22 shows a side view of outsole layer.
Figure 31:
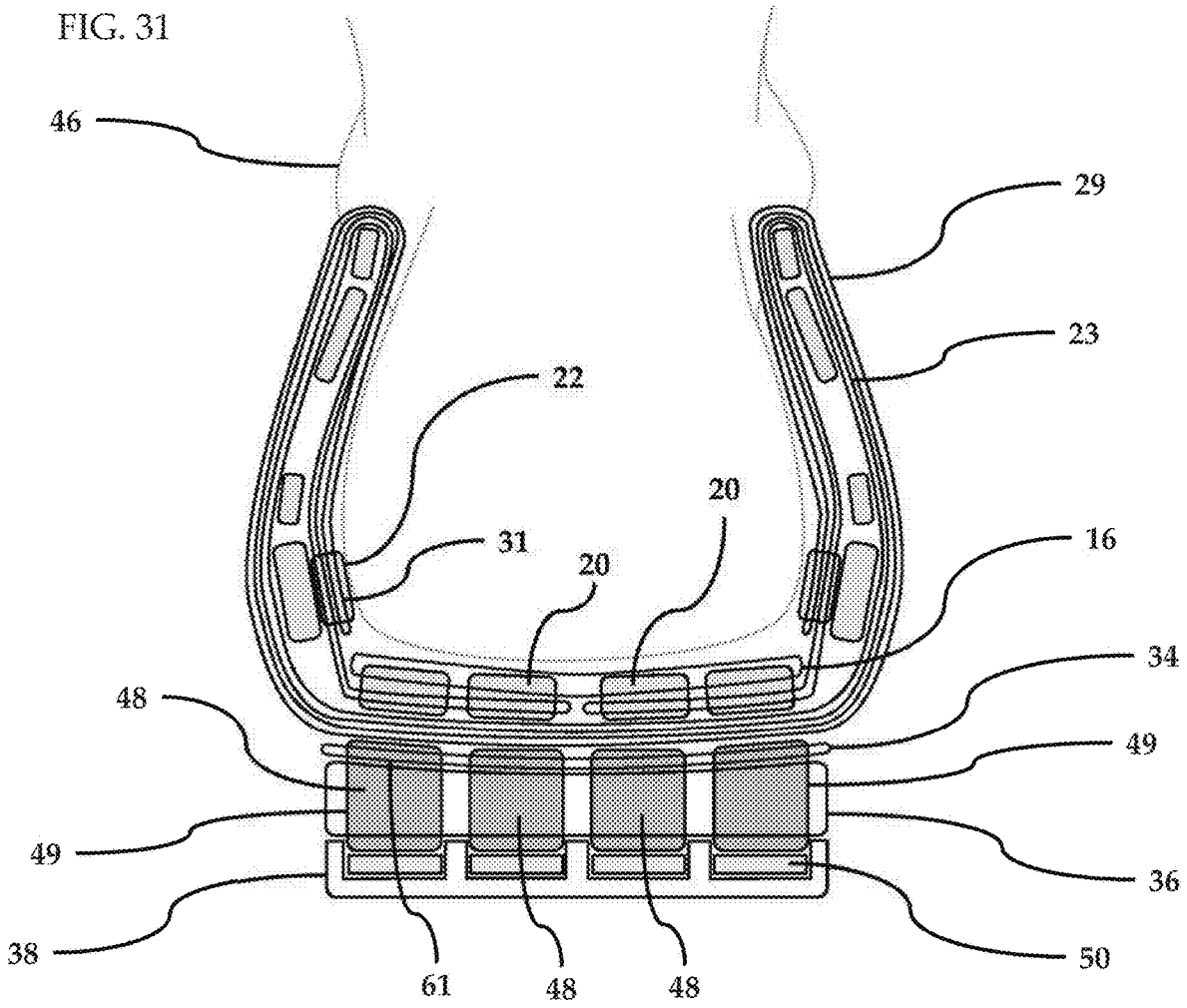
FIG. 31 shows a rear side view of a layered composite assembly of insole element, an array of cushioning pod elements, full layer, and partial layer is folded into a three-dimensional structure appropriately shaped for unibody shoe upper, in conjunction with the cross-section of a person's foot.

FIGS. 21 and 22 depict optional outsole layer 34. As depicted in FIG. 31, outsole layer 34 may optionally include outsole layer apertures 61 sized, shaped, and positioned to engage one or more sole pod elements 48. It is understood that outsole layer 34 may optionally be made of natural or synthetic fabric, natural or synthetic leather, mesh, flexible or pliable plastic, hard plastic or rubber, latex, neoprene, silicone, other rubber material, synthetic fiber or composite, or any combination of the foregoing, which may optionally impart different degree of breathability, stretchability, shock absorption, weight, and structural integrity to the assembly.

Alternatively, and optionally, outsole layer 34 may have embedded or adhered onto it electronic, mechanical, or electro-mechanical devices as depicted in FIGS. 74 through 76.

Figure 23:
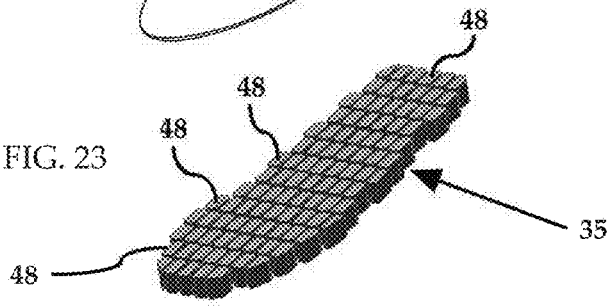
FIG. 23 shows a perspective view of sole pod elements.
Figure 24:
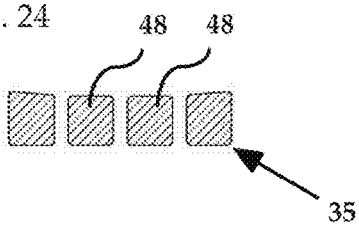
FIG. 24 shows a side view of sole pod elements.

FIGS. 23 and 24 depict optional sole pod elements 48, an array of which forms outsole padding element 35. Optionally, sole pod elements 48 may be made of foam or rubber, or other shock absorbing materials, such as plastic, elastomer, and so forth, and including any combination of such materials. Functionally, the cushioning pod elements may act as a cushion against impact, or provide insulation to heat or cold, or provide ventilation or air circulation, or provide varying rigidity or flexibility to the entire assembly, depending on the sizes (including thickness), types, and materials of the individual sole pod elements, their shapes, their numbers, their placement, and their closeness in relation to each other or other components.

It must be understood that sole pod elements 48 may be made of different combinations of materials, and combinations of subcomponents with varying sizes and shapes, including, without limitations, arrangements similar to those depicted in FIGS. 68 and 69.

In one embodiment of the invention, optionally one or more sole pod elements 48 are sized, shaped, and positioned to engage midsole apertures 49 in midsole element 36.

Figure 25:
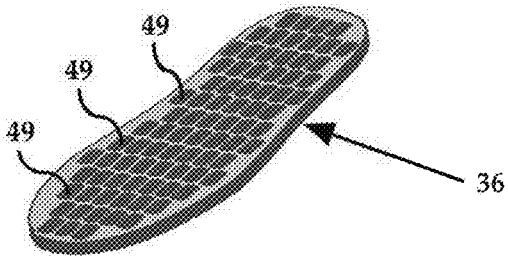
FIG. 25 shows a perspective view of midsole elements.
Figure 26:
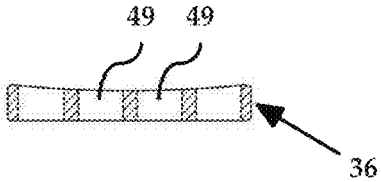
FIG. 26 shows a side view of midsole elements.

FIGS. 25 and 26 depict optional midsole element 36. Optionally, midsole element 36 may include midsole apertures 49, or alternatively or additionally be shaped appropriately so as to engage one or more sole pod elements 48.

Optionally, midsole element 36 may be made of foam or rubber, or other shock absorbing materials, such as plastic, elastomer, and so forth, and including any combination of such materials. Functionally, the midsole element 36 may act as a cushion against impact, absorb shock, or provide varying rigidity or flexibility to the entire assembly, depending on the sizes (including thickness), types, and materials used to make midsole element 36.

Alternatively, and optionally, midsole element 36 may have embedded or adhered onto them electronic, mechanical, or electro-mechanical devices as depicted in FIGS. 74 through 76.

Figure 27:
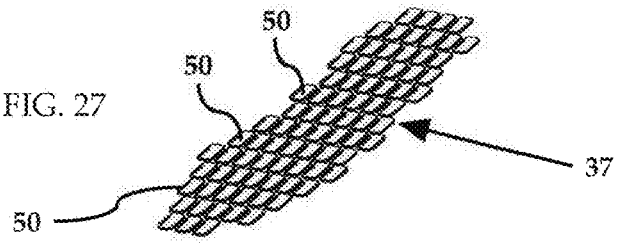
FIG. 27 shows a perspective view of partial outsole caps.
Figure 28:
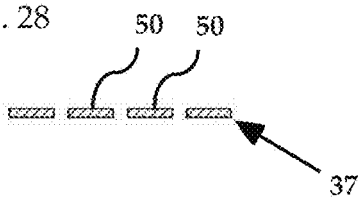
FIG. 28 shows a side view of partial outsole caps.

FIGS. 27 and 28 depict optional partial outsole caps 50, an array of which form partial outsole element 37. Optionally, partial outsole caps 50 may be made of foam or rubber, or other shock absorbing materials, such as plastic, elastomer, and so forth, and including any combination of such materials. Functionally, the cushioning pod elements may act as a cushion against impact, absorb shock, provide protection against abrasion, or provide varying rigidity or flexibility to the entire assembly, depending on the sizes (including thickness), types, and materials of individual partial outsole caps, their shapes, their numbers, their placement, and their closeness in relation to each other or other components.

It must be understood that partial outsole caps 50 may be made of different combinations of materials, and combinations of subcomponents with varying sizes and shapes, including, without limitations, arrangements similar to those depicted in FIGS. 68 and 69.

Figure 29:
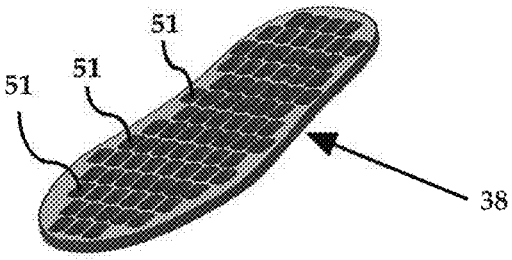
FIG. 29 shows a perspective view of partial outsole element.
Figure 30:
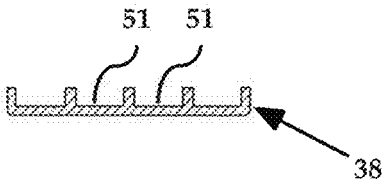
FIG. 30 shows a side view of partial outsole element.

FIGS. 29 and 30 depict optional outsole element 38. Optionally, outsole element 38 may be made of foam or rubber, or other shock absorbing materials, such as plastic, elastomer, and so forth, and including any combination of such materials. Functionally, the outsole element 38 may act as a cushion against impact, absorb shock, provide protection against abrasion, or provide varying rigidity or flexibility to the entire assembly, depending on the sizes (including thickness), types, and materials used to make outsole element 38.

Optionally, outsole element 38 may include outsole locks 51, or alternatively or additionally be shaped appropriately so as to engage one or more sole pod elements 48 or partial outsole caps 50.

Alternatively, and optionally, outsole element 38 may have embedded or adhered onto them electronic, mechanical, or electro-mechanical devices as depicted in FIGS. 74 through 76.

FIG. 31 depicts one optional embodiment of the invention, in which a layered composite assembly of insole element 16, full layer 23, and partial layer 29 is folded into a three-dimensional structure appropriately shaped for unibody shoe upper 33, in conjunction with the cross-section of a person's foot 46 in relation optionally to the folded layered composite assembly (that is, unibody shoe upper 33). FIG. 19 also depicts the cross-sectional views of insole element 16 optionally engaged to multiple cushioning pod elements 20, among other things.

Additionally, FIG. 31 depicts another optional aspect of the invention, in which outsole layer 34 is optionally engaged to multiple sole pod elements 48 by means of outsole layer apertures 61; sole pod elements 48 are optionally engaged to midsole element 36 by means of midsole apertures 49 depicted in FIGS. 25 and 26; partial outsole caps 50 are engaged or adhered to sole pod elements 48; and full outsole element 38 is engaged or adhered to partial outsole caps 50 or sole pod elements 48, or to both of them.

Optionally, the unibody shoe outsole assembly is engaged, stitched, glued, or made to adhere to the folded layered composite assembly (that is, unibody shoe upper 33) as depicted in FIG. 31. In one embodiment of the invention, outsole layer 34 or multiple sole pod elements 48, or both, are engaged, stitched, glued, or made to adhere to unibody shoe upper 33.

Figure 32:
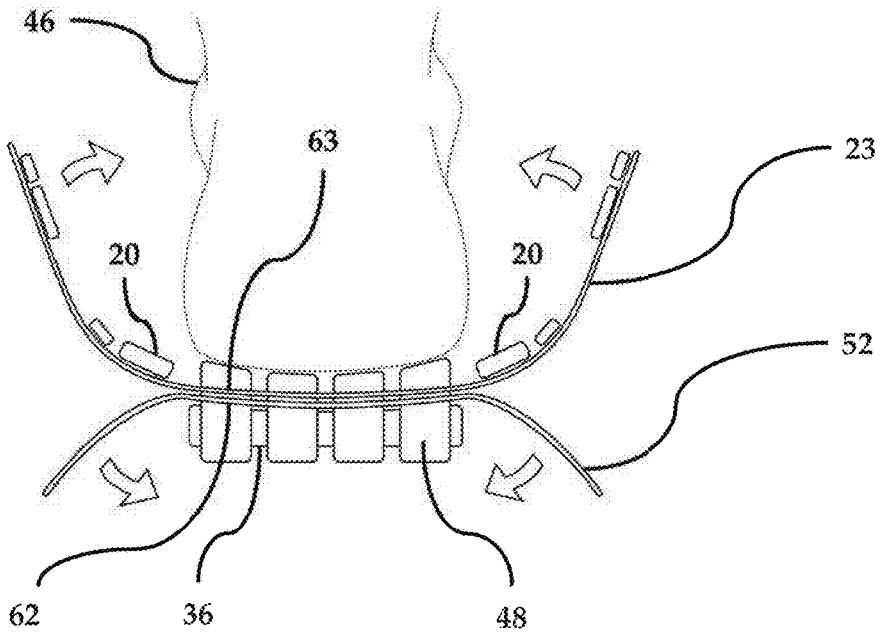
FIG. 32 shows a rear side view of an extended outsole layer that is sized and positioned so as to fold over and "wrap around" or envelop sole pod elements and midsole element, in conjunction with the cross-section of a person's foot.
Figure 33:
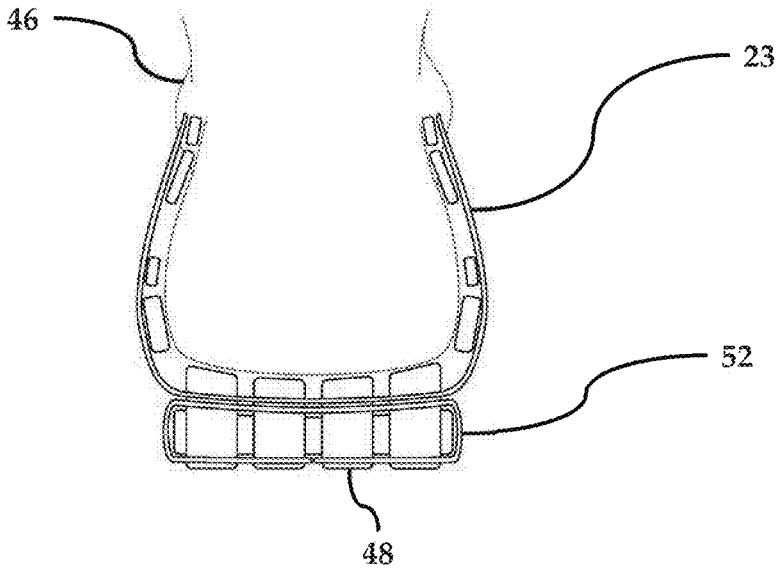
FIG. 33 shows a rear side view of an extended outsole layer folded over and "wrapped around" or enveloping sole pod elements and midsole element, in conjunction with the cross-section of a person's foot.
Figure 34:
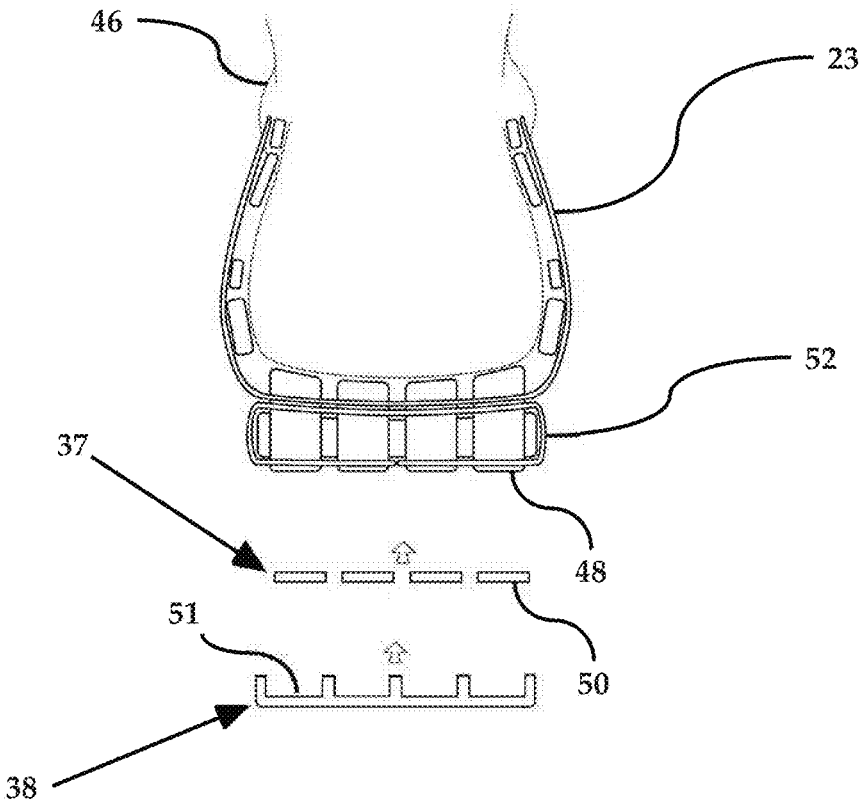
FIG. 34 shows a partially exploded rear side view of an extended outsole layer folded over and "wrapped around" or enveloping sole pod elements and midsole element, and fitted with a partial outsole element or a full outsole element, in conjunction with the cross-section of a person's foot.

FIGS. 32 and 33 depict another optional embodiment of the invention, in which full layer 23 optionally includes openings, that is, full layer sole pod apertures 63, that engage sole pod elements 48. In this embodiment, sole pod elements 48 make contact with the sole of the foot 46 of the person wearing the shoe.

Furthermore, FIG. 32 depicts another optional aspect of the invention, in which extended outsole layer 52 is sized and positioned so as to fold over and "wrap around" or envelop sole pod elements 48 and midsole element 36. In this optional embodiment, the extended outsole layer 52 is optionally engaged to multiple sole pod elements 48 by means of extended outsole layer apertures 62.

FIG. 33 depicts extended outsole layer 52 folded over and "wrapped around" or enveloping sole pod elements 48 and midsole element 36.

As depicted in FIGS. 34 and 37, and FIGS. 44 through 45, partial outsole element 37 or full outsole element 38, or a combination of both, may optionally be engaged, stitched, glued, or made to adhere to the assembly shown in FIGS. 32 through 33.

Figure 35:
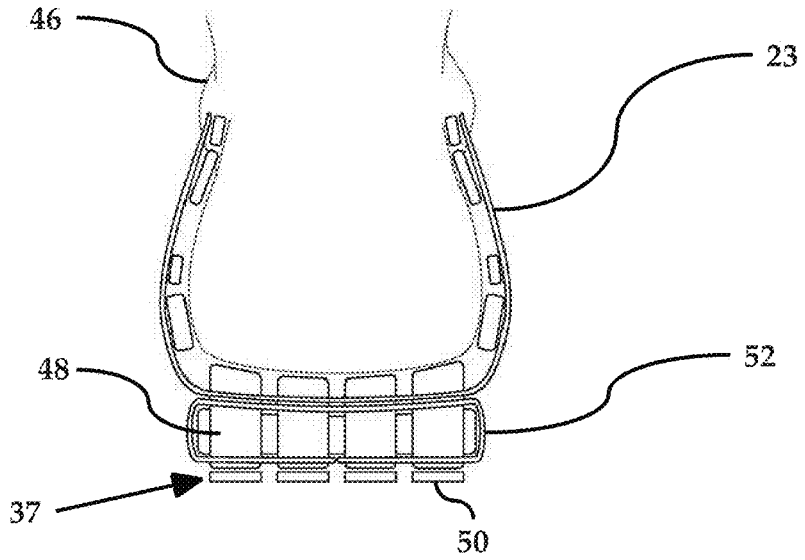
FIG. 35 shows a rear side view of an extended outsole layer folded over and "wrapped around" or enveloping sole pod elements and midsole element, and fitted with a partial outsole element, in conjunction with the cross-section of a person's foot.
Figure 36:
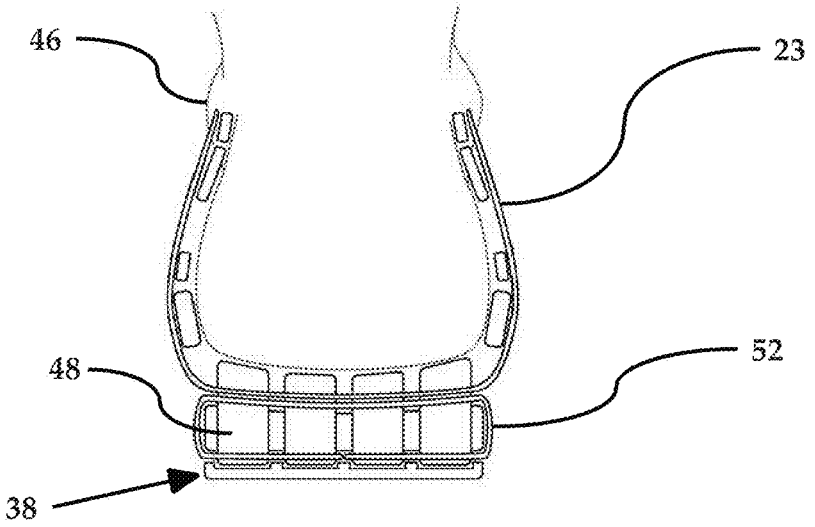
FIG. 36 shows a rear side view of an extended outsole layer folded over and "wrapped around" or enveloping sole pod elements and midsole element, and fitted with a full outsole element, in conjunction with the cross-section of a person's foot.
Figure 37:
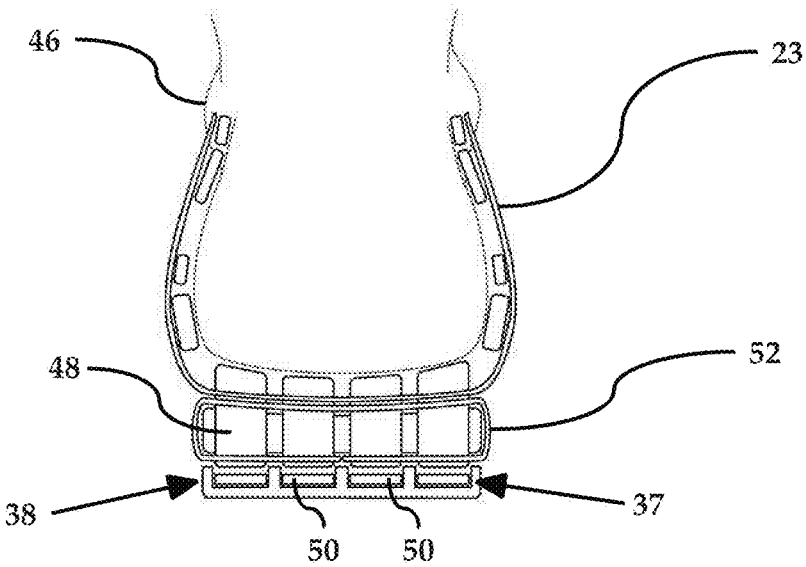
FIG. 37 shows a rear side view of an extended outsole layer folded over and "wrapped around" or enveloping sole pod elements and midsole element, and fitted with a partial outsole element or a full outsole element, in conjunction with the cross-section of a person's foot.
Figure 45:
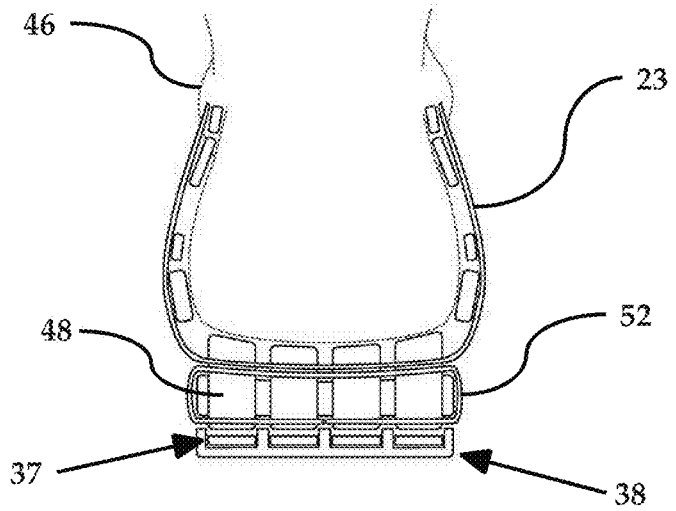
FIG. 45 shows a rear side view of an extended outsole layer folded over and "wrapped around" or enveloping sole pod elements and midsole element, and fitted with a partial outsole element or a full outsole element, in conjunction with the cross-section of a person's foot.

Accordingly, FIG. 35 depicts the assembly shown in FIGS. 32 through 33 engaged, stitched, glued, or made to adhere to partial outsole element 37. FIG. 36 depicts the assembly shown in FIGS. 32 through 33 engaged, stitched, glued, or made to adhere to full outsole element 38. Finally, FIGS. 37 and 45 depict the assembly shown in FIGS. 32 through 33 engaged, stitched, glued, or made to adhere to a combination of partial outsole element 37 and full outsole element 38.

Although FIGS. 31 through 37 depict unibody shoe upper 33 with a single full layer 23, it is understood that, optionally, unibody shoe upper 33 may include more than one full layer 23, or one or more partial layers 29, or a combination of the same.

Figure 38:
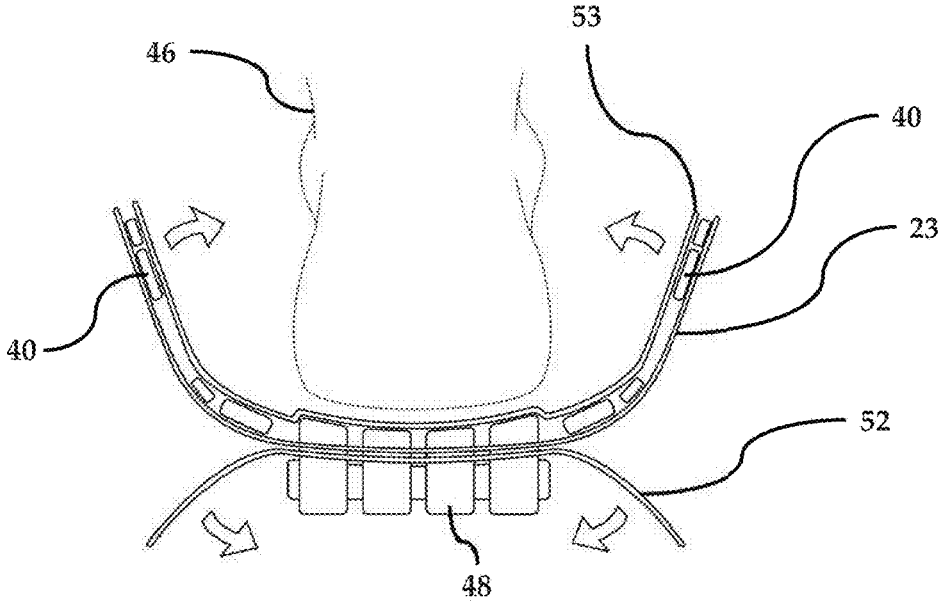
FIG. 38 shows a rear side view of unibody shoe upper assembled with full layer and secondary full layer, in conjunction with the cross-section of a person's foot.
Figure 39:
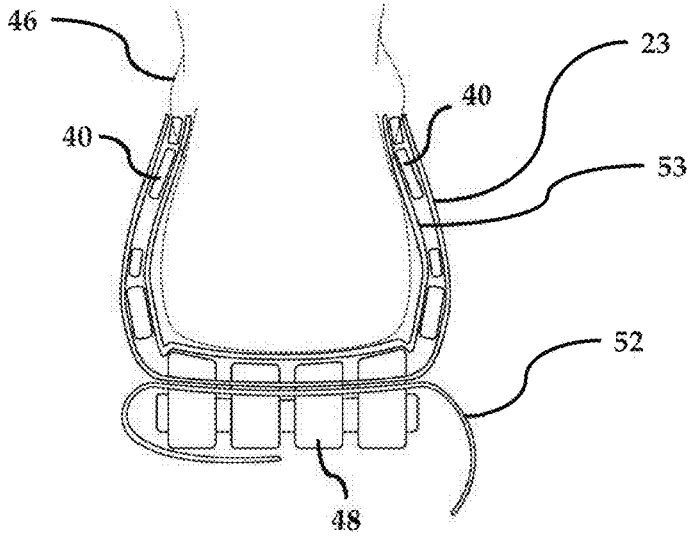
FIG. 39 shows a rear side view of unibody shoe upper assembled with full layer and secondary full layer, with extended outsole layer that is sized and positioned so as to fold over and "wrap around" or envelop sole pod elements and midsole element, in conjunction with the cross-section of a person's foot.
Figure 40:
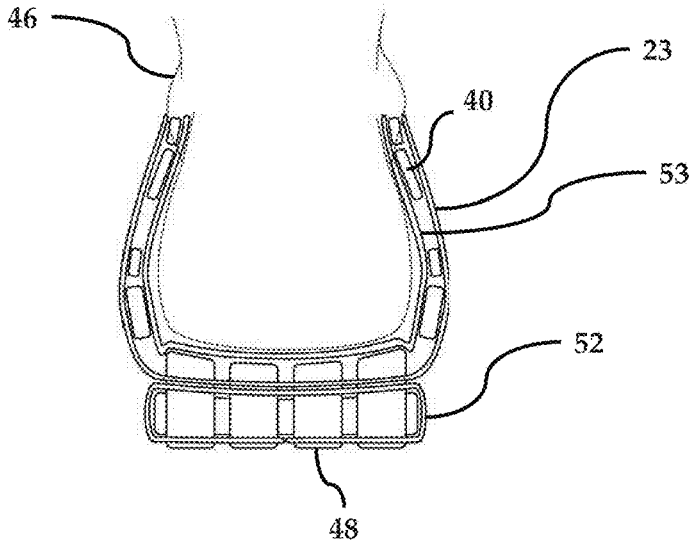
FIG. 40 shows a rear side view of unibody shoe upper assembled with full layer and secondary full layer, with extended outsole layer that is sized and positioned so as to fold over and "wrap around" or envelop sole pod elements and midsole element, in conjunction with the cross-section of a person's foot.

Accordingly, FIGS. 38 through 40 depict the cross-section of unibody shoe upper 33 optionally assembled with full layer 23 and secondary full layer 53. In this optional embodiment of the invention, heel collar cushioning element 40 and heel cushioning element 47, among other things, are optionally "sandwiched" between full layer 23 and secondary full layer 53.

Figure 41:
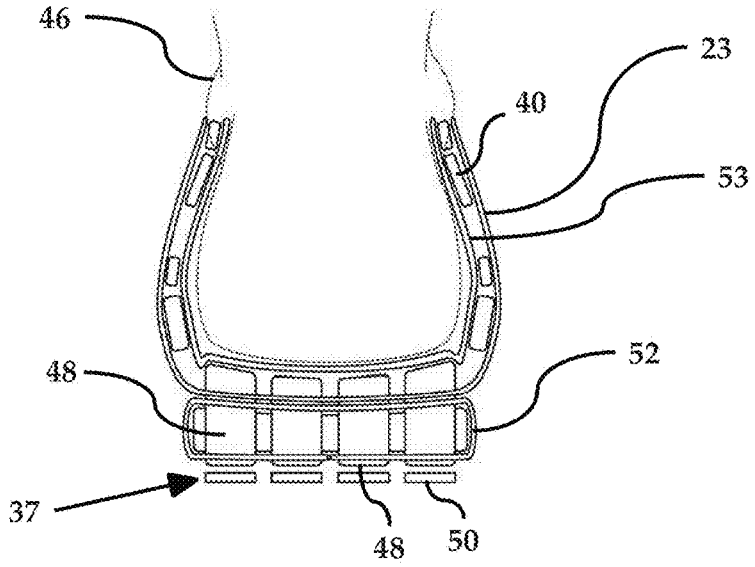
FIG. 41 shows a rear side view of unibody shoe upper assembled with full layer and secondary full layer, with extended outsole layer that is sized and positioned so as to fold over and "wrap around" or envelop sole pod elements and midsole element, and fitted with a partial outsole element, in conjunction with the cross-section of a person's foot.
Figure 42:
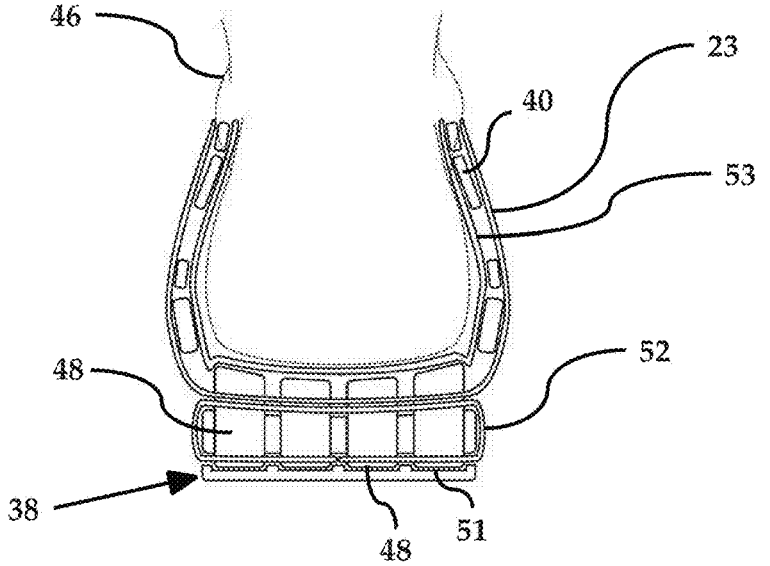
FIG. 42 shows a rear side view of unibody shoe upper assembled with full layer and secondary full layer, with extended outsole layer that is sized and positioned so as to fold over and "wrap around" or envelop sole pod elements and midsole element, and fitted with a full outsole element, in conjunction with the cross-section of a person's foot.
Figure 43:
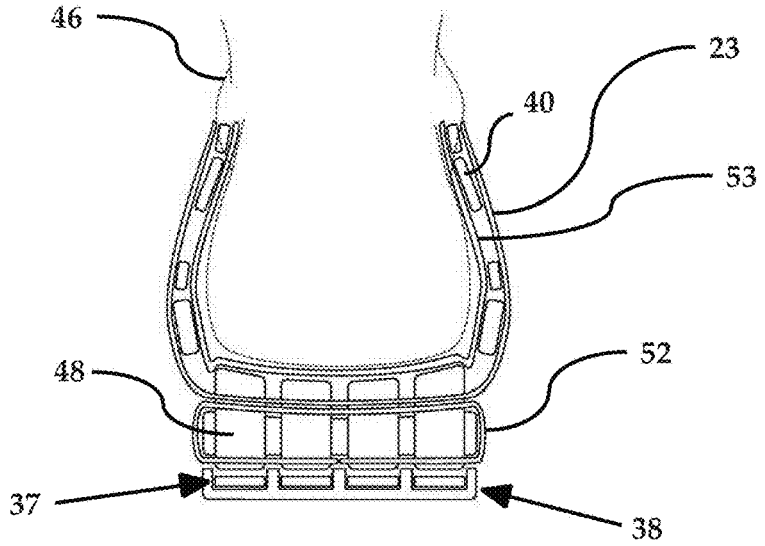
FIG. 43 shows a rear side view of unibody shoe upper assembled with full layer and secondary full layer, with extended outsole layer that is sized and positioned so as to fold over and "wrap around" or envelop sole pod elements and midsole element, and fitted with a partial outsole element and full outsole element, in conjunction with the cross-section of a person's foot.
Figure 44:
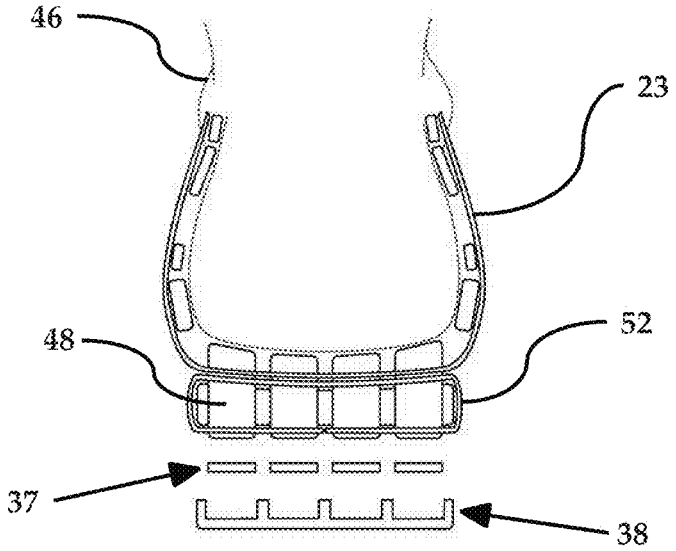
FIG. 44 shows a partially exploded rear side view of an extended outsole layer folded over and "wrapped around" or enveloping sole pod elements and midsole element, and fitted with a partial outsole element or a full outsole element, in conjunction with the cross-section of a person's foot.
Figure 46:
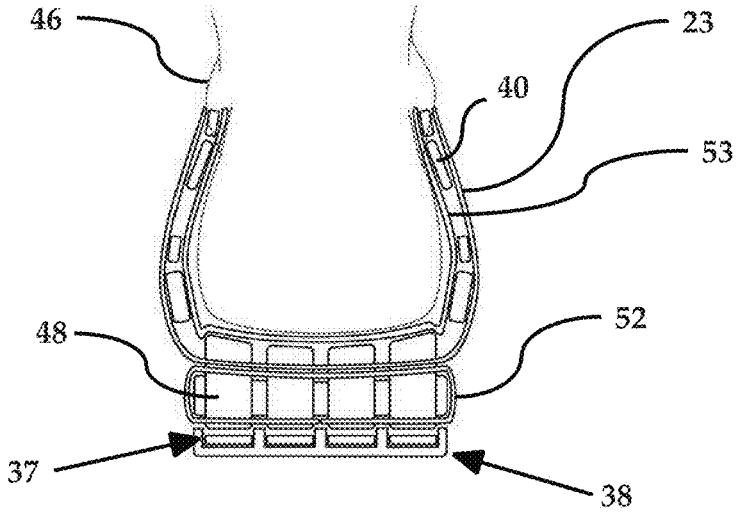
FIG. 46 shows a rear side view of unibody shoe upper assembled with full layer and secondary full layer, with extended outsole layer that is sized and positioned so as to fold over and "wrap around" or envelop sole pod elements and midsole element, and fitted with a partial outsole element and full outsole element, in conjunction with the cross-section of a person's foot.

As depicted in FIGS. 41 through 43 and in FIG. 46, partial outsole element 37 or full outsole element 38, or both, may optionally be engaged, stitched, glued, or made to adhere to the assembly shown in FIG. 40. Accordingly, FIG. 41 depicts the assembly shown in FIG. 40 engaged, stitched, glued, or made to adhere to partial outsole element 37. FIG. 42 depicts the assembly shown in FIG. 40 engaged, stitched, glued, or made to adhere to full outsole element 38. Finally, FIGS. 43 and 46 depict the assembly shown in FIG. 40 engaged, stitched, glued, or made to adhere to a combination of partial outsole element 37 and full outsole element 38.

Figure 47:
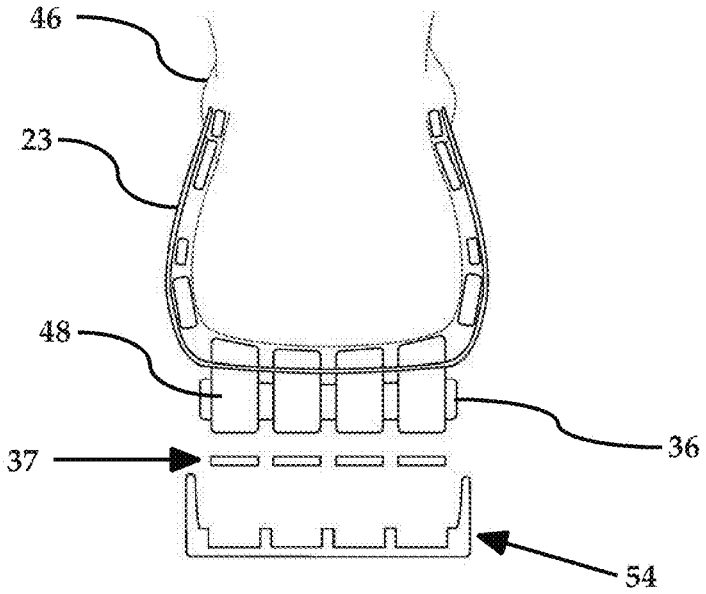
FIG. 47 shows a rear side view of unibody shoe upper assembly with extended full outsole element, in conjunction with the cross-section of a person's foot.
Figure 48:
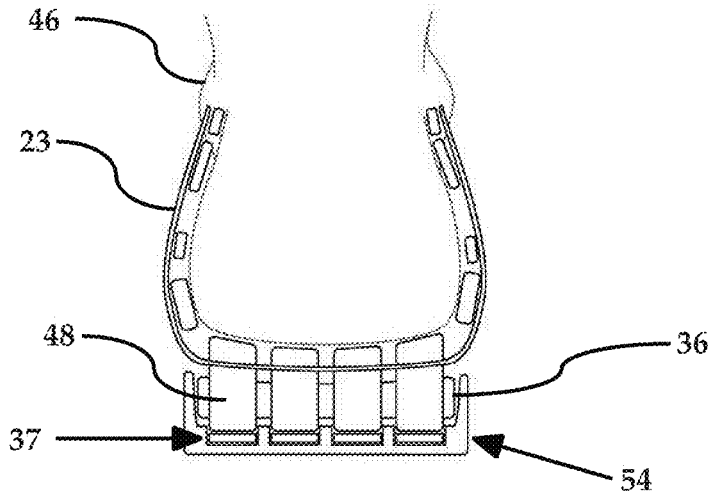
FIG. 48 shows a rear side view of unibody shoe upper assembly with partial outsole element and extended full outsole element, in conjunction with the cross-section of a person's foot.
Figure 49:
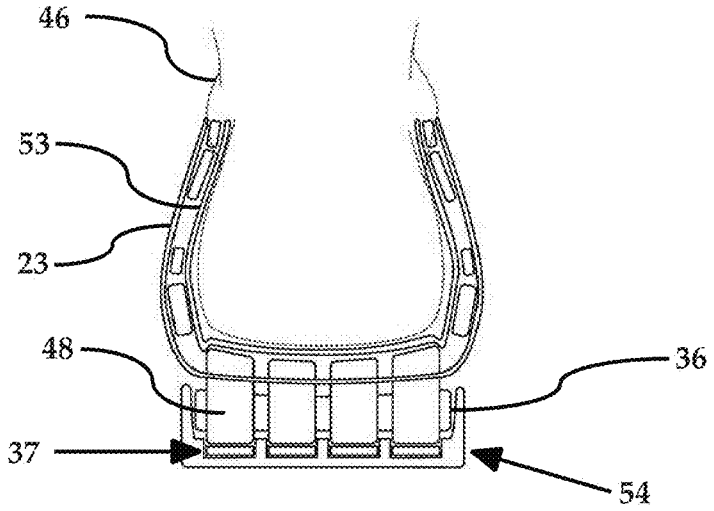
FIG. 49 shows a rear side view of unibody shoe upper assembly with partial outsole element and extended full outsole element, in conjunction with the cross-section of a person's foot.
Figure 50:
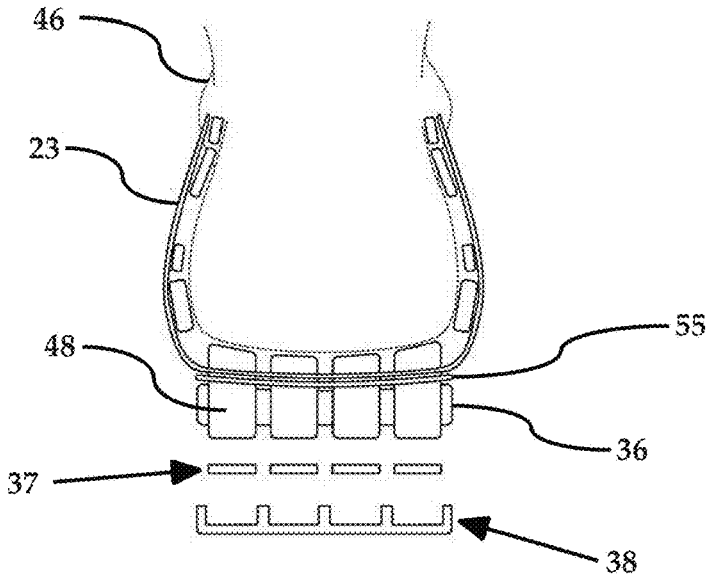
FIG. 50 shows a rear side view of unibody shoe upper assembly with outsole element, and partial outsole element and full outsole element, in conjunction with the cross-section of a person's foot.
Figure 51:
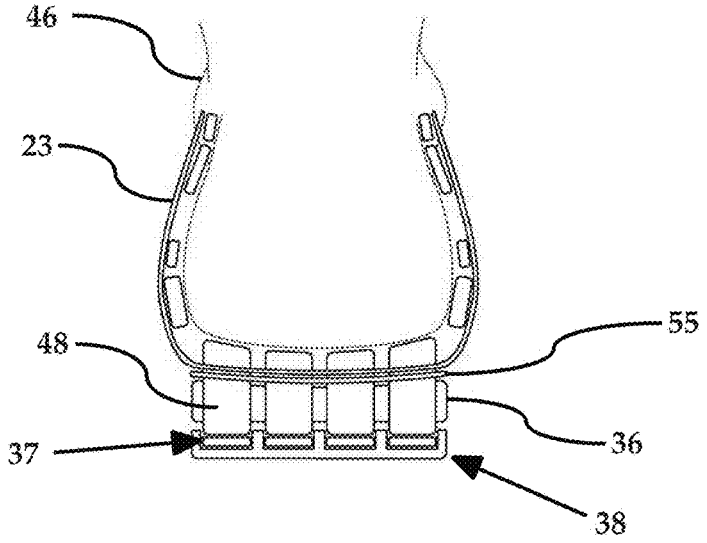
FIG. 51 shows a rear side view of unibody shoe upper assembly with outsole element, and partial outsole element and full outsole element, in conjunction with the cross-section of a person's foot.

It is understood that full outsole element 38 may vary in dimension and size, including thickness or height. In one optional embodiment of the invention, the perimetral edge of the full outsole element 38 may be shaped and sized so as to extend up to unibody shoe upper 33. FIGS. 47 through 48 depict the assembly shown in FIG. 33 engaged, stitched, glued, or made to adhere to extended full outsole element 54. FIG. 49 depicts the assembly shown in FIG. 40 engaged, stitched, glued, or made to adhere to extended full outsole element 54.

As further depicted in FIGS. 41 through 43, and FIGS. 50 through 54, numerous optional combinations and permutations are possible by combining outsole layer 34 (identified in FIGS. 50 through 52 as outsole element 55) or extended outsole layer 52, with partial outsole element 37, full outsole element 38, extended full outsole element 54, or a combination of the foregoing.

Figure 53:
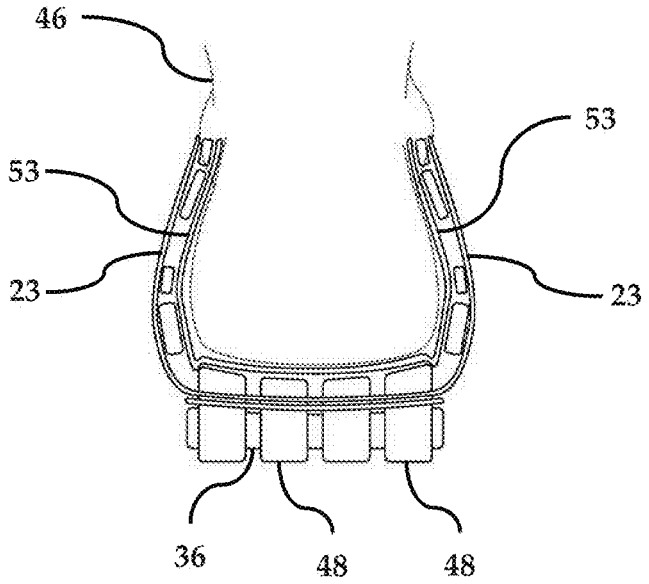
FIG. 53 shows a rear side view of unibody shoe upper assembly without outsole element, and partial outsole element and full outsole element, in conjunction with the cross-section of a person's foot.

It is also understood that optionally, the present invention does not have to include partial outsole element 37, full outsole element 38, or extended full outsole element 54, as depicted in FIG. 53.

Figure 52:
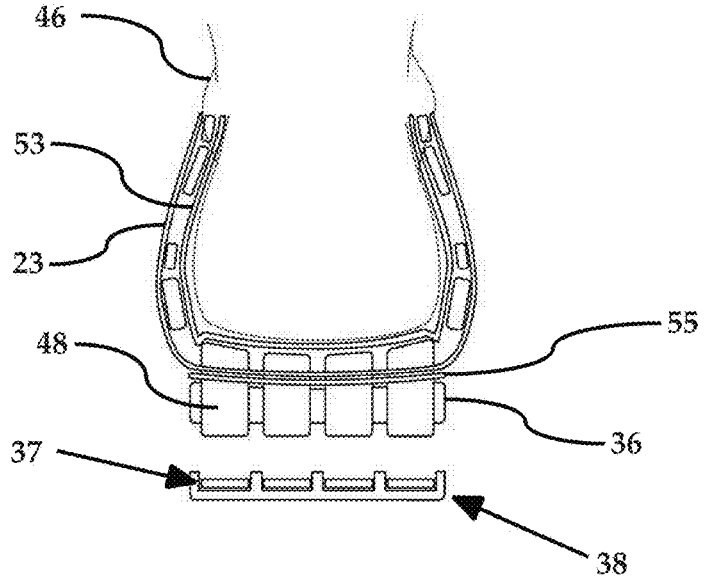
FIG. 52 shows a rear side view of unibody shoe upper assembly with outsole element, and partial outsole element and full outsole element, in conjunction with the cross-section of a person's foot.
Figure 54:
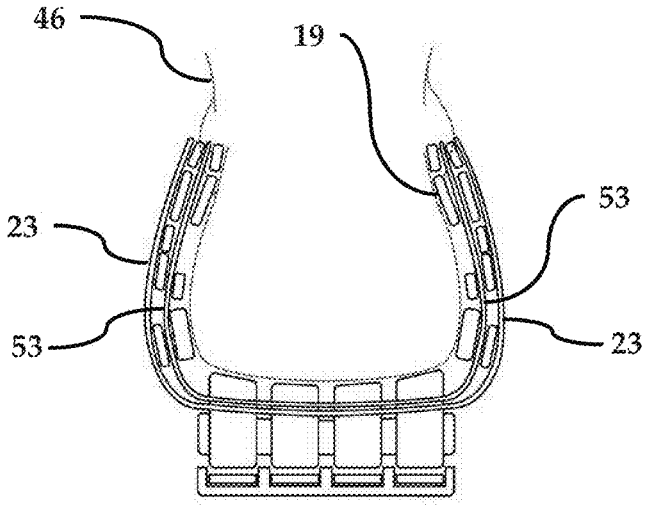
FIG. 54 shows a rear side view of unibody shoe upper assembly with full layer and secondary full layer, in conjunction with the cross-section of a person's foot.

Additionally, as depicted in FIGS. 43, 45, and 52, numerous optional combinations and permutations are possible by using one or more full layer 23 in assembling unibody shoe upper 33. By way of example only, optionally a single full layer 23 may be used as depicted in FIG. 45; or optionally full layer 23 and secondary full layer 53 may be used together, as depicted in FIGS. 46 and 52; or optionally, full layer 23 and secondary full layer 53 may also be used in conjunction with multiple instances, or layers, of cushioning padding element 19, as depicted in FIG. 54.

Figure 55:
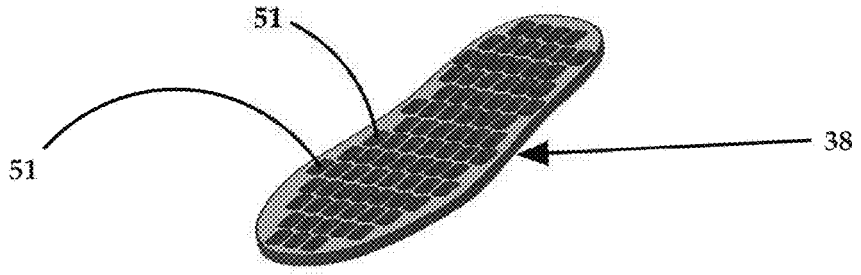
FIG. 55 shows a perspective view of partial outsole element.

FIGS. 29, 30 and 55 depict outsole element 38 as being made of a single, flat contiguous piece. However, it is understood that, optionally, outsole element 38 may be curved or "arched" three-dimensionally.

Figure 56:
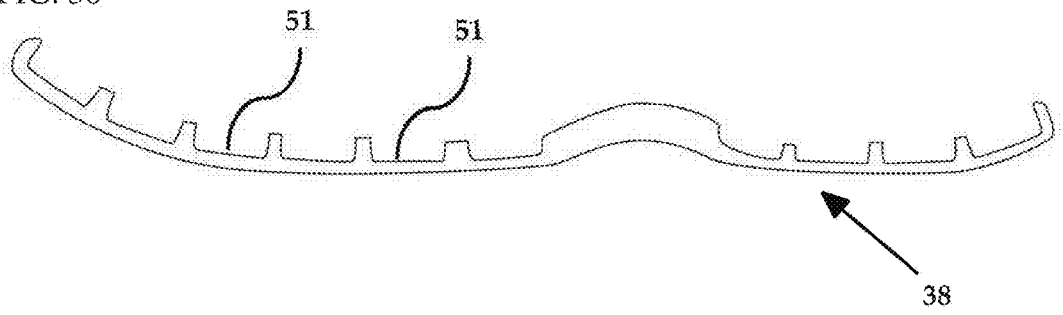
FIG. 56 shows a cross-sectional view of outsole element, which incorporates an "arch."

FIG. 56 depicts a cross-section of an optional embodiment of outsole element 38, which incorporates an "arch."

Figure 57:
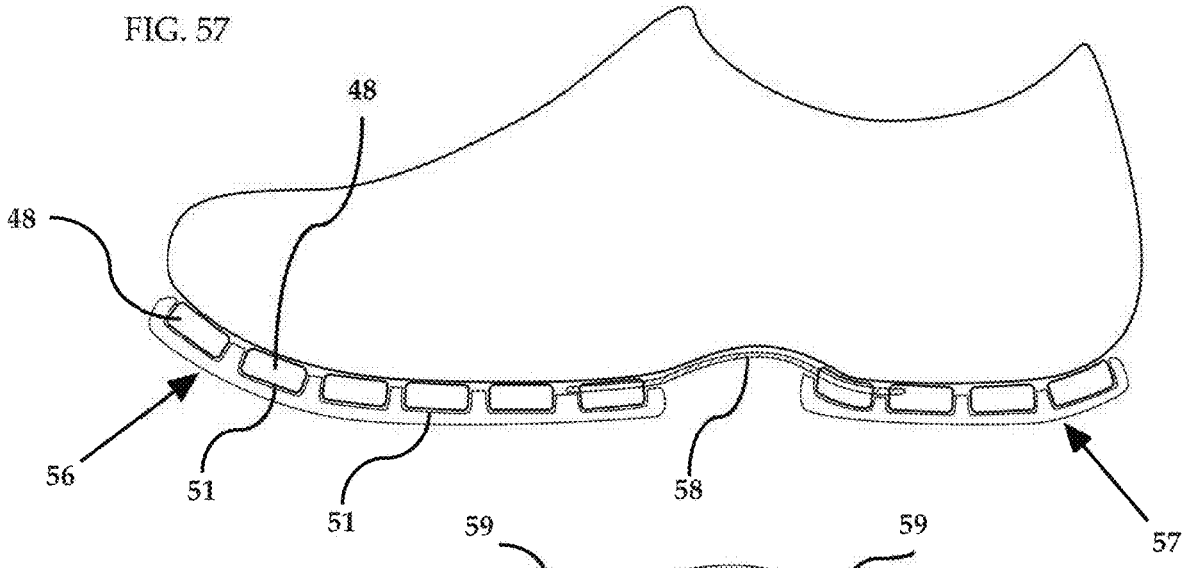
FIG. 57 shows a cross-sectional view of outsole element assembled from two or more separate outsole components, and joined by a stabilizer.

Furthermore, it is also understood that, optionally and as depicted in FIG. 57, outsole element 38 may be assembled from two or more separate outsole components 56 and 57, and that the separate components may be joined by a stabilizer 58.

Figure 58:
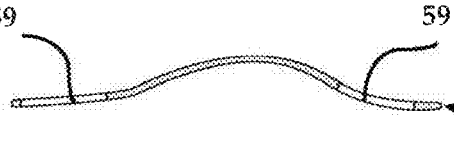
FIG. 58 shows a cross-section of a stabilizer.

As depicted in FIG. 58, stabilizer 58 may optionally include stabilizer apertures 59, or be sized, shaped, and positioned, so as to engage one or more sole pod elements 48.

Unibody Shoe Upper and Outsole Component Assembly and Construction Process

The present invention also relates to the process of making the unibody construction footwear described above.

Figure 59:
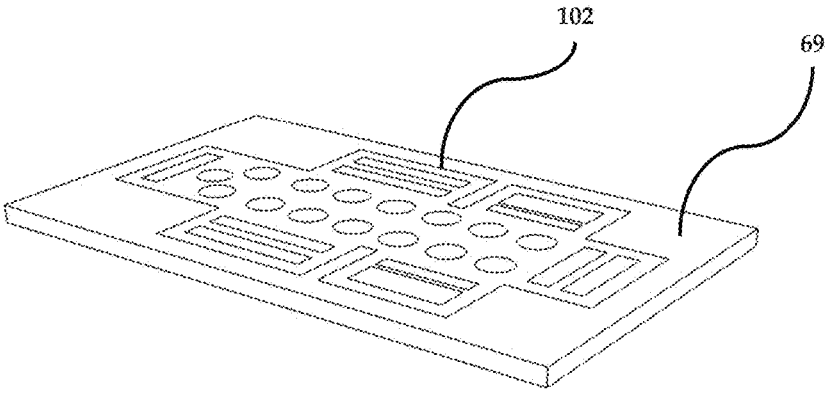
FIG. 59 shows a perspective view of cushioning substrate with cushioning substrate elements of various shapes, sizes and texture. Structures shown are represented in a stylized and simplified rendering.
Figure 60:
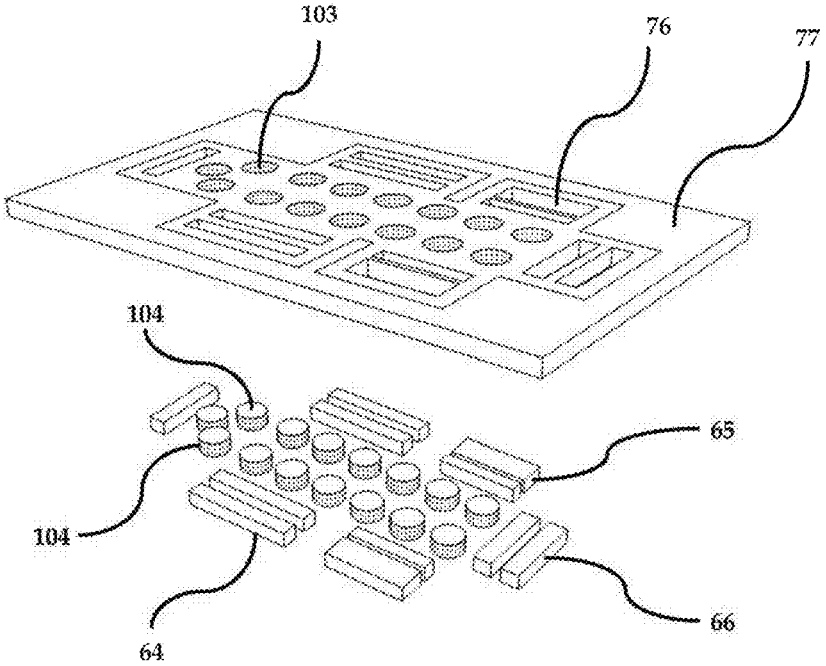
FIG. 60 shows a perspective view of cushioning substrate with cushioning substrate elements of various shapes, sizes and texture cut out of the cushioning substrate. Structures shown are represented in a stylized and simplified rendering.
Figure 61:
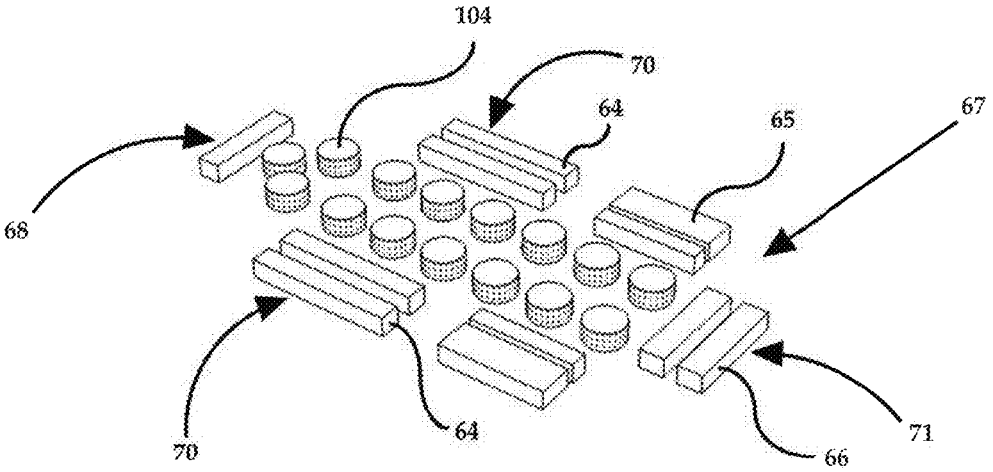
FIG. 61 shows a perspective view of cushioning substrate elements of various shapes, sizes and texture cut out of a cushioning substrate. Structures shown are represented in a stylized and simplified rendering.

As depicted in FIGS. 59 through 61, in one embodiment of the invention, cushioning substrate 69 is used to make cushioning substrate elements of various sizes and shapes.

As depicted in FIG. 59, cushioning substrate 69 is cut along substrate cutting lines 102.

FIG. 60 depicts one embodiment of the invention in which various cushioning substrate elements are cut out of cushioning substrate 69, leaving behind holes 103 and 76 in cushioning substrate 69. The material cut out of cushioning substrate 69 may be used to create, optionally, cushioning substrate elements of various sizes and shapes, as described below. The cushioning substrate 69 with materials removed from holes 103 and 76 is depicted in FIG. 60 as remaining cushioning substrate 77.

FIGS. 60 and 61 depict the various cushioning substrate elements optionally made from cushioning substrate 69, including, by way of example only, bottom substrate elements 104, side substrate elements 64, heelcap substrate elements 65, and heel collar substrate elements 66. As depicted in FIG. 61, the various cushioning substrate elements are optional positioned in relation to each other to form cushioning substrate assembly 67.

In this embodiment of the invention, the various cushioning substrate elements are optionally positioned and aligned in relation to their location in the unibody shoe upper 33. Optionally, side substrate elements 64 may be positioned in relation to the vamp sides 70 of unibody shoe upper 33; heel collar substrate element 66 may be positioned in relation to heelcounter 71 of unibody shoe upper 33; and at least one of bottom substrate elements 104 may be positioned in relation to the toe 68 of unibody shoe upper 33.

It is understood that bottom substrate elements 104 fabricated in the manner described above may optionally be used to make cushioning pod elements 20. Optionally, bottom substrate elements 104 may also be used to make sole pod elements 48 or partial outsole element 37. Side substrate elements 64 may optionally be used to make side cushioning subcomponent 39 or side cushioning element 44. Heelcap substrate elements 65 may optionally be used to make heel cushioning element 47.

An Alternative Embodiment

Figure 62:
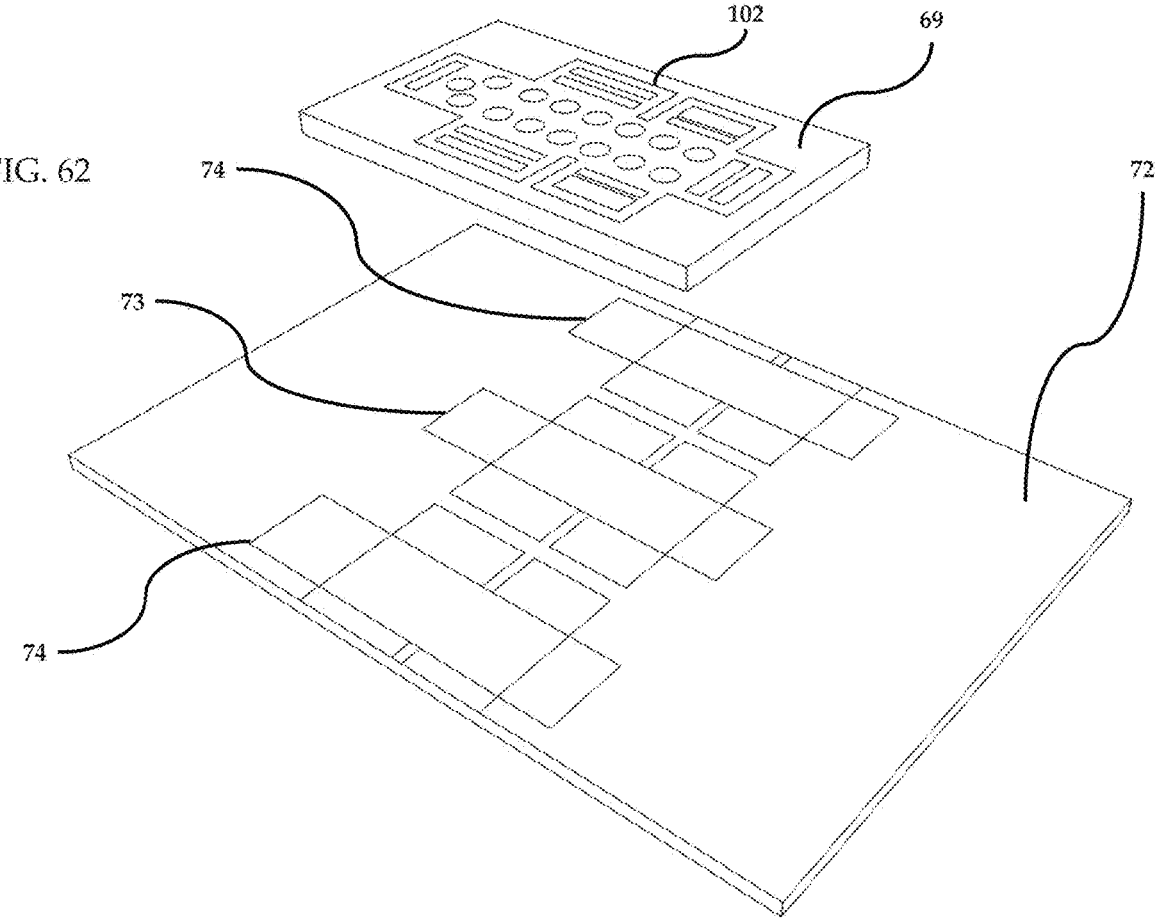
FIG. 62 shows a perspective view of cushioning substrate with cushioning substrate elements of various shapes, sizes and texture aligned to a sheeting substrate. Structures shown are represented in a stylized and simplified rendering.
Figure 63:
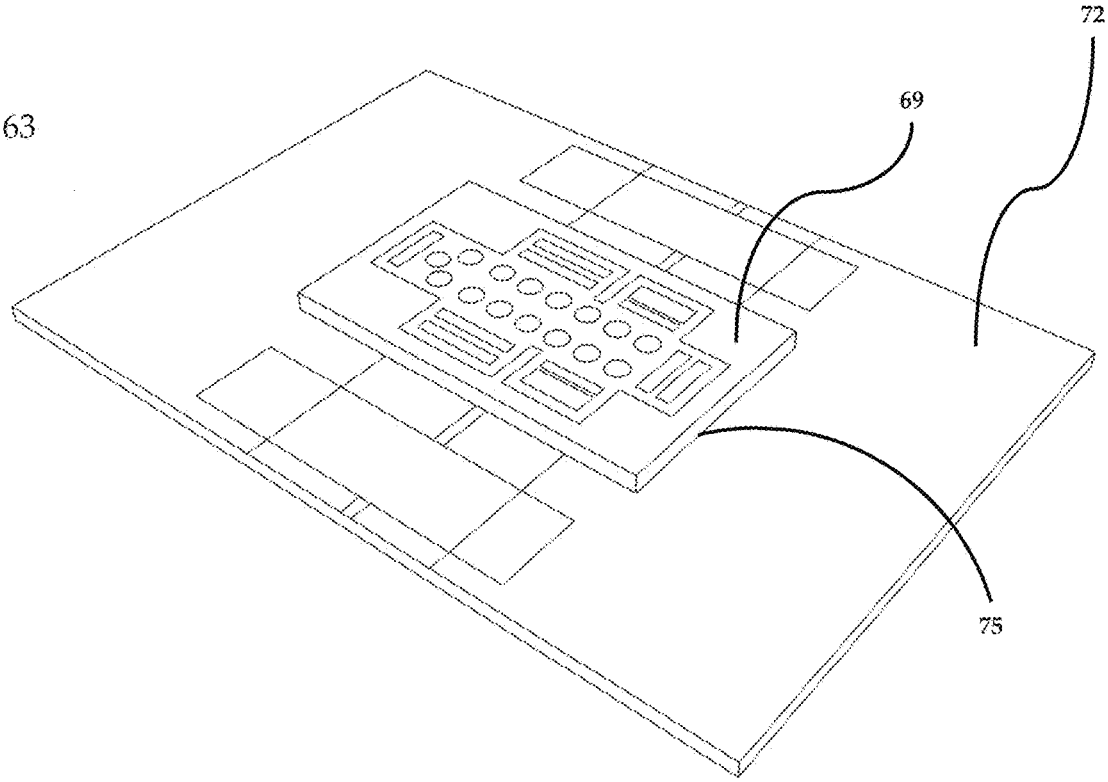
FIG. 63 shows a perspective view of cushioning substrate with cushioning substrate elements of various shapes, sizes and texture aligned and positioned on a sheeting substrate contact surface. Structures shown are represented in a stylized and simplified rendering.
Figure 64:
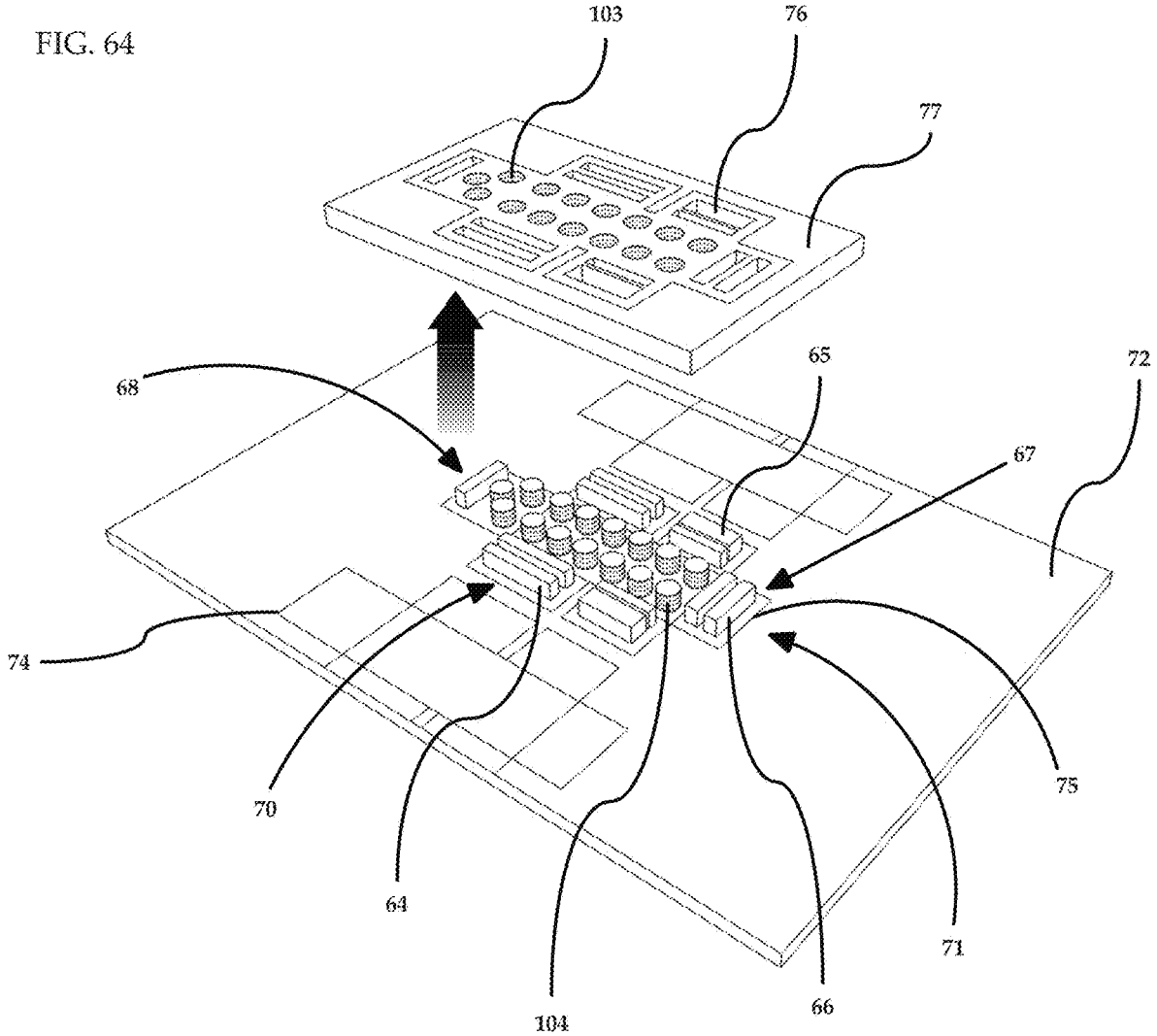
FIG. 64 shows a perspective view of cushioning substrate with cushioning substrate assembly aligned and positioned on a sheeting substrate contact surface. Structures shown are represented in a stylized and simplified rendering.

One alternative embodiment of the invention is depicted in FIGS. 62 through 64, FIG. 62 depicts cushioning substrate 69, cut along substrate cutting lines 102. Cushioning substrate 69 is positioned or aligned in relation to sheeting substrate 72. Optionally, substrate cutting lines 102 may be positioned or aligned in relation to sheeting substrate cutting line 73.

It is understood that, optionally, more than one instance of cushioning substrate 69 may be positioned or aligned in relation to more than one instance of sheeting substrate cutting lines 74 on a contiguous sheet of sheeting substrate 72, in order to speed up the assembly of the components described below.

FIG. 63 depicts cushioning substrate 69 being aligned and positioned against sheeting substrate contact surface 75 of sheeting substrate 72.

FIG. 64 depicts cushioning substrate assembly 67 (optionally including bottom substrate elements 104, side substrate elements 64, heelcap substrate elements 65, and heel collar substrate elements 66) being adhered to sheeting substrate contact surface 75 of sheeting substrate 72.

Cushioning substrate assembly 67, or individual cushioning substrate elements, may be made to adhere to sheeting substrate contact surface 75 by various means, such as, optionally, applying adhesive selectively to various cushioning substrate elements; applying adhesive to the surface of cushioning substrate 69, or a portion of the same, and then selectively removing the adhesive from the area encompassing the surface of remaining cushioning substrate 77; and applying adhesive to the surface of cushioning substrate 69, or a portion of the same, and then masking the same so that only cushioning substrate assembly 67, or individual cushioning substrate elements, are made to adhere to sheeting substrate contact surface 75. It is understood that any of these or other methods for making a material to adhere to the other may be used.

As further depicted in FIG. 64, the remaining cushioning substrate 77 is removed, leaving behind cushioning substrate assembly 67, or individual cushioning substrate elements, adhered to sheeting substrate contact surface 75.

The resulting assembly may be processed further to form components for unibody shoe upper 33 depicted in FIG. 8, or for unibody outsole assembly depicted in FIG. 9.

It is understood that sheeting substrate 72 described above may optionally be used to make insole element 16, full layer 23, or partial layer 29. Optionally, sheeting substrate 72 may also be used to make outsole layer 34, midsole element 36, and full outsole element 38.

Another Alternative Embodiment

Figure 65:
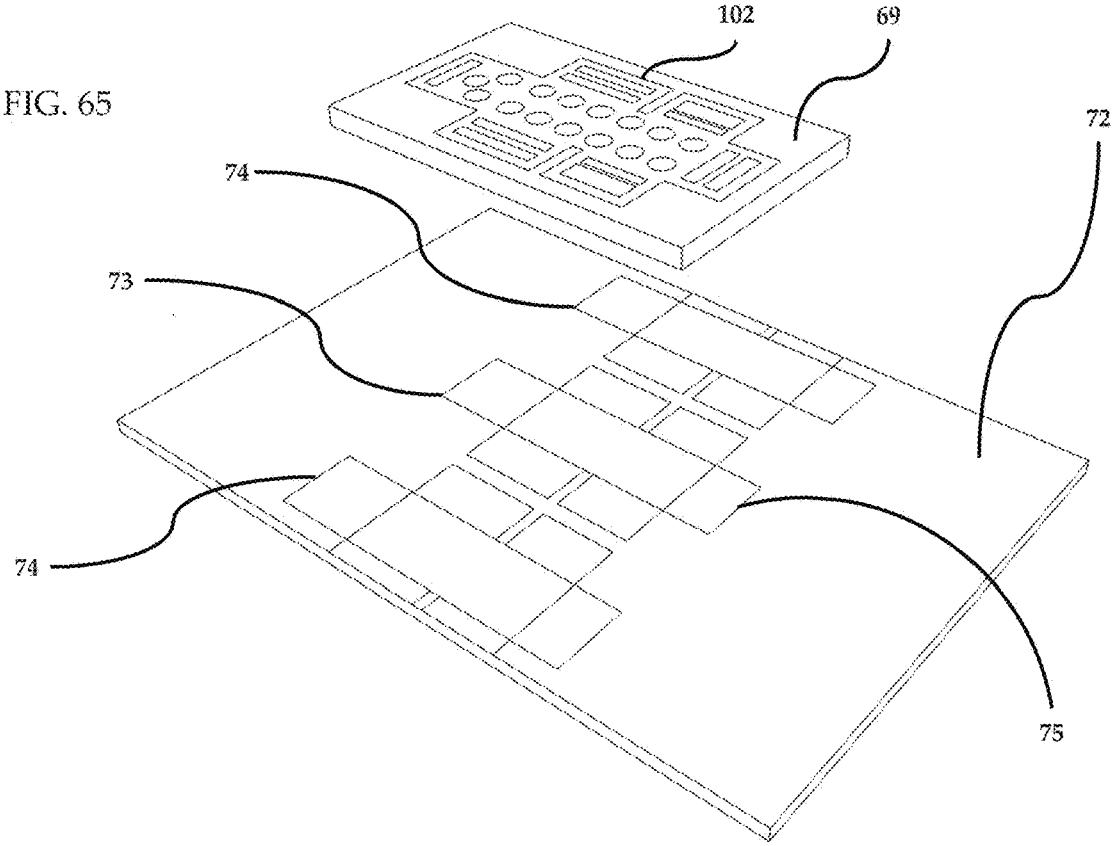
FIG. 65 shows a perspective view of cushioning substrate aligned on a sheeting substrate. Structures shown are represented in a stylized and simplified rendering.
Figure 66:
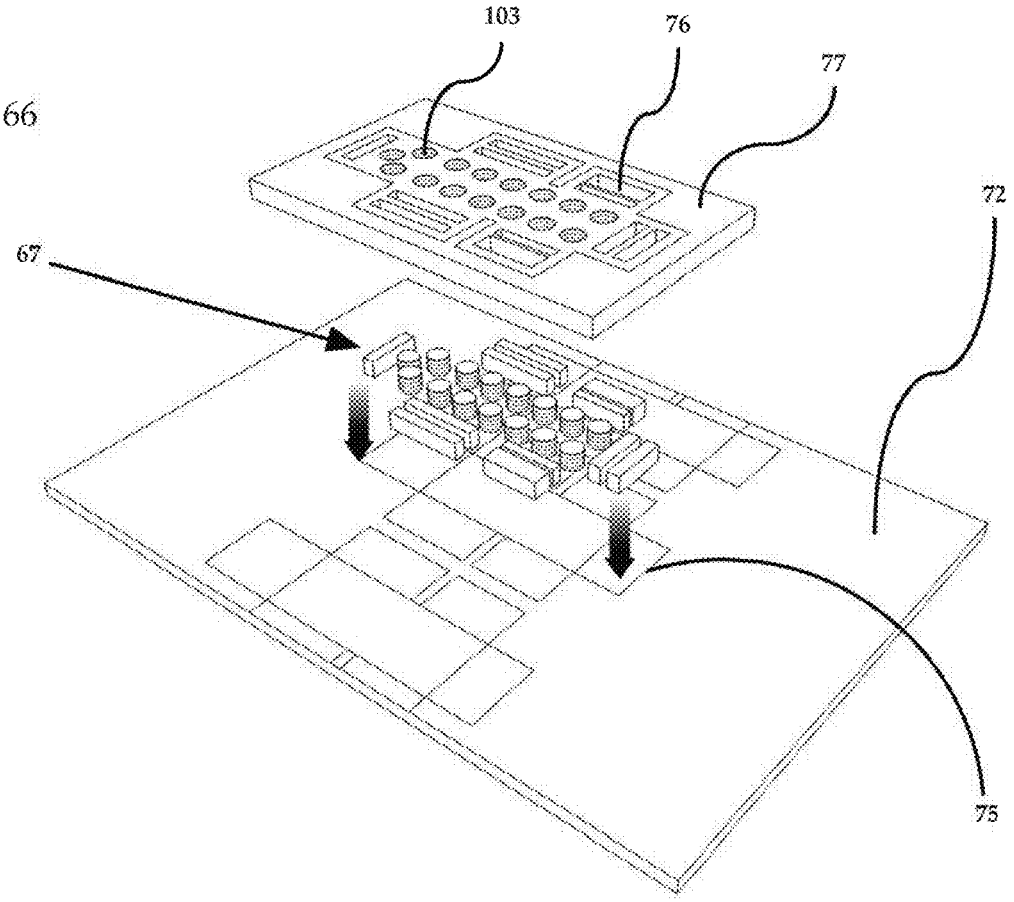
FIG. 66 shows a perspective view of cushioning substrate with cushioning substrate assembly aligned and positioned on a sheeting substrate contact surface. Structures shown are represented in a stylized and simplified rendering.
Figure 67:
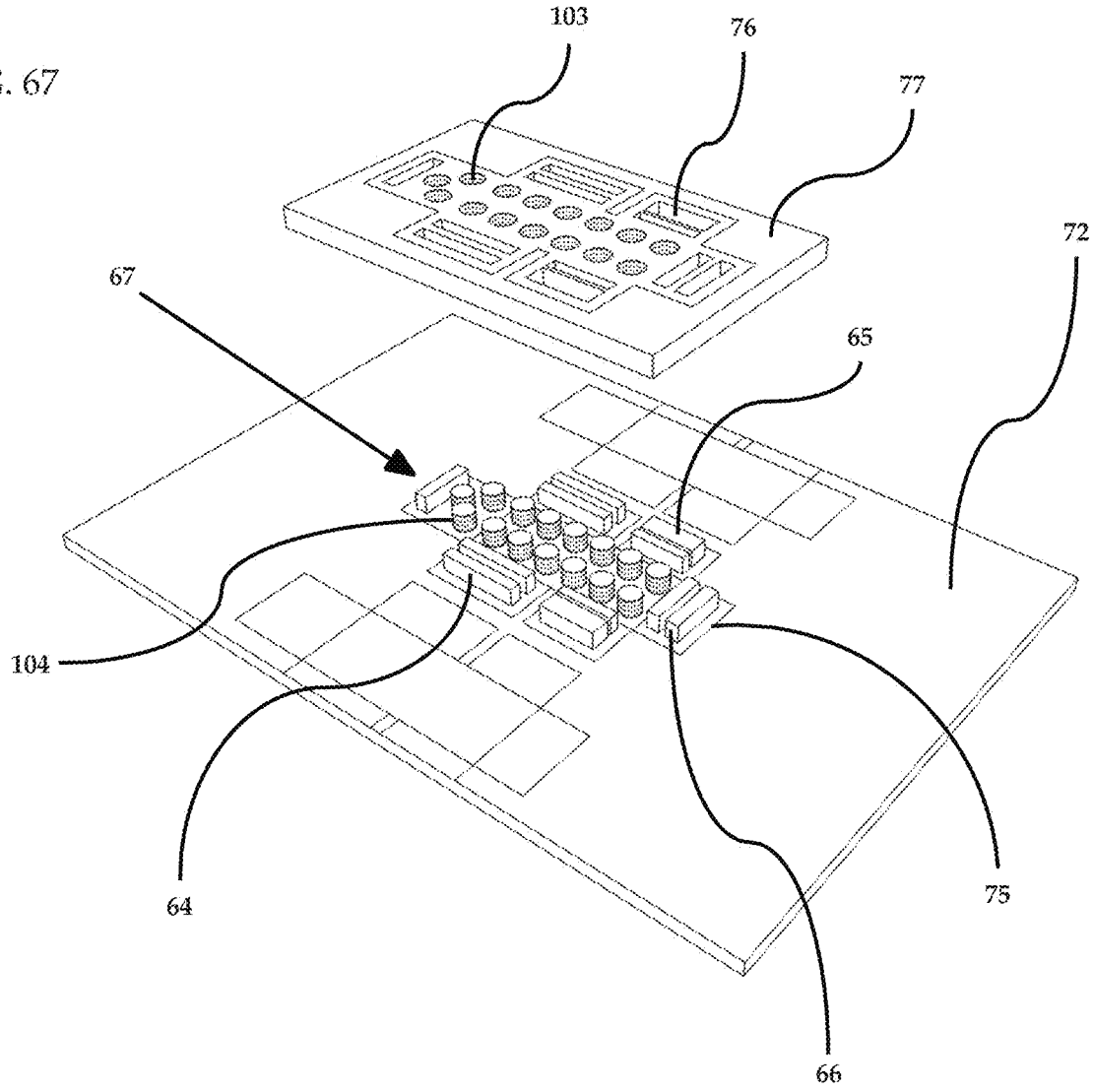
FIG. 67 shows a perspective view of cushioning substrate with cushioning substrate elements of various shapes, sizes and texture aligned and positioned on a sheeting substrate contact surface. Structures shown are represented in a stylized and simplified rendering.

Another alternative embodiment of the invention is depicted in FIGS. 65 through 67. FIG. 65 depicts cushioning substrate 69 positioned or aligned in relation to sheeting substrate 72 so as to leave a varying amount of distance between them. Alternatively, and optionally, cushioning substrate 69 may make contact with sheeting substrate 72. Also optionally, substrate cutting lines 102 may be positioned or aligned in relation to sheeting substrate cutting line 73.

Alternatively, and optionally, cushioning substrate 69 may be cut along substrate cutting lines 102 before it is positioned or aligned in relation to sheeting substrate 72.

Again, it is understood that more than one instance of cushioning substrate 69 may be positioned in relation to sheeting substrate 72, and aligned in relation to sheeting substrate cutting lines 74.

As depicted in FIG. 66, cushioning substrate assembly 67 or individual cushioning substrate elements may alternatively be pushed, pressed, or "punched through" out of cushioning substrate 69, so as to make contact with and be pressed against sheeting substrate contact surface 75 of sheeting substrate 72.

If cushioning substrate 69 was not cut along substrate cutting lines 102 before it was positioned or aligned in relation to sheeting substrate 72, it is understood that cushioning substrate 69 may be cut along substrate cutting lines 102 and pushed, pressed, or "punched through" out of cushioning substrate 69 in a single or substantially continuous step.

In any event, once cushioning substrate assembly 67 or individual cushioning substrate elements are alternatively cut out or pushed, pressed, or "punched through" out of cushioning substrate 69, they leave behind remaining cushioning substrate 77 with holes 103 and 76 corresponding to the former locations of the individual cushioning substrate elements in the cushioning substrate 69.

FIG. 67 depicts cushioning substrate assembly 67 (optionally including bottom substrate elements 104, side substrate elements 64, heelcap substrate elements 65, and heel collar substrate elements 66) making contact with sheeting substrate contact surface 75 of sheeting substrate 72. Cushioning substrate assembly 67, individual cushioning substrate elements, may be made to adhere to sheeting substrate contact surface 75 by various means, including glue or cement, adhesive film, heat or microwave or radio-wave activated adhesive, two sided adhesive film, and the like. It is understood that any of these or other methods for making a material to adhere to the other may be used.

Alternatively, and optionally, apertures may be cut into sheeting substrate 72, or indentations may be cut out of or pressed onto sheeting substrate contact surface 75 of sheeting substrate 72. The said apertures may be sized, shaped, and positioned so as to engage cushioning substrate assembly 67 or individual cushioning substrate elements and optionally "lock" them. Optional examples of this are depicted in FIGS. 70 and 71, and FIGS. 81 and 82.

The resulting assembly may be processed further to form components for unibody shoe upper 33 depicted in FIG. 8, or for unibody outsole assembly depicted in FIG. 9.

It is understood that sheeting substrate 72 described above may optionally be used to make insole element 16, full layer 23, or partial layer 29. Optionally, sheeting substrate 72 may also be used to make outsole layer 34, midsole element 36, and full outsole element 38.

Figure 77:
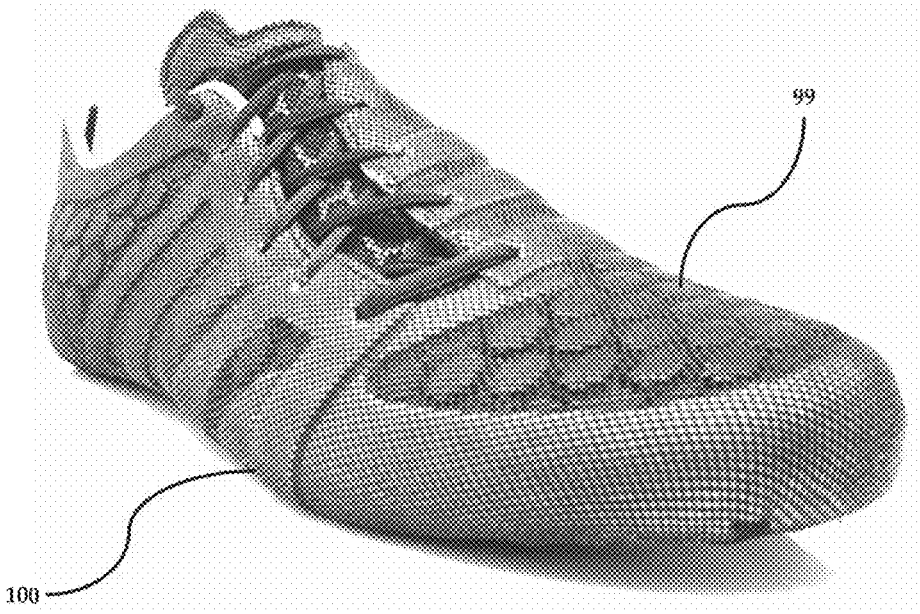
FIG. 77 shows a perspective view of a shoe upper.
Figure 78:
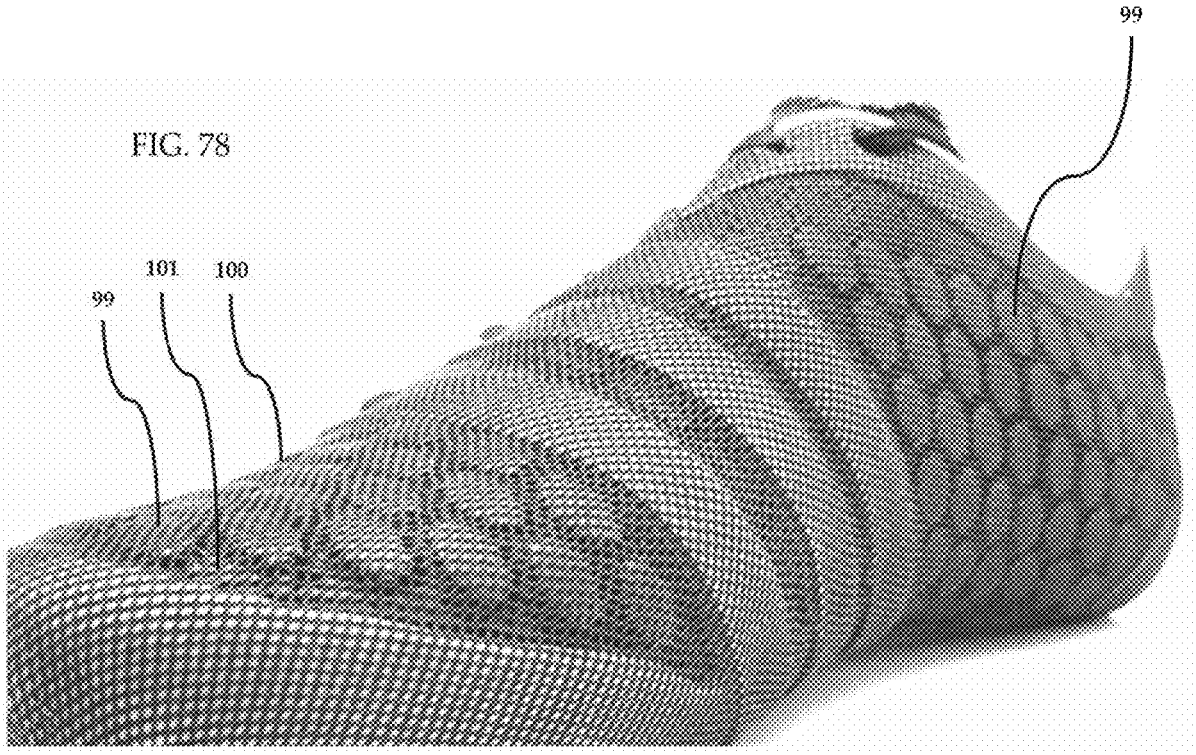
FIG. 78 shows a perspective view of a shoe upper.

It is understood that the processes depicted in FIGS. 62 through 64 and FIGS. 65 through 67 may be used to create composite materials depicted in FIGS. 77 and 78. FIGS. 77 and 78 depict, without limitations, an example of a shoe upper in which the top and side walls (or the "vamp") are fabricated by layering or "sandwiching" foam elements (such as cushioning pod elements 20) between sheets or layers of flat material. FIGS. 77 and 78 depict the "vamp" of a shoe, in which the "vamp" is made of foam elements 99 sandwiched between outer layer 100 and inner layer 101, where outer layer 100 is made of mesh, and permits the foam elements 99 underneath it to be partially visible.

Alternative Cushioning Substrate Assembly Method

It is understood that cushioning substrate 69 may be used to fabricate cushioning substrate elements of various shapes and sizes (including thicknesses). It is also understood that cushioning substrate 69, and the cushioning substrate elements, may optionally be made of different types of materials, including, without limitations, foam, rubber, silicone, latex, natural or synthetic fabric, natural or synthetic leather, mesh, flexible or pliable plastic, or other rubber or plastic material, synthetic fiber or composite, or any combination of such materials.

It is further understood that more than one type of materials may be optionally used to make cushioning substrate elements.

FIG. 68 depicts one alternative embodiment of the invention, in which cushioning substrate 69 is combined with or optionally glued to alternative cushioning substrate 79 in order to create an array of cushioning substrate elements made of two different types of materials, such as bottom substrate elements 104 combined with alternative bottom substrate elements 80, and heel collar substrate element 66 combined with alternative heel collar substrate element 81.

By way of example only, and optionally, the method described in FIG. 68 could be used to fabricate sole pod elements 48, as depicted in FIGS. 23 and 53, in which the upper half of sole pod element 48 could be made of foam or other softer, cushioning material, and the lower half of sole pod element 48 could be made of rubber or other resilient and abrasion resistant material.

Additionally, and optionally, the method depicted in FIG. 68 could also be used to fabricate cushioning pod elements 20, as depicted in FIGS. 10 and 19, in which the upper half of cushioning pod element 20 could be made of soft foam or other cushioning material, and the lower half of cushioning pod element 20 could be made of rubber or other shock absorbing material.

FIG. 69 depicts another alternative embodiment of the invention, in which cushioning substrate 69 is combined with or optionally glued to alternative partial cushioning substrate 82 in order to create an array of cushioning substrate elements, some of which are made of a single type of material (such as side substrate elements 64 and at least some of bottom substrate elements 104), and some of which are made of two different types of materials (such as the combination of heel collar substrate element 66 with alternative partial heel collar substrate element 83, as depicted in FIG. 69).

It is understood that by varying the types of materials used to make cushioning substrate 69, alternative cushioning substrate 79, and alternative partial cushioning substrate 82, and the numbers, shapes, sizes (including thicknesses), positions, and alignments of the appropriate substrates, it is possible to fabricate many different variations of cushioning substrate assembly 67 and individual cushioning substrate elements.

Optional Reinforcing Structure

Figure 70:
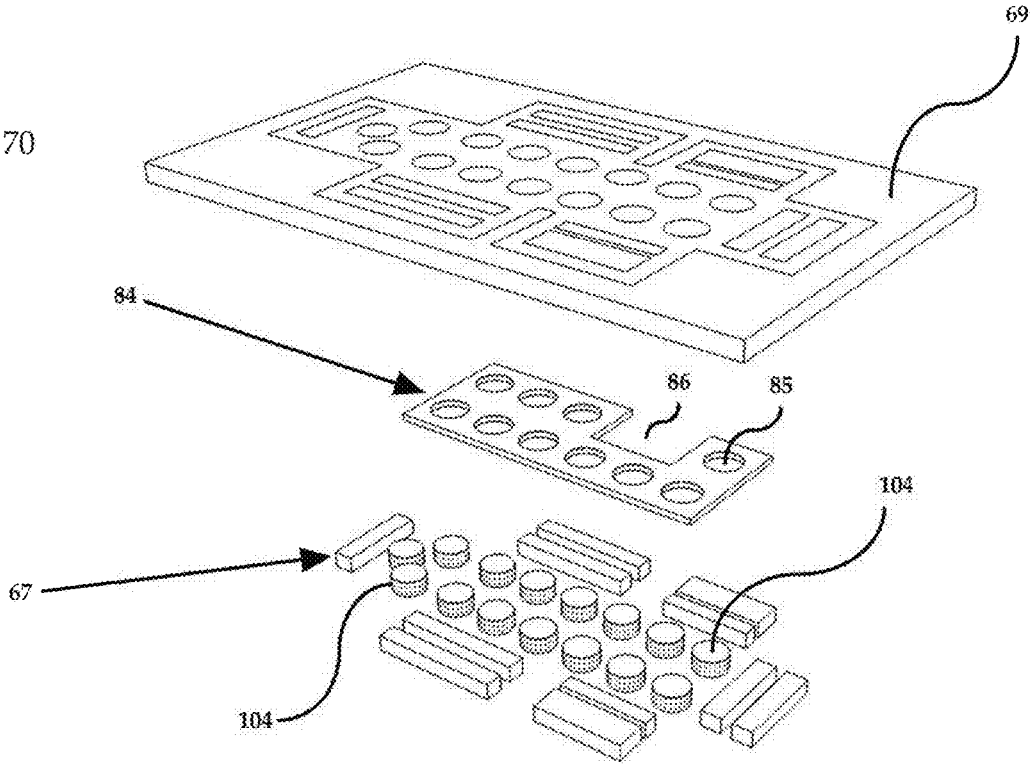
FIG. 70 shows a perspective view of a cushioning substrate combined with a reinforcing structure, which engages cushioning substrate assembly. Structures shown are represented in a stylized and simplified rendering.
Figure 71:
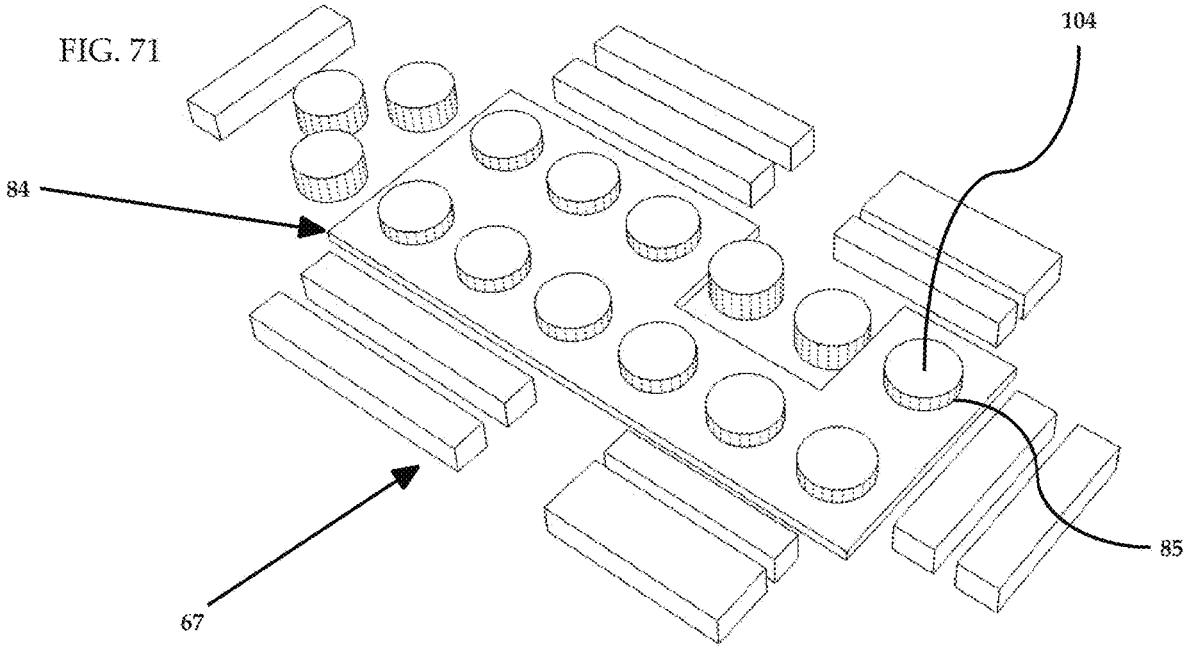
FIG. 71 shows a perspective view of a reinforcing structure fitted onto cushioning substrate assembly. Structures shown are represented in a stylized and simplified rendering.

In yet another alternative embodiment of the invention, apertures may be cut into cushioning substrate 69, sheeting substrate 72, or other materials of appropriate size, shape, and composition, so as to create reinforcing structure 84 as depicted in FIGS. 70 and 71.

As depicted in FIG. 70, reinforcing structure 84 may be shaped to include voids 86, or reinforcing structure apertures 85, which may be sized, shaped, and positioned to engage cushioning substrate assembly 67 or individual cushioning substrate elements; cushioning padding element 19 or individual cushioning pod elements 20; outsole padding element 35 or individual sole pod elements 48; or locking pod elements 22.

By way of example only, FIG. 71 depicts reinforcing structure 84 fitted onto cushioning substrate assembly 67, with at least one bottom substrate element 104 engaged to at least one reinforcing structure aperture 85.

Figure 72:
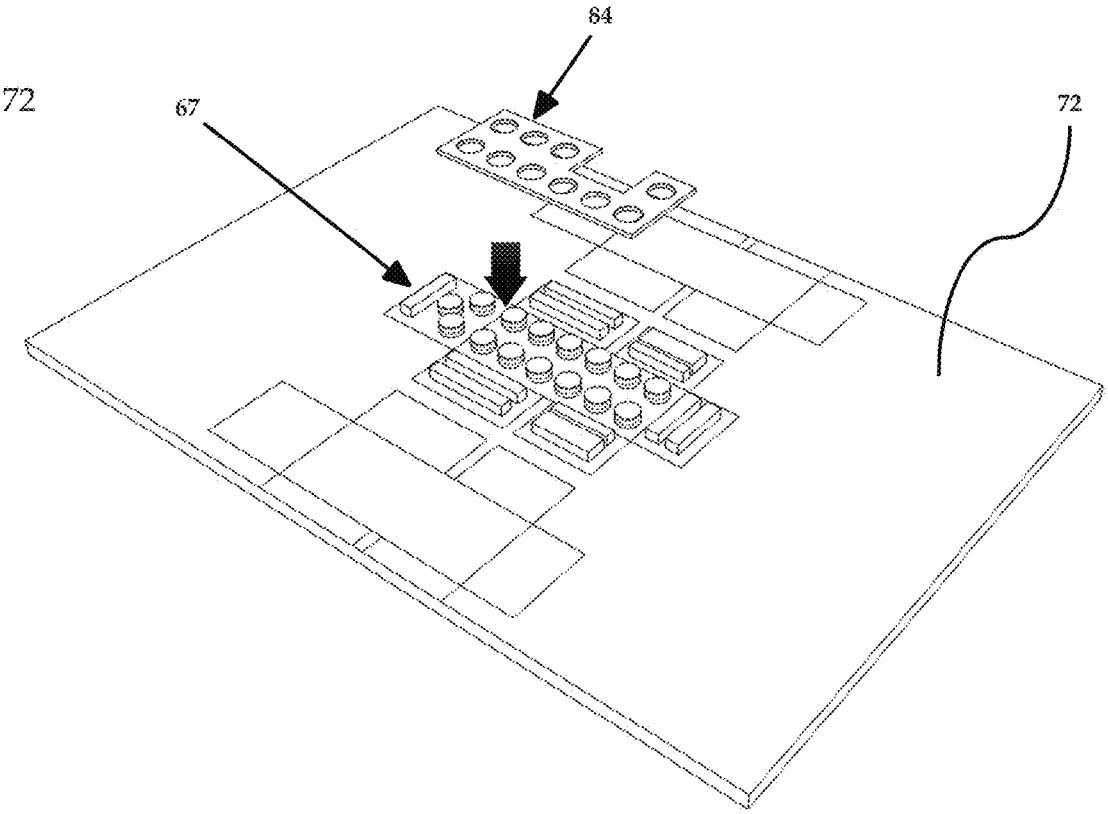
FIG. 72 shows a perspective view of a reinforcing structure aligned to and engaging cushioning substrate assembly, which is positioned on the surface of sheeting substrate. Structures shown are represented in a stylized and simplified rendering.

FIG. 72 depicts reinforcing structure 84 being aligned to and engaging cushioning substrate assembly 67, which is positioned on the surface of sheeting substrate 72.

Figure 73:
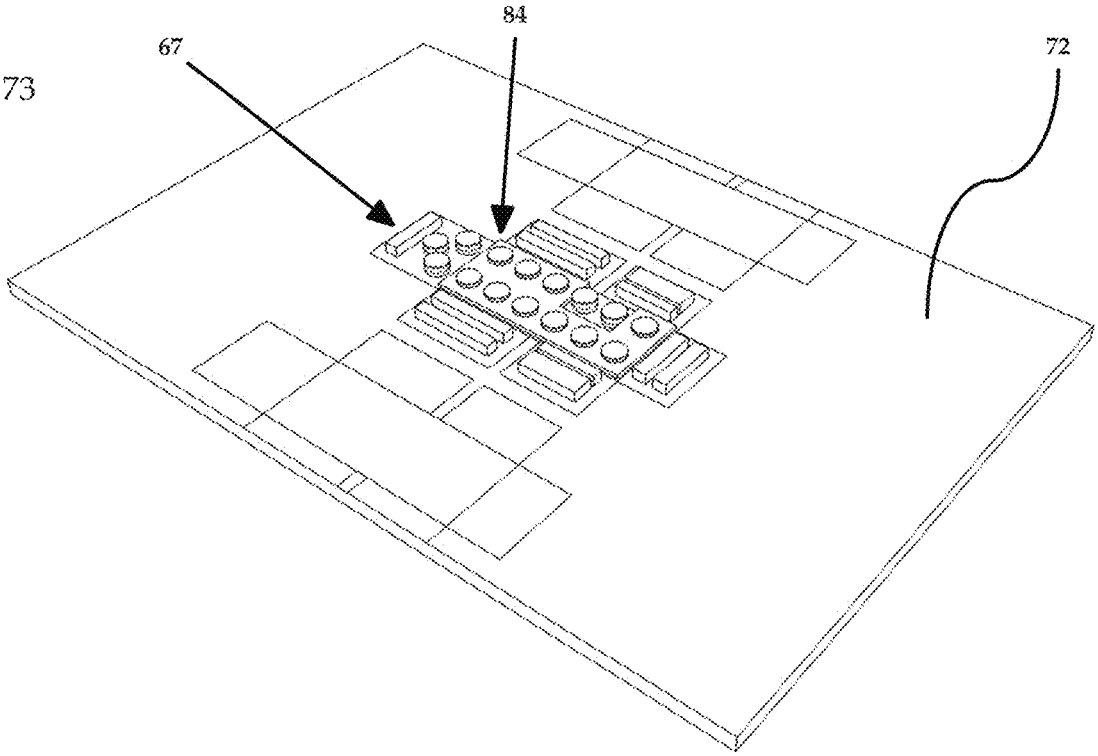
FIG. 73 shows a perspective view of a reinforcing structure fitted to cushioning substrate assembly, which has been positioned on and glued to the surface of sheeting substrate. The cushioning substrate and cushioning substrate elements are represented in a stylized and simplified rendering. Structures shown are represented in a stylized and simplified rendering.

FIG. 73 depicts reinforcing structure 84 fitted to cushioning substrate assembly 67, which has been positioned on and glued to the surface of sheeting substrate 72.

It is understood that reinforcing structure 84 may have a variety of shapes (including thickness) and sizes. It is also understood that reinforcing structure 84 may optionally be used to hold together, provide structural integrity, "lock" or seal seams created when sheeting substrate 72, or other layered components such as full layer 23 and partial layer 29, are folded three-dimensionally to form unibody shoe upper 33.

Figure 79:
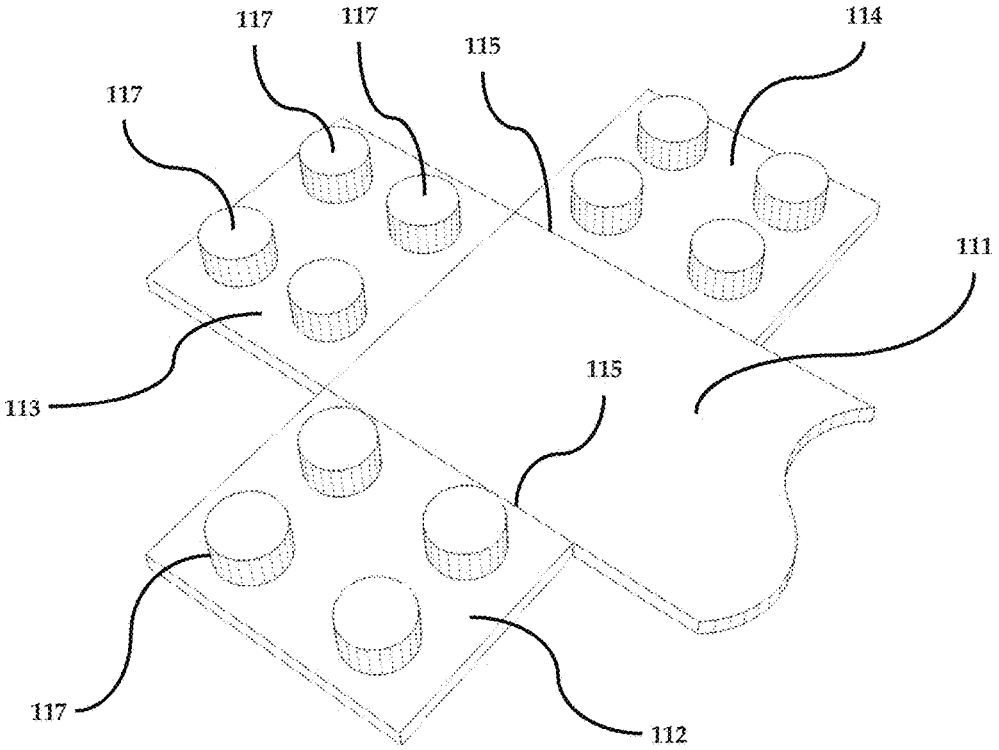
FIG. 79 shows a perspective view of sheeting substrate which has glued on it cushioning substrate elements. Structures shown are represented in a stylized and simplified rendering.

By way of example only, FIG. 79 depicts sheeting substrate 111 which has glued on it cushioning substrate elements 117.

Figure 80:
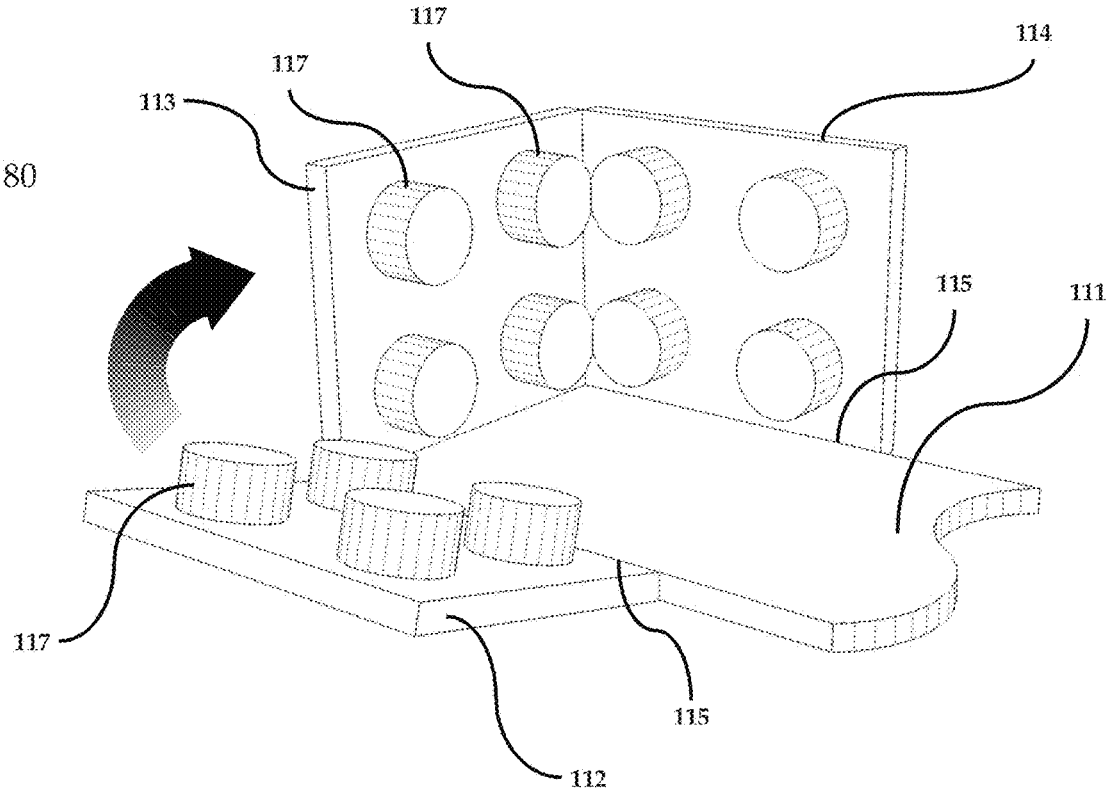
FIG. 80 shows a perspective view of the front, right, and left leaves of sheeting substrate folded along sheeting substrate folding lines, to form a three-dimensional shape. Structures shown are represented in a stylized and simplified rendering.

As depicted in FIG. 80, the front 113, right 114, and left 112 leaves of sheeting substrate 111 are folded along sheeting substrate folding lines 115, to form a three-dimensional shape. Note that FIG. 80 depicts unfolded left leaf 112 of sheeting substrate 111, for illustrative purposes.

Figure 81:
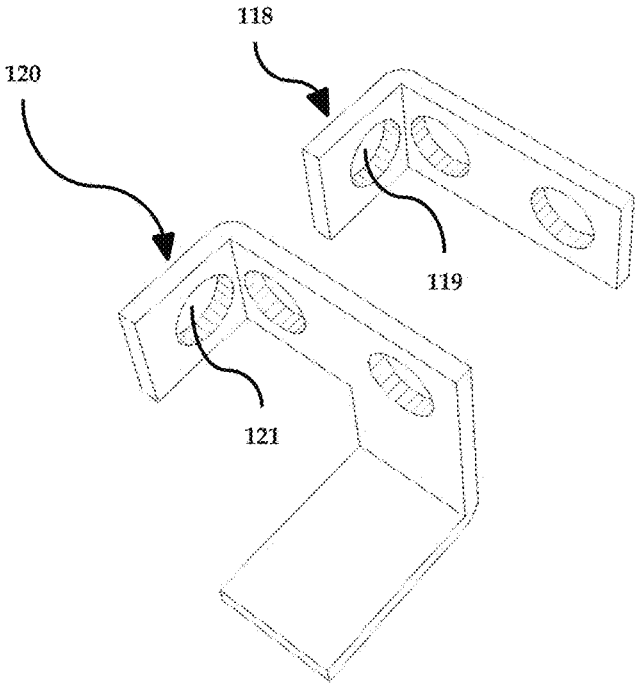
FIG. 81 shows a perspective view of two alternatively shaped and sized reinforcing structures. Structures shown are represented in a stylized and simplified rendering.

FIG. 81 depicts two alternative, optionally shaped and sized reinforcing structures—reinforcing structure 118 and reinforcing structure 120. Reinforcing structure 118 includes holes 119, and reinforcing structure 120 includes holes 121. It is understood that reinforcing structure elements may have a variety of shapes and dimensions, and that the size, position, and placement of the holes may vary.

Figure 82:
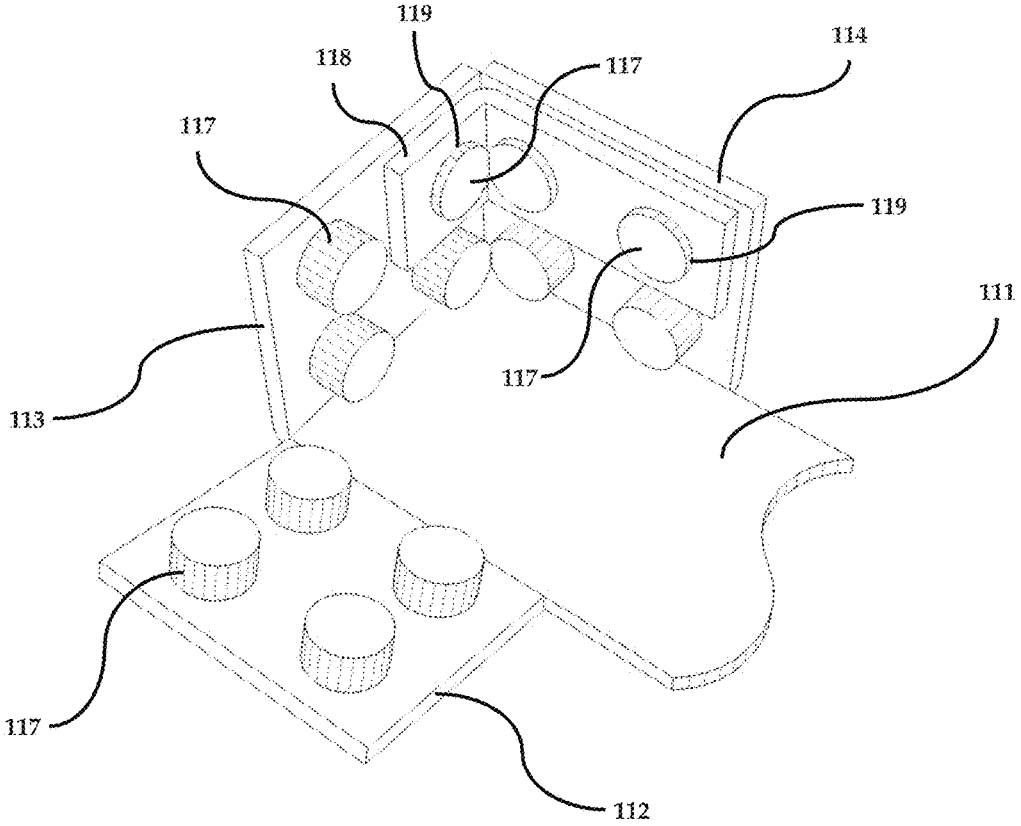
FIG. 82 shows a perspective view of reinforcing structure positioned in relation to the folded up sheeting substrate, so that one or more holes engage one or more cushioning substrate elements. Structures shown are represented in a stylized and simplified rendering.

As depicted in FIG. 82, reinforcing structure 118 may be positioned in relation to the folded up sheeting substrate 111, so that one or more holes 119 engage one or more cushioning substrate elements 117.

Figure 83:
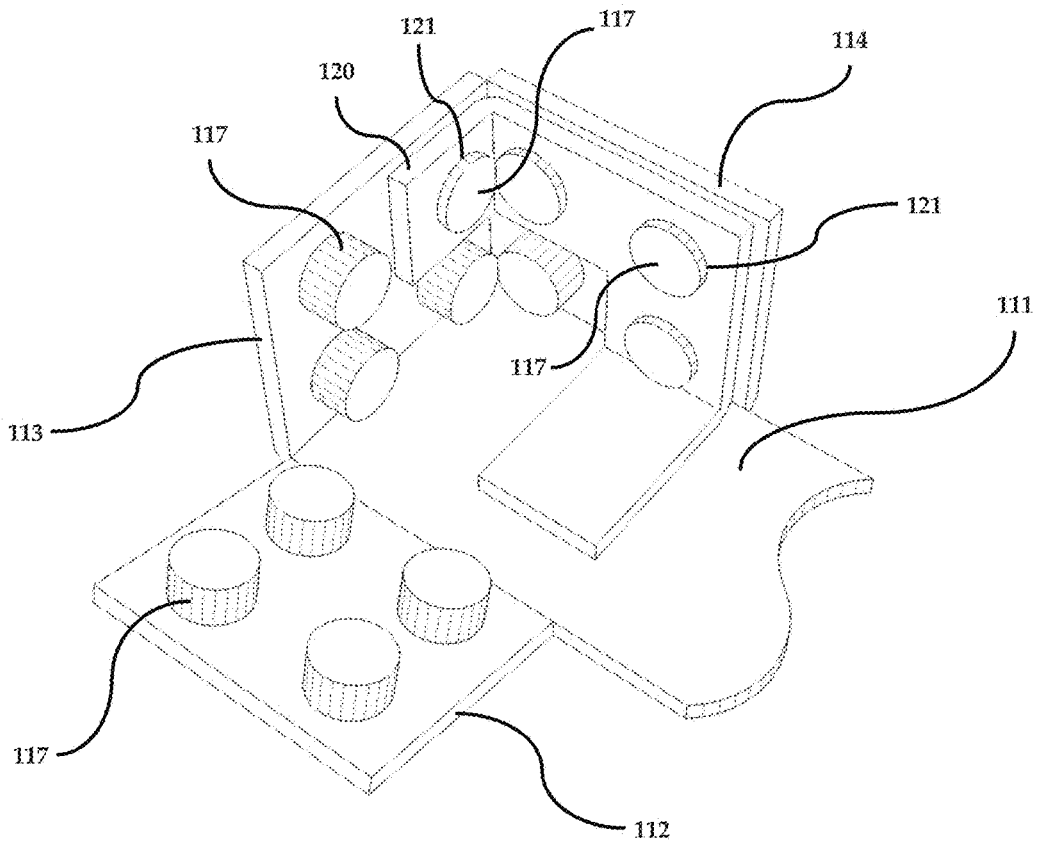
FIG. 83 shows a perspective view of reinforcing structure positioned in relation to the folded up sheeting substrate, so that one or more holes engage one or more cushioning substrate elements. Structures shown are represented in a stylized and simplified rendering.

FIG. 83 depicts alternatively shaped and sized reinforcing structure 120 positioned in relation to the folded up sheeting substrate 111, so that one or more holes 121 engage one or more cushioning substrate elements 117.

It is understood that cushioning substrate elements 117 may be glued to either face of sheeting substrate 111. Optionally, cushioning substrate elements 117 may be glued to both faces of sheeting substrate 111.

Figure 84:
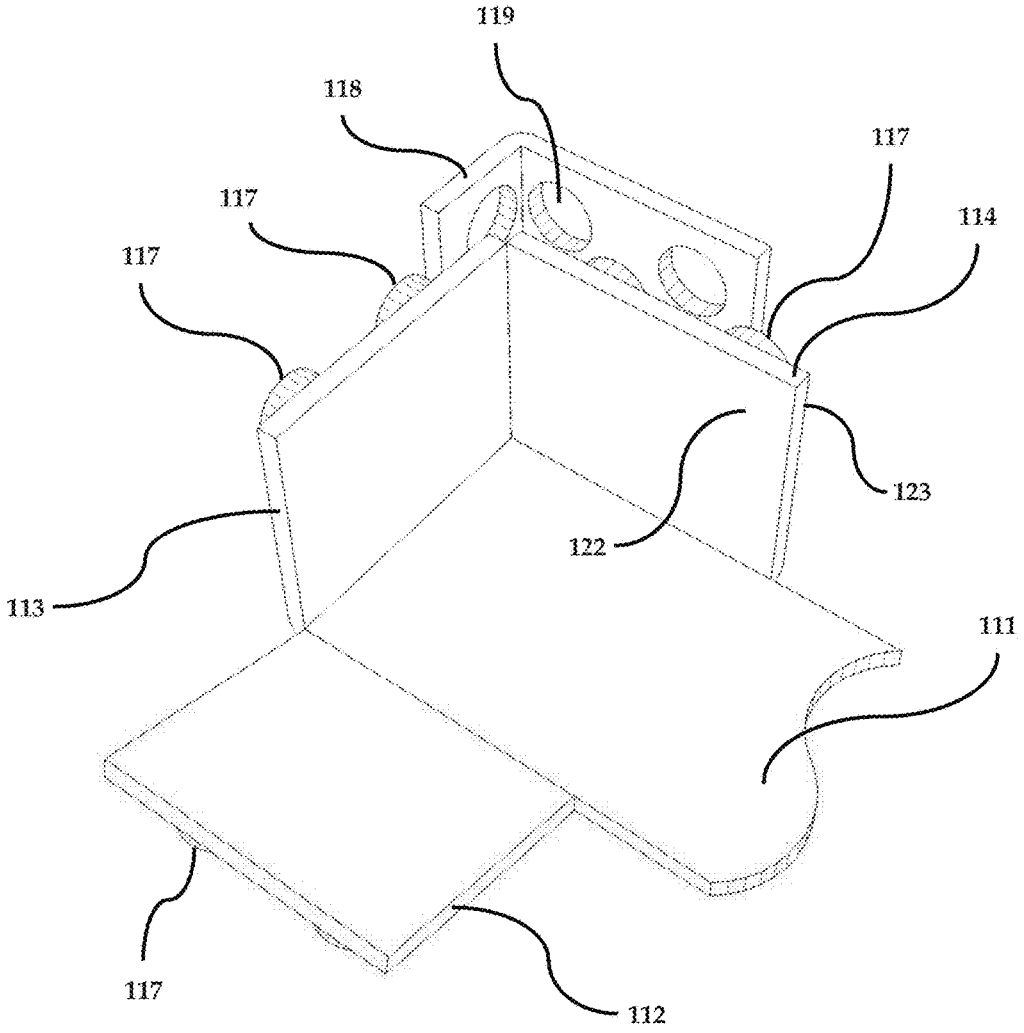
FIG. 84 shows a perspective view of sheeting substrate which has glued on it cushioning substrate elements on the outer side of folded up sheeting substrate. Structures shown are represented in a stylized and simplified rendering.

FIG. 84 depicts sheeting substrate 111 which has glued on it cushioning substrate elements 117. However, in this case, cushioning substrate elements 117 are glued to outer side 123, rather than inner side 122. In FIG. 84, reinforcing structure 118 is positioned in relation to outer side 123 of the folded up sheeting substrate 111, so that one or more holes 119 engage one or more cushioning substrate elements 117.

Figure 85:
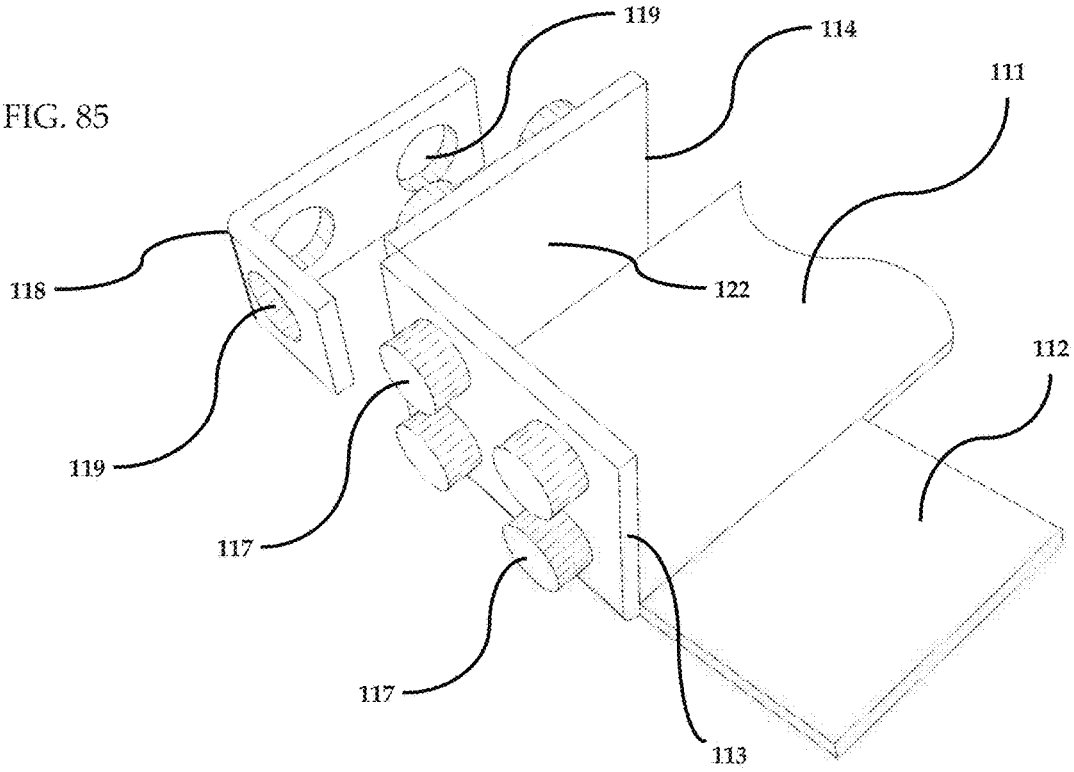
FIG. 85 shows a perspective view of sheeting substrate which has glued on it cushioning substrate elements on the outer side of folded up sheeting substrate. Structures shown are represented in a stylized and simplified rendering.
Figure 86:
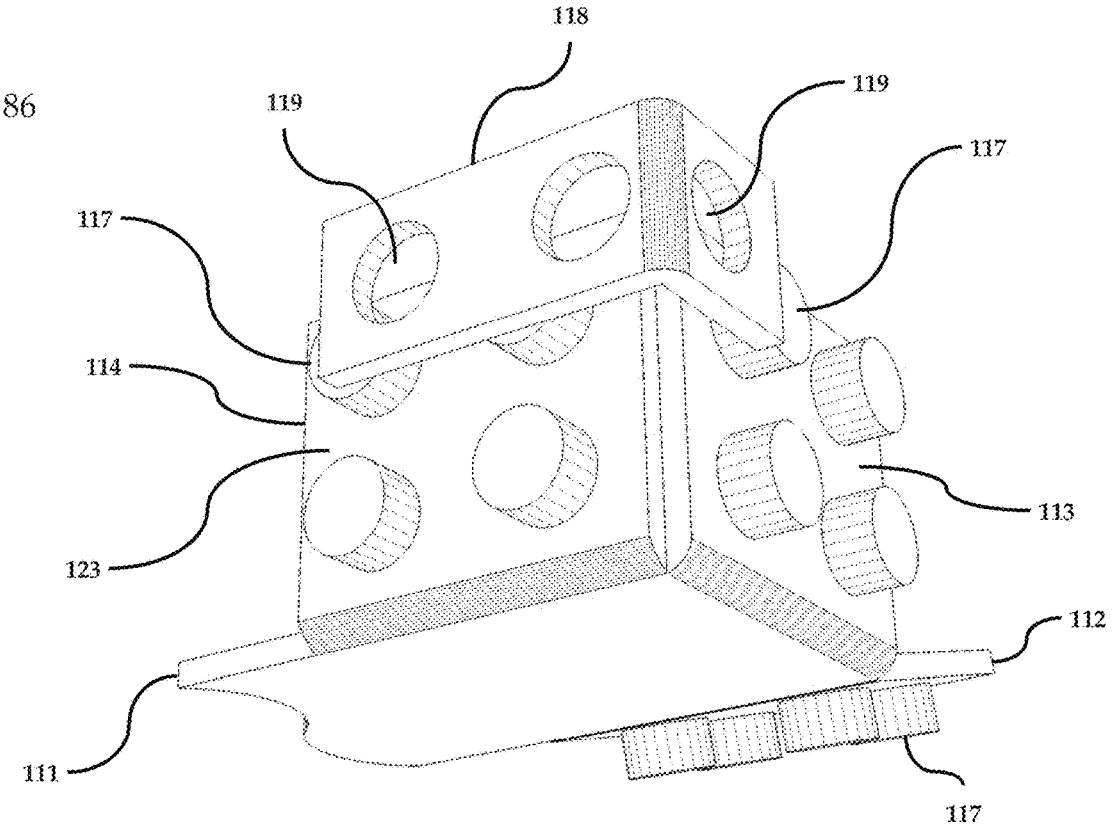
FIG. 86 shows a perspective view of sheeting substrate which has glued on it cushioning substrate elements on the outer side of folded up sheeting substrate. Structures shown are represented in a stylized and simplified rendering.

FIGS. 84 and 85 depict different isometric views of sheeting substrate 111 with cushioning substrate elements 117 glued to the outer side 123 of sheeting substrate 111. FIGS. 85 and 86, depict reinforcing structure 118 positioned in relation to outer side 123 of the folded up sheeting substrate 111, so that one or more holes 119 engage one or more cushioning substrate elements 117.

Optional Embedded Devices

Yet another benefit of unibody construction footwear is the greater ease of incorporating a variety of electrical, mechanical, and electro-mechanical devices into the footwear in the course of assembling it. In part because unibody construction footwear is assembled from flat layers or "sheets" of materials that are assembled and folded into a three-dimensional shoe shape (as opposed to smaller pieces and components that have to be stitched or glued together), it is possible to apply, "imprint," or even "etch" electronic circuit and devices on the flat sheets of materials used in the assembly of the unibody construction footwear.

FIGS. 74 through 76 depict various optional ways of embedding, layering, or adhering electrical, mechanical, and electro-mechanical devices, wiring, and circuitry onto one or more of the component layers of the unibody construction footwear.

FIG. 74 depicts laminate 91 cut and shaped to make device substrate 86.

In one alternative embodiment of the invention, device substrate 86 may optionally include device substrate apertures 78, which may be sized, shaped, and positioned to engage, optionally and by way of example only, one or more of cushioning substrate assembly 67 or individual cushioning substrate elements; cushioning padding element 19 or individual cushioning pod elements 20; outsole padding element 35 or individual sole pod elements 50; or locking pod elements 22.

By way of example only, FIGS. 75 and 76 depict device substrate 86 optionally fitted onto cushioning substrate assembly 67, with at least one bottom substrate element 104 engaged to at least one device substrate aperture 78.

As depicted in FIG. 74, a variety of electrical, mechanical, and electro-mechanical devices may optionally be applied to the surface or affixed to device substrate 86. Alternatively, and optionally, electrical, electronic, mechanical, and electro-mechanical devices may also be engaged or embedded into apertures impressed or cut out in device substrate 86.

By way of example only, and optionally, sensor 93 (such as, for instance, a pedometer) may be affixed to device substrate 86, as depicted in FIG. 74.

Also by way of example only, and optionally, power source 92 (such as a battery, or a piezoelectric power generator, or other similar power generating device) may be engaged or embedded into an aperture in device substrate 86.

Optionally, interface port 94 or input/output device 97 may also be affixed to device substrate 86 and connected to sensor 93 and power source 92 by way of wires 95.

It is understood that there is no limitation on the type of electrical, electronic, mechanical, and electro-mechanical devices that may be affixed or engaged to device substrate 86, or on the position of the said devices on or in device substrate 86. By way of example only, electronic display device 96 (such as, by way of example only, a flexible organic light emitting diode ("OLED") or light emitting polymer ("LEP") display), may optionally be affixed to device substrate 86, and connected to power source 92 by way of wires 95.

It is also understood that device substrate 86 may be processed further to optionally make sheeting substrate 72 depicted in FIGS. 62 through 67; reinforcing structure 84 depicted in FIGS. 70 through 73; insole element 16, full layer 23, or partial layer 29 depicted in FIGS. 6, 11, and 12; or outsole layer 34, midsole element 36, or full outsole element 38 depicted in FIG. 9.

FIGS. 75 and 76 depict one optional embodiment of the invention, in which device substrate 86 with device substrate apertures 78 is positioned to engage a portion of cushioning substrate assembly 67 or individual bottom substrate elements 104, and the assembly is affixed to sheeting substrate contact surface 75 of sheeting substrate 72. The entire assembly may then be cut out, and incorporated into the unibody construction footwear.

As depicted in FIG. 74, device substrate 86 may be positioned so that the front 87 is aligned to the toe of the completed footwear; right side wall 89 is aligned to the right side of the completed footwear; left side wall 88 is aligned to the left side of the completed footwear; and heel wall 90 is aligned to the rear or heel portion of the completed footwear. When the entire assembly is folded into an appropriate three-dimensional shape, the left side wall 88, right side wall 89, and heel wall 90 would stand approximately perpendicularly from the remaining surface of device substrate 86.

The present invention is not to be limited in scope by the specific embodiments described herein. Indeed, various modifications of the invention in addition to those described herein will become apparent to those skilled in the art from the foregoing description and accompanying figures. Such modifications are intended to fall within the scope of the appended claims. The following examples are offered by way of illustration of the present invention, and not by way of limitation.

EXAMPLES

Example 1

A process for making shoe upper for a typical casual shoe is described herein. Three sheets of EVA foam are pre-cut. The foam materials have different colors (red, gray, blue), and may have different thicknesses, and may alternatively be comprised of different types of materials. The foam sheets are cut out of larger blocks of foam material in bulk. Cut foam pieces from the three foam sheets (red, gray, blue) are mixed and matched to construct an assembled workpiece. In this case, the individual pieces in the assembled foam workpiece have different thicknesses. This results in greater stiffness and cushioning characteristics. Almost infinite variations in component size, shape, composition, and so forth are possible. Many of these assembled workpieces are laid out in a suitable pattern.

First substrate layer (in this case, black open mesh that will form the "outer skin" of the shoe) is laid over the assembled foam workpieces. Optionally, a nylon sheet may be placed over the assembly prior to the lamination, to absorb excess glue and protect the fabric/heat platen. The work piece is heat pressed. The assembled foam workpieces are glued to the first substrate layer (black open mesh). The work piece is cut along a suitable pattern.

Optionally, additional trimmings, cushioning, and so forth may be added to the assembly and further laminated (in this case, a cut foam piece that provides additional cushioning is further laminated).

Second substrate layer (in this case, green fabric that will form the "inner skin" or lining of the shoe) is laid over the workpiece on the opposite side from the side bound to the black open mesh. The work piece is placed under a heated pressure platen and laminated. The second substrate layer is trimmed so that substantially the portion laminated to the workpiece remains.

The work piece now has a complex shape and composition. Certain areas of the flat work piece are thicker than others, or made of different materials, or made of materials with different colors, which are bound on both sides with a first and second substrate.

The shoe upper is constructed in a flattened form. Additional trimmings may be laid over the work piece and laminated to the same. In this case, thin TPU pieces (thermoplastic polyurethane) pre-coated with HMA film is placed over the work piece and pressed with a heat platen. Additional trimmings (and logos) may be laminated onto the assembly, as desired. The flat work piece is folded to form the shape of a shoe. There is a single seam, which is glued or stitched. The shoe upper is ready to be glued to the outsole. And the outsole is glued to the upper.

Example 2

A sandal made by unibody process is described. The shoe is an open-toe sandal, and the "upper" (the upper straps) and the sockliner (the lining) are made of a single contiguous piece. By layering and fitting different materials (e.g., the pods and the foot arch support) into a single sheet of contiguous material, different parts of the shoe (i.e., the sockliner/inner sole versus the outer straps) take on different characteristics.

Three sheets of EVA foam pre coated with HMA film are provided. The foam materials have different colors (one blue and two gray) and different thicknesses (one thick gray foam sheet, and one thin foam sheet). The three foam sheets are cut. Cut materials are removed from the foam sheet material, leaving behind lattices of thin gray foam material or thick gray foam material, and blue foam material. The cut blue foam pieces (shaped like elliptic cylinders) and the thick gray foot arch reinforcement are fitted into the think gray lattice of foam material.

A separate foam sheet is cut to provide a layer that will include the straps. On to this, a workpiece is assembled that includes placing the assembled thick gray lattice of foam material on to the separate foam sheet. First substrate layer (in this case, green fabric) is laid over the assembled foam workpiece, and positioned for lamination. The work piece is heat pressed. The assembled foam workpiece is glued to the first substrate layer (green fabric).

A piece of TPU (thermoplastic polyurethane) is cut along a suitable pattern that substantially overlaps in perimeter with the assembled workpiece. The TPU is aligned with the workpiece and laminated on the side opposite the side first substrate was laminated. Unassembled and unfolded upper of the shoe is now created. The upper is folded, and the upper is ready to be bonded to the outsole. Once the outsole is bound to the folded upper, finished sandal is constructed.

Example 3

Another optional embodiment of the invention, namely, an alternative process for assembling a shoe upper for an athletic shoe, along with the finished shoe, is described herein.

Figure 87:
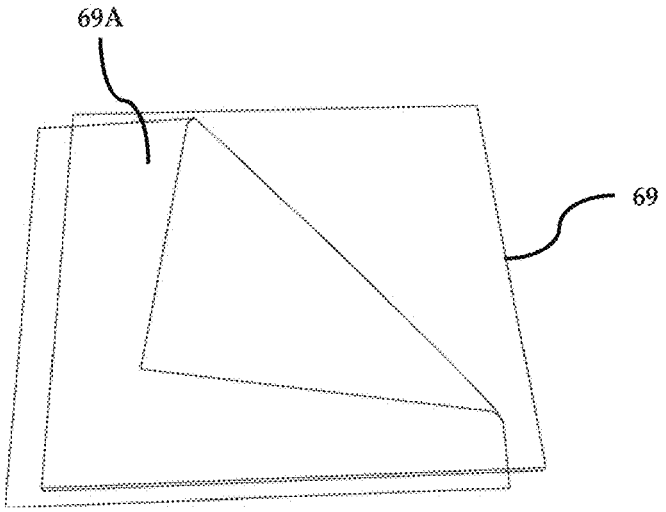
FIG. 87 shows perspective view of cushioning substrate covered on its top and bottom surfaces with a layer of adhesive.

Optionally, cushioning substrate 69 is covered on its top and bottom surfaces with a layer of adhesive 69A, as depicted in FIG. 87. In one optional embodiment of the invention, adhesive 69A is a hot-melt adhesive ("HMA") film activated by heat, or heat and pressure. However, it is understood that any compound, glue, or bonding agent capable of joining or adhering the various components made from cushioning substrate 69 to a suitable full layer or partial layer element may be used for this purpose.

Figure 88:
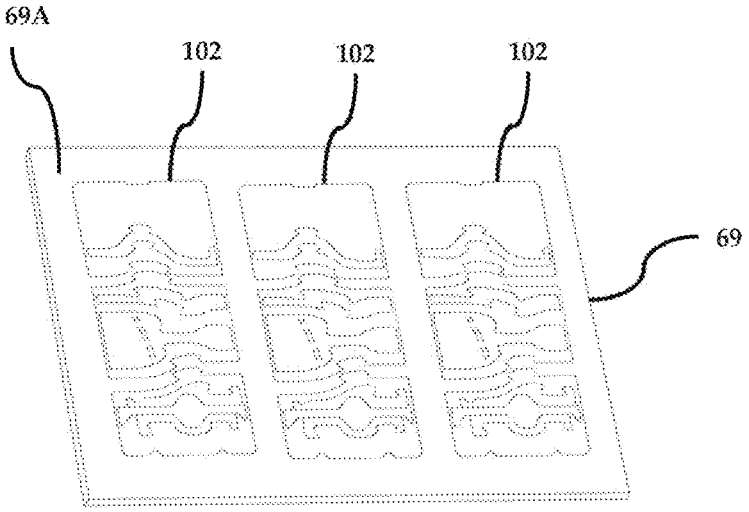
FIG. 88 shows perspective view of cushioning substrate cut along substrate cutting lines.

FIG. 88 depicts cushioning substrate 69 (optionally laminated with a layer of adhesive 69A) cut along substrate cutting lines 102 to define an instance of first alternative cushioning pod elements 221A. It is understood that cushioning substrate 69 may be cut in a variety of alternative and optional shapes and dimensions, to create alternative cushioning pod elements of suitable shape and dimension. It is also understood that, optionally, multiple instances of first alternative cushioning pod elements 221A may be fabricated from a single instance of cushioning substrate 69, as depicted in FIG. 88.

Figure 89:
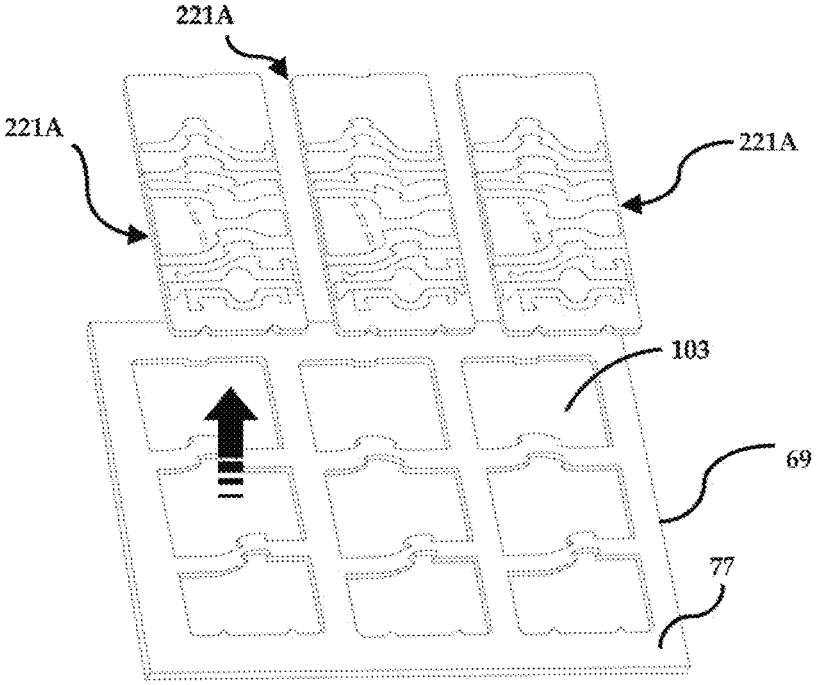
FIG. 89 shows perspective view of cut first alternative cushioning pod elements extracted from cushioning substrate, leaving behind holes and remaining cushioning substrate.

As depicted in FIG. 89, one or more instances of cut first alternative cushioning pod elements 221A may be extracted from cushioning substrate 69, leaving behind holes 103 and remaining cushioning substrate 77.

Figure 90:
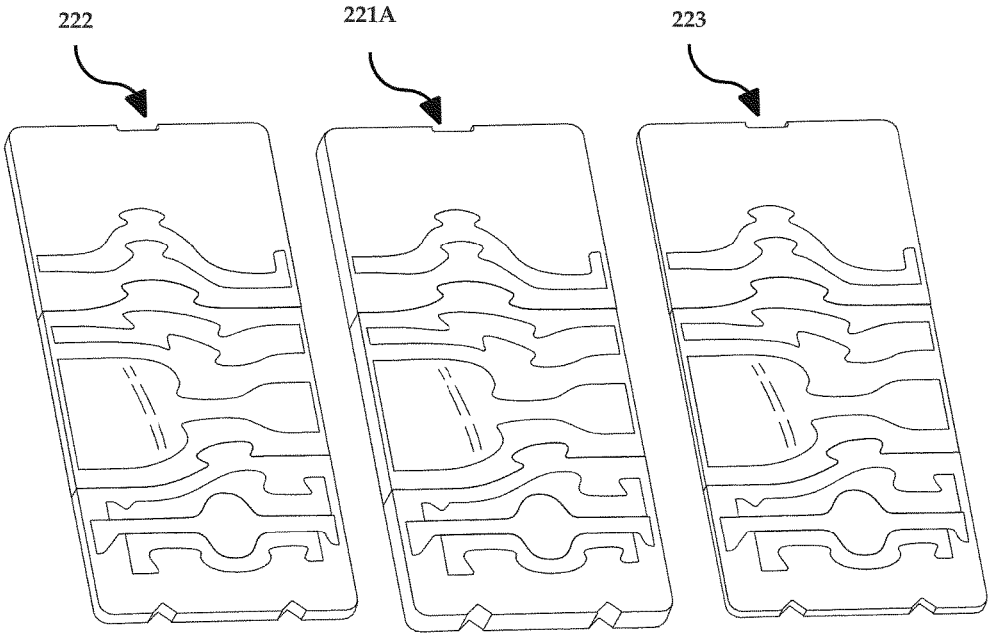
FIG. 90 shows perspective view of a variety of alternative cushioning pod elements.

By selecting suitable cushioning substrates of varying thickness, color, texture, and composition, and repeating the steps depicted in FIGS. 87 through 89 and described in connection with the said figures, a variety of alternative cushioning pod elements may be fabricated, such as, by way of example only, second alternative cushioning pod element 222, and third alternative cushioning pod elements 223 as seen in FIG. 90, for instance.

Figure 91:
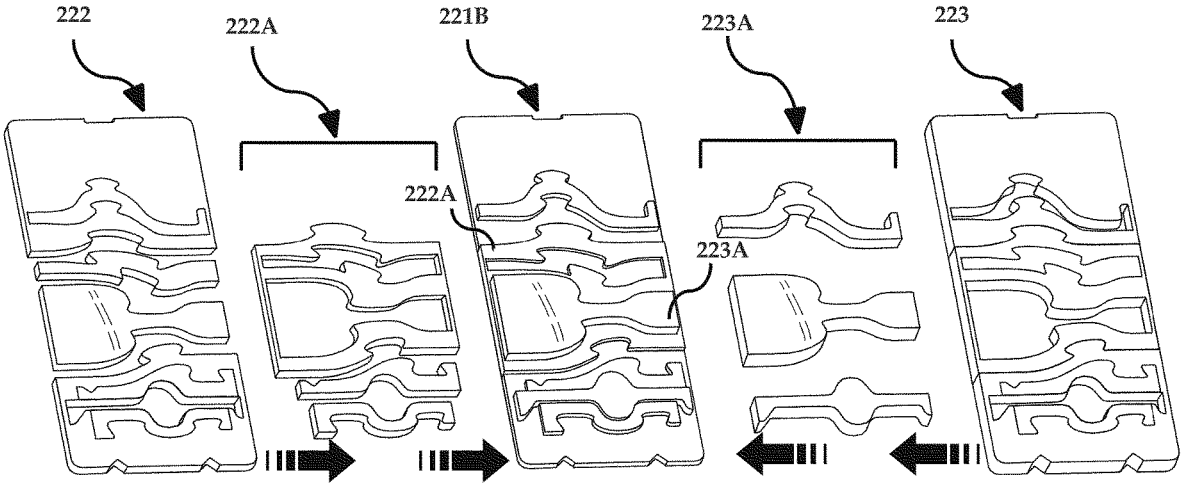
FIG. 91 shows perspective view of complex set of composite cushioning pod elements, which is assembled by taking parts and components from various cushioning pod elements, and incorporating such parts and components into other cushioning pod elements.

FIG. 91 depicts complex set of composite cushioning pod elements 221B, which is assembled by taking parts and components (such as second alternative cushioning pod element components 222A and third alternative cushioning pod element components 223A) from second alternative cushioning pod element 222 and third alternative cushioning pod elements 223, and incorporating such parts and components into the first alternative cushioning pod elements 221A.

Figure 92:
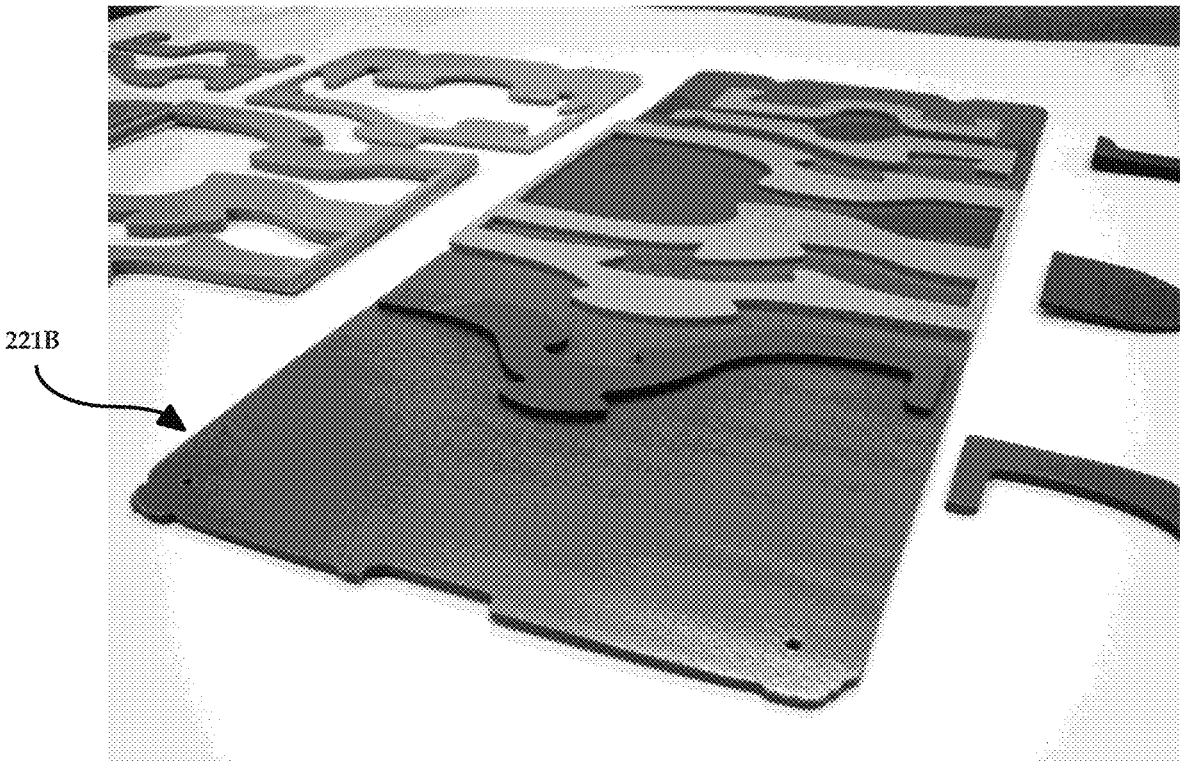
FIG. 92 shows perspective view of a complex set of composite cushioning pod elements.

A non-limiting example of composite cushioning pod elements 221B is depicted in FIG. 92.

Figure 93:
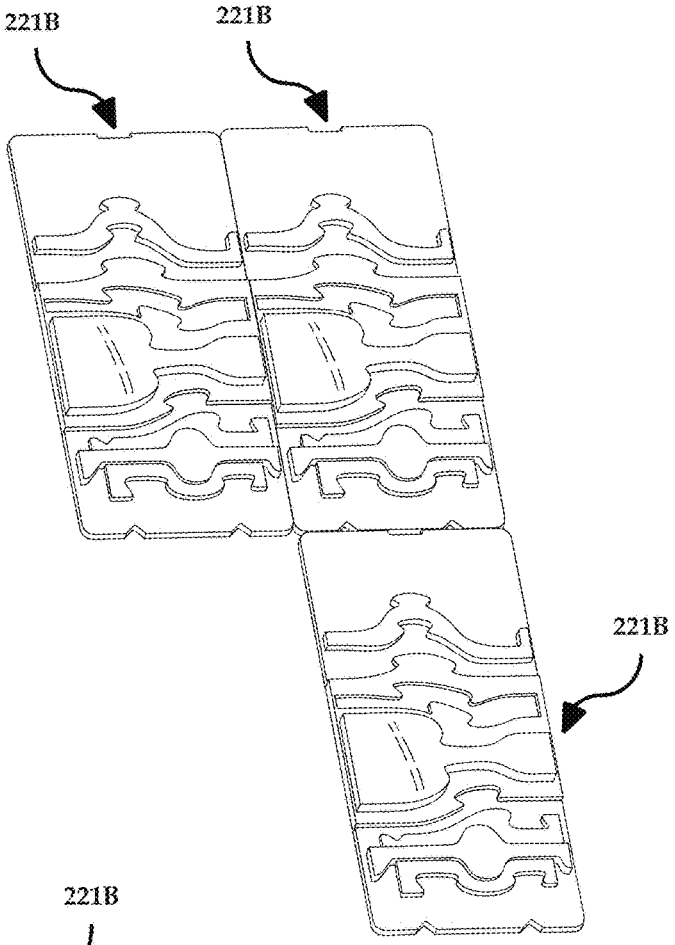
FIG. 93 shows perspective view of suitable arrangement of identical or different composite cushioning pod elements.
Figure 94:
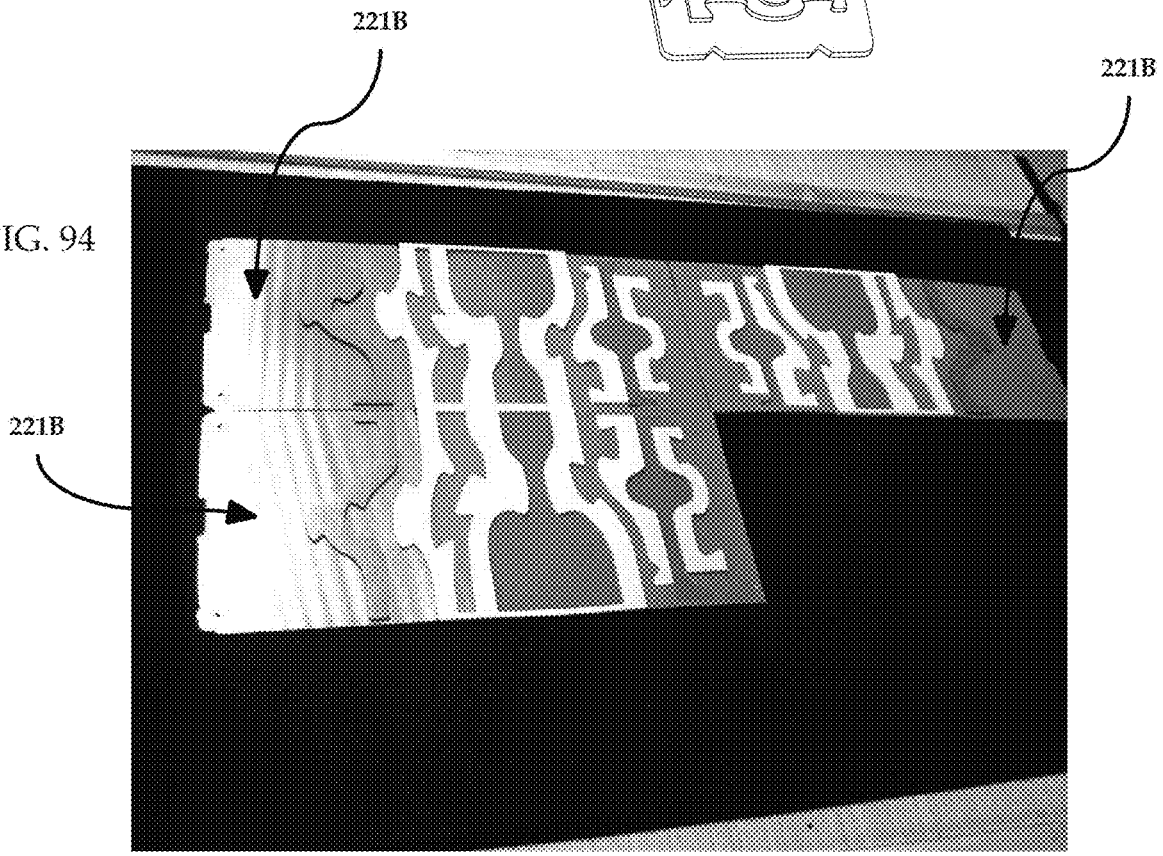
FIG. 94 shows perspective view of suitable arrangement of identical or different composite cushioning pod elements.

Multiple instances of identical or different composite cushioning pod elements 221B may be positioned in a suitable arrangement, as depicted in FIGS. 93 and 94.

Figure 95:
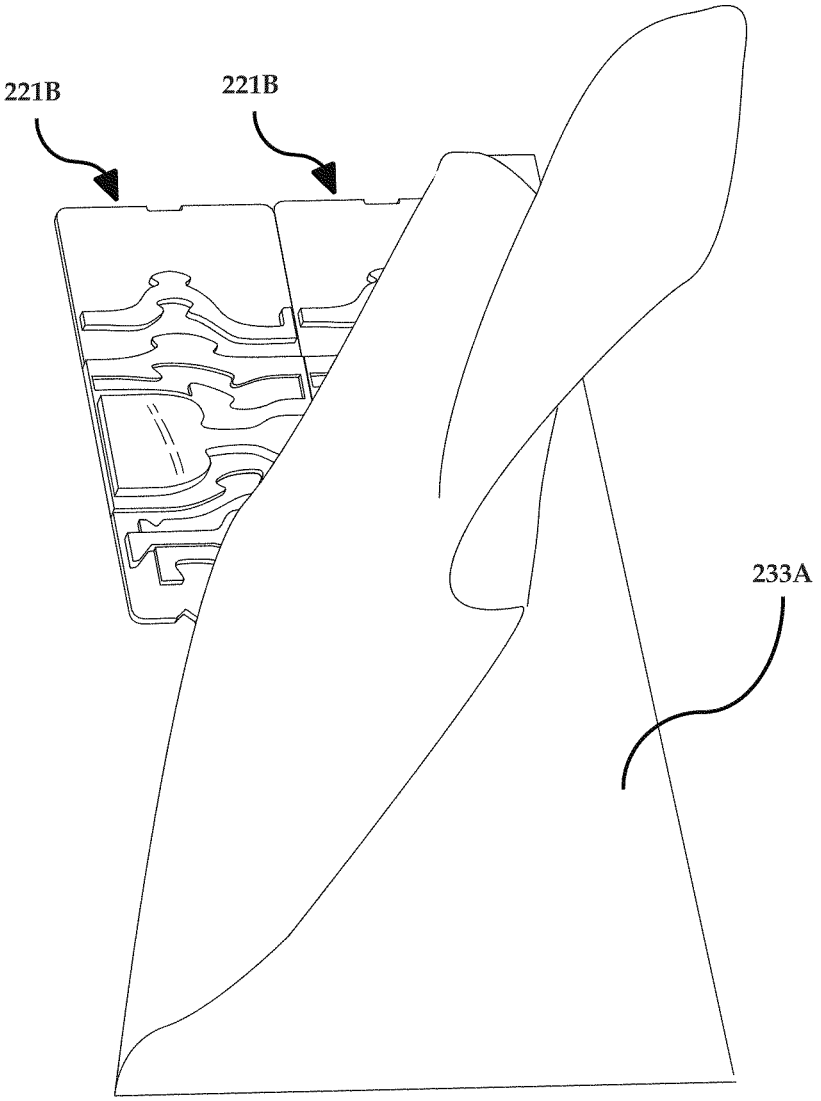
FIG. 95 shows perspective view of outer full layer sheet positioned adjacent to composite cushioning pod elements.

FIG. 95 depicts outer full layer sheet 233A positioned adjacent to multiple instances of composite cushioning pod elements 221B.

Figure 96:
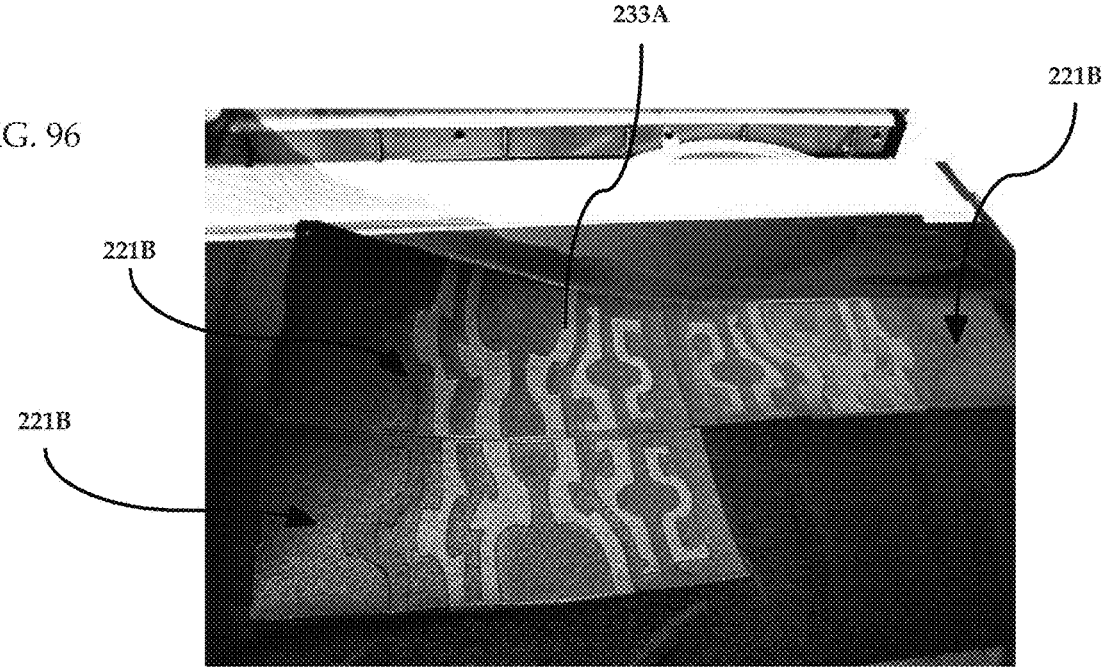
FIG. 96 shows perspective view of outer full layer sheet laminated or bonded to the composite cushioning pod elements.
Figure 97:
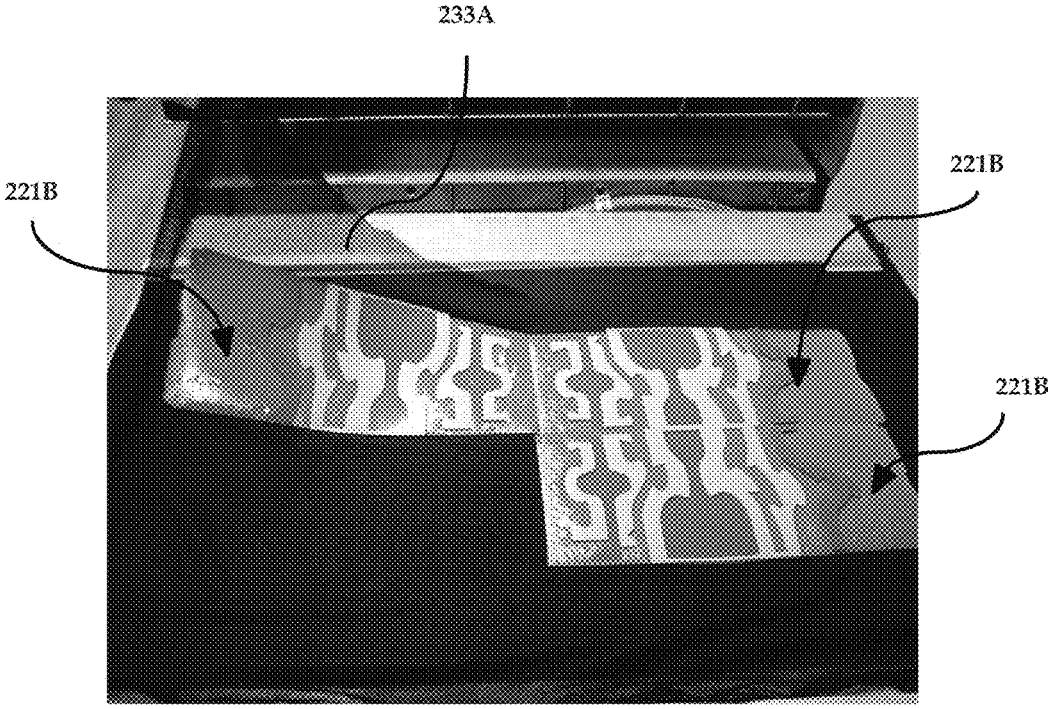
FIG. 97 shows perspective view of outer full layer sheet laminated or bonded to the composite cushioning pod elements.

The outer full layer sheet 233A is laminated or bonded to the composite cushioning pod elements 221B, as depicted in FIGS. 96 and 97. FIGS. 96 and 97 depict the two opposite sides of the composite cushioning pod elements 221B.

Figure 98:
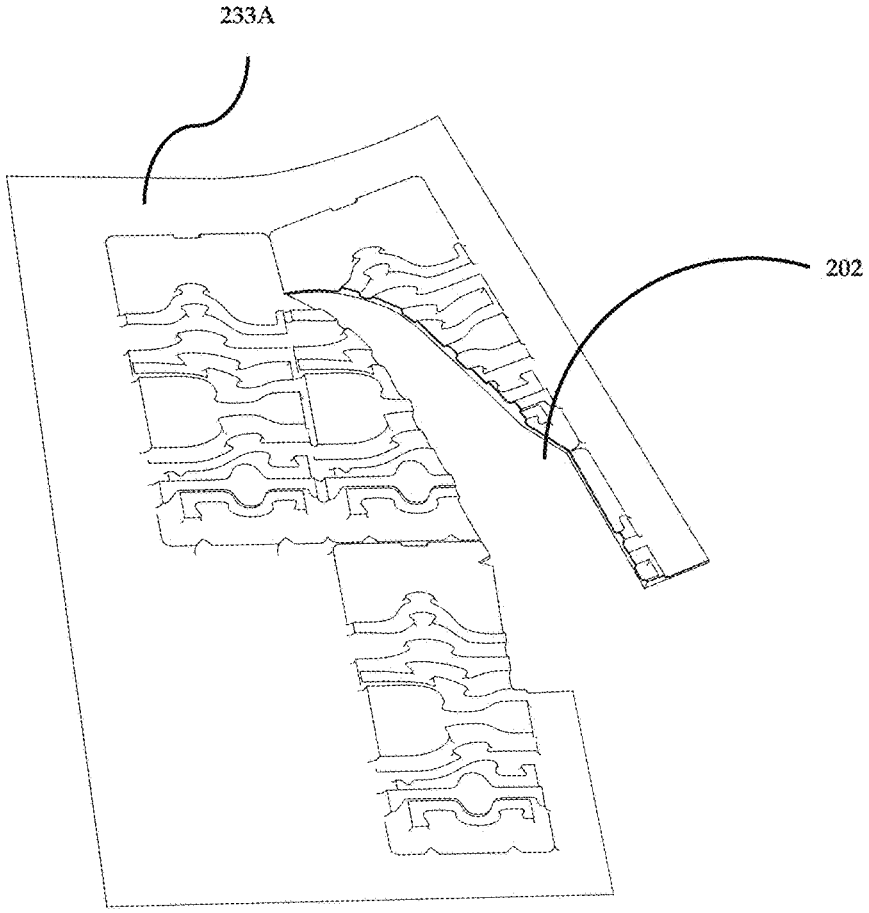
FIG. 98 shows perspective view of laminated work piece cut along shoe upper cutting lines.
Figure 99:
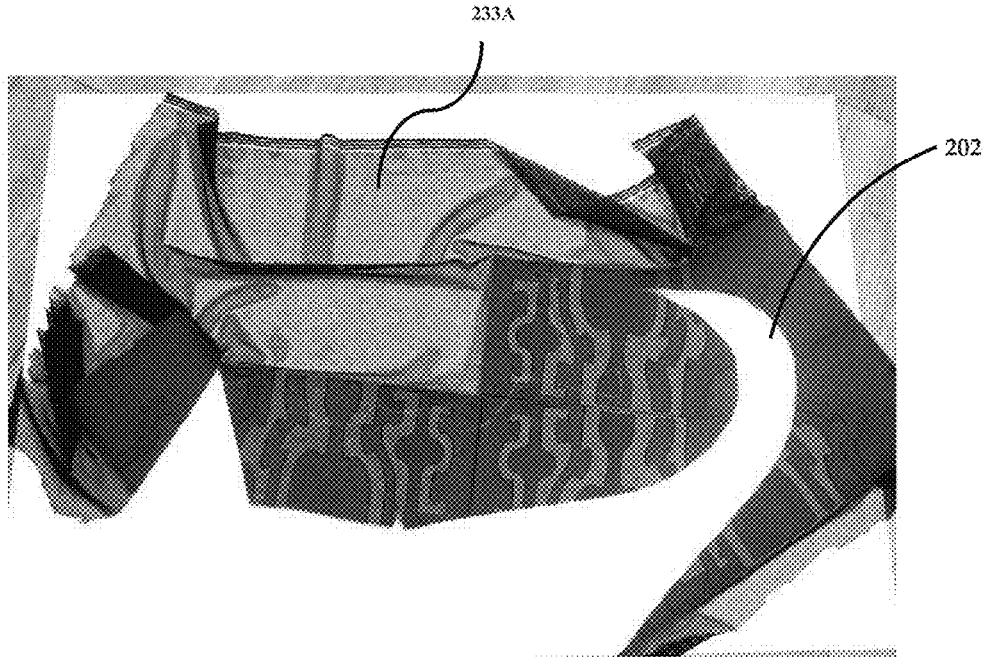
FIG. 99 shows perspective view of laminated work piece cut along shoe upper cutting lines.
Figure 100:
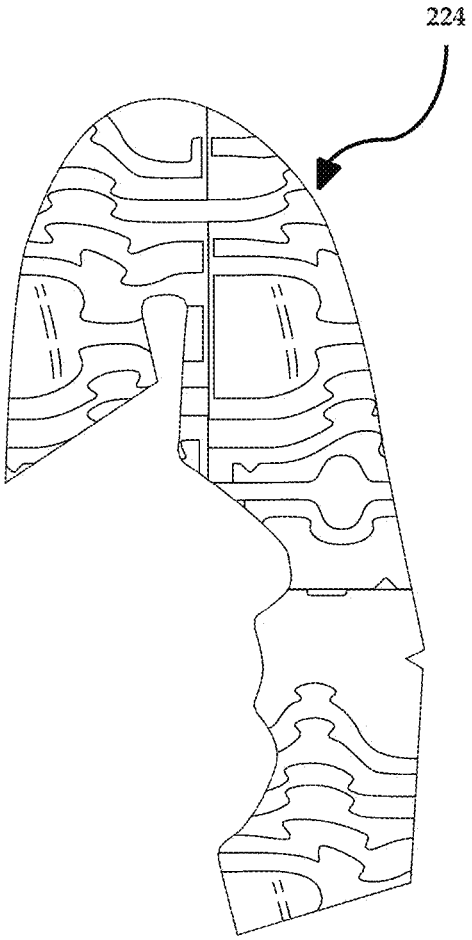
FIG. 100 shows side view of upper assembly work piece.
Figure 101:
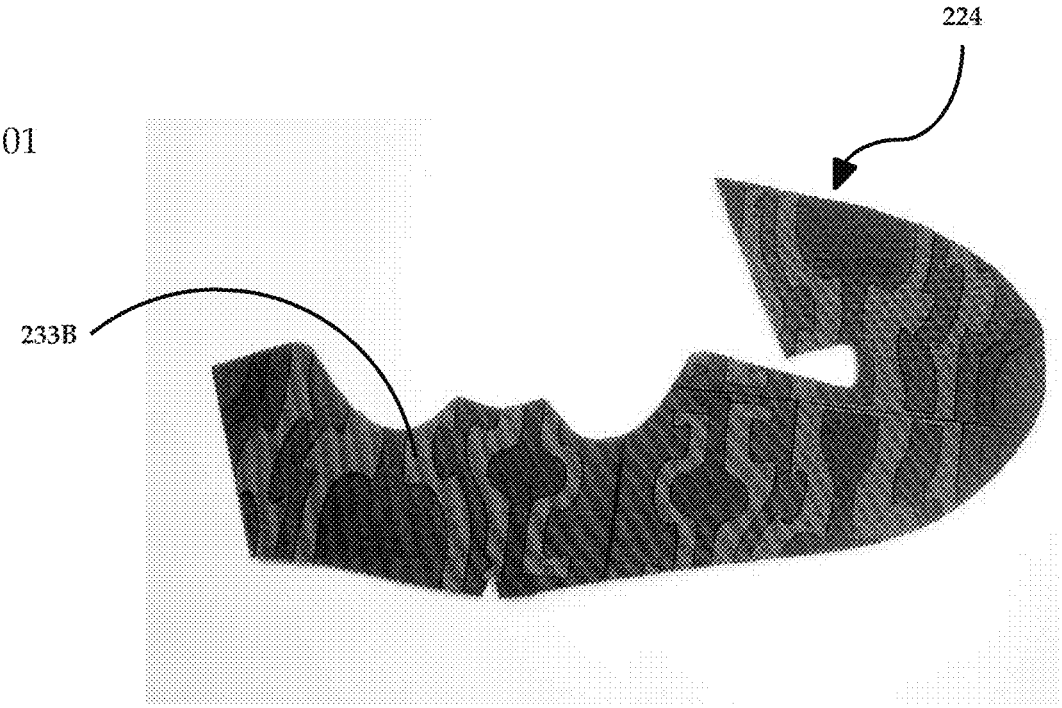
FIG. 101 shows side view of upper assembly work piece.

Optionally, the laminated work piece may be cut along shoe upper cutting lines 202, as depicted in FIGS. 98 and 99, to form first upper assembly work piece 224, shown in FIGS. 100 and 101.

Figure 102:
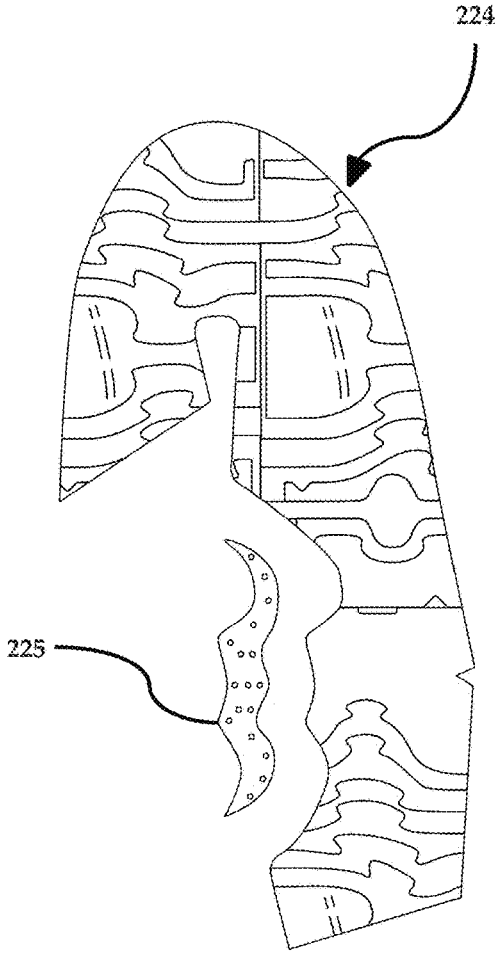
FIG. 102 shows side view of heel counter cushioning element ready to be bonded to upper assembly work piece.
Figure 103:
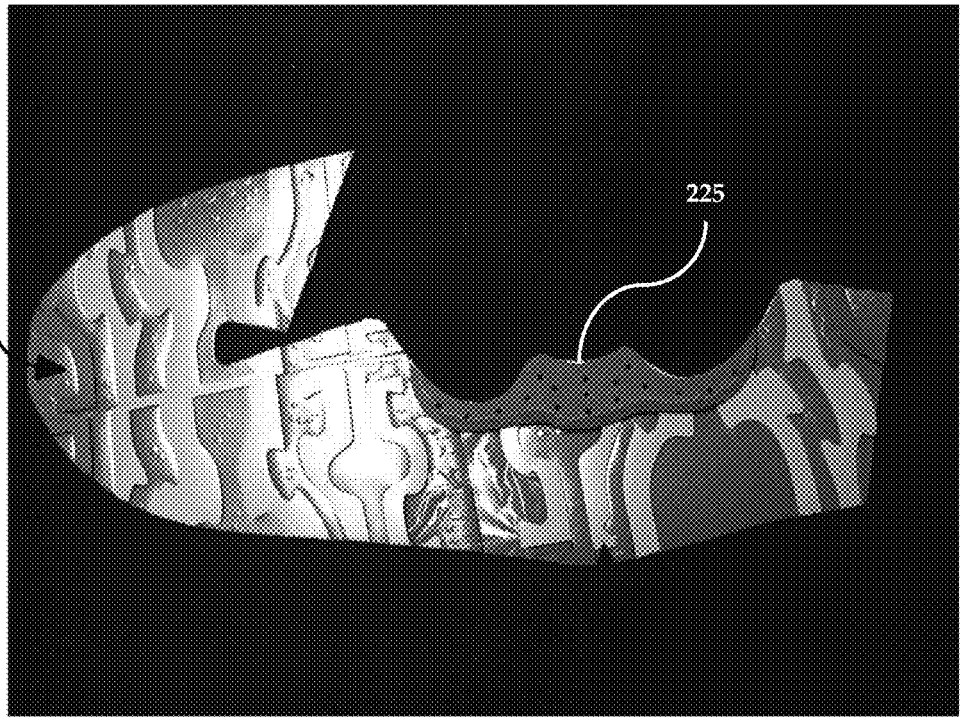
FIG. 103 shows side view of heel counter cushioning element bonded to upper assembly work piece.

Optionally, additional cushioning elements, such as heel counter cushioning element 225 depicted in FIGS. 102 and 103 may be bonded to first upper assembly work piece 224.

Figure 104:
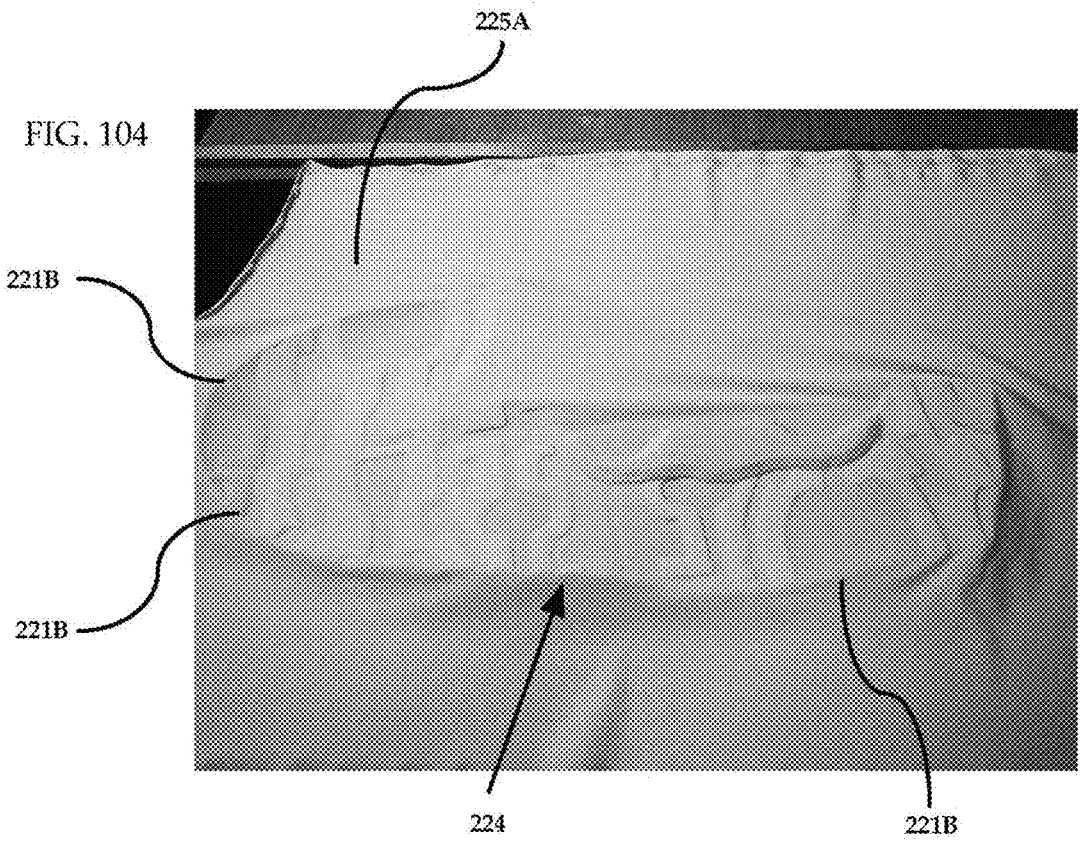
FIG. 104 shows side view of inner full layer sheet laminated or bonded to the exposed side of the composite cushioning pod elements.
Figure 105:
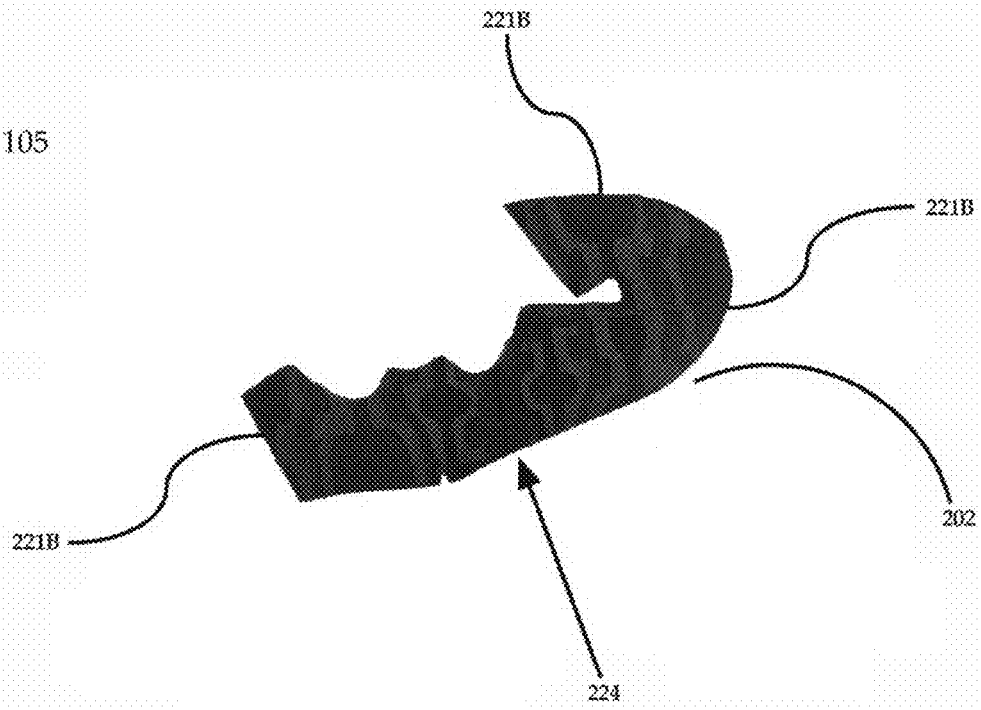
FIG. 105 shows side view of inner full layer sheet laminated or bonded to the exposed side of the composite cushioning pod elements.

Optionally, an inner full layer sheet 225A may be laminated or bonded to the exposed side of the composite cushioning pod elements 221B, as depicted in FIGS. 104 and 105. Alternatively, and optionally, inner full layer sheet 225A may be laminated or bonded to composite cushioning pod elements 221B before the composite cushioning pod elements are cut along shoe upper cutting lines 202.

Figure 106:
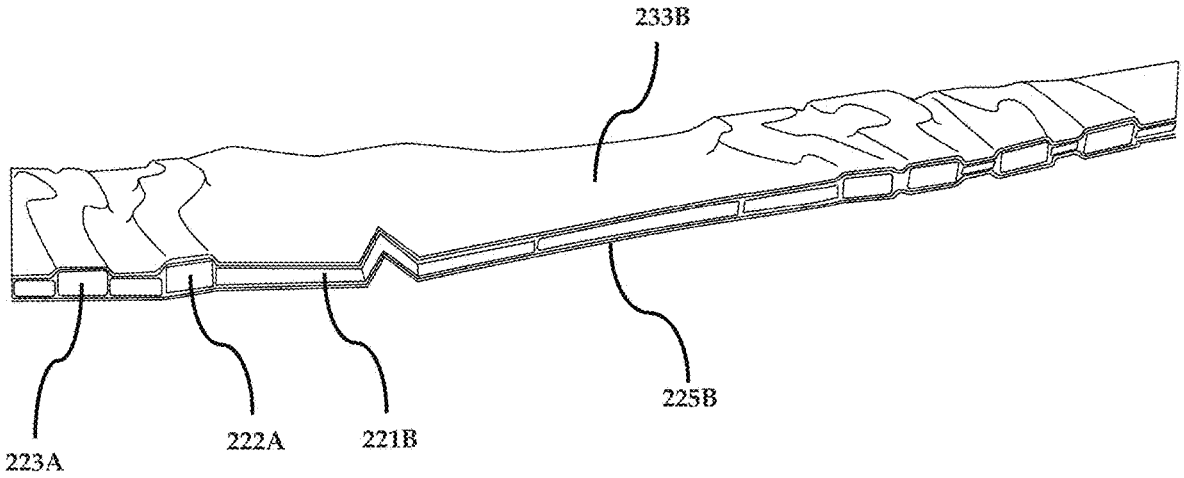
FIG. 106 shows lateral view of a work piece following lamination of the inner full layer and outer full layer to the cushioning pod elements.
Figure 107:
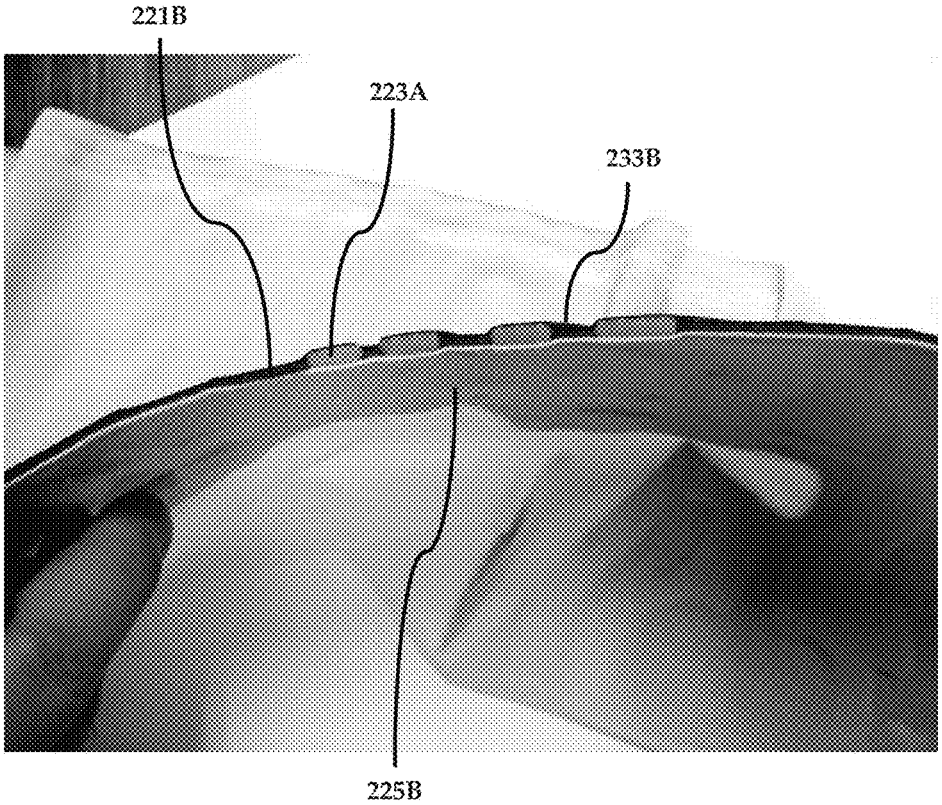
FIG. 107 shows lateral view of a work piece following lamination of the inner full layer and outer full layer to the cushioning pod elements.

FIGS. 106 and 107 depict the lateral view of the work piece following the lamination of the inner full layer 225B and outer full layer 233B to the cushioning pod elements.

Figure 108:
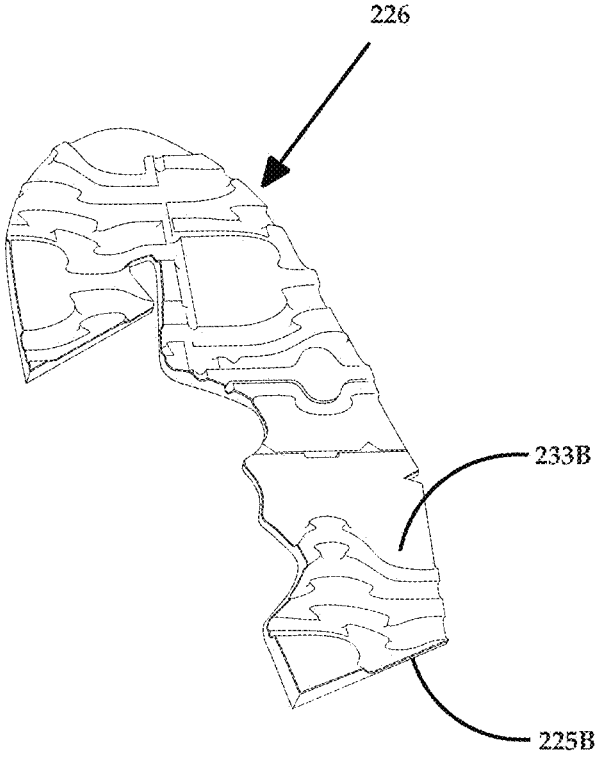
FIG. 108 shows side view of upper assembly workpiece.
Figure 109:
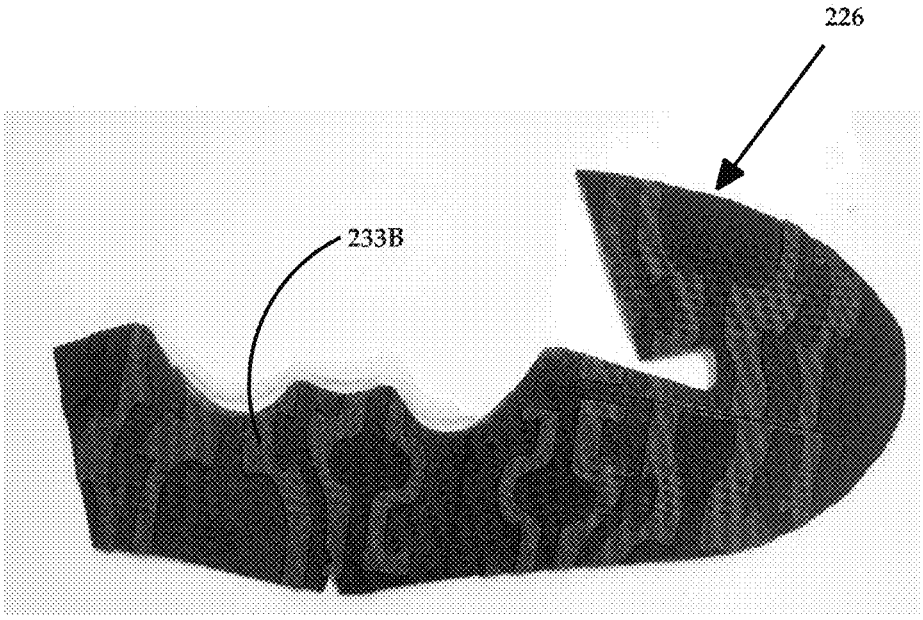
FIG. 109 shows side view of upper assembly workpiece

FIGS. 108 and 109 depict the resulting second upper assembly workpiece 226.

Figure 110:
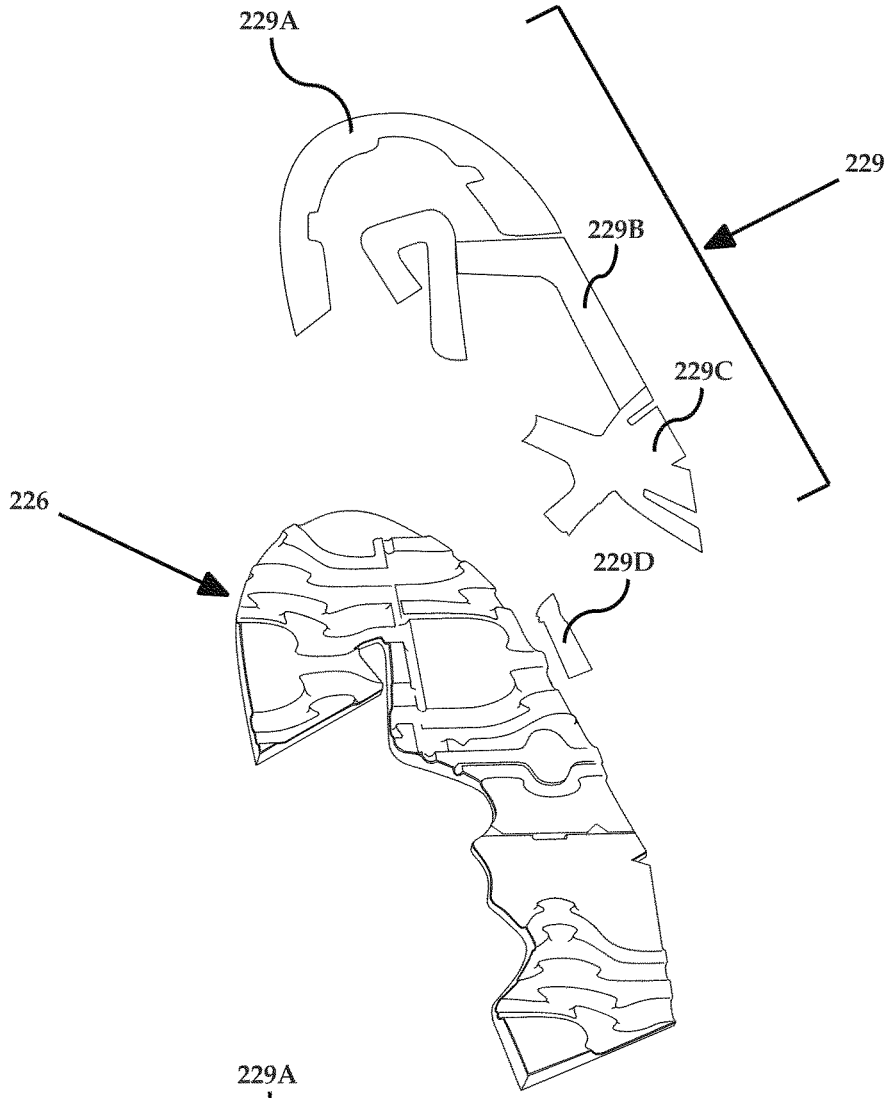
FIG. 110 shows side view of partial layer elements bonded to a upper assembly workpiece.
Figure 111:
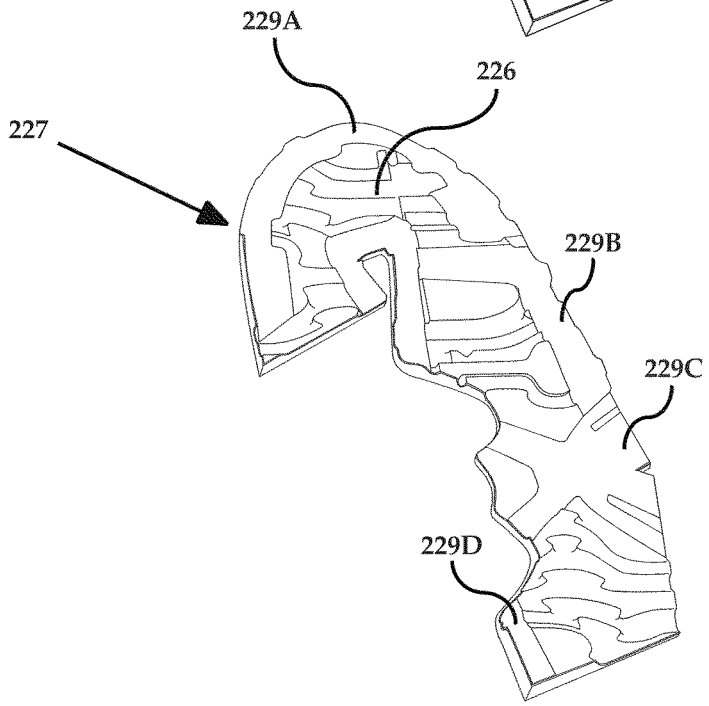
FIG. 111 shows side view of partial layer elements bonded to a upper assembly workpiece.

As depicted in FIGS. 110 and 111, partial layer elements 229 (optionally, comprised of partial layer element components 229A, 229B, 229C, and 229D) may be optionally bonded to second upper assembly workpiece 226, to provide additional structural integrity, or protection from abrasion, and the like.

Figure 112:
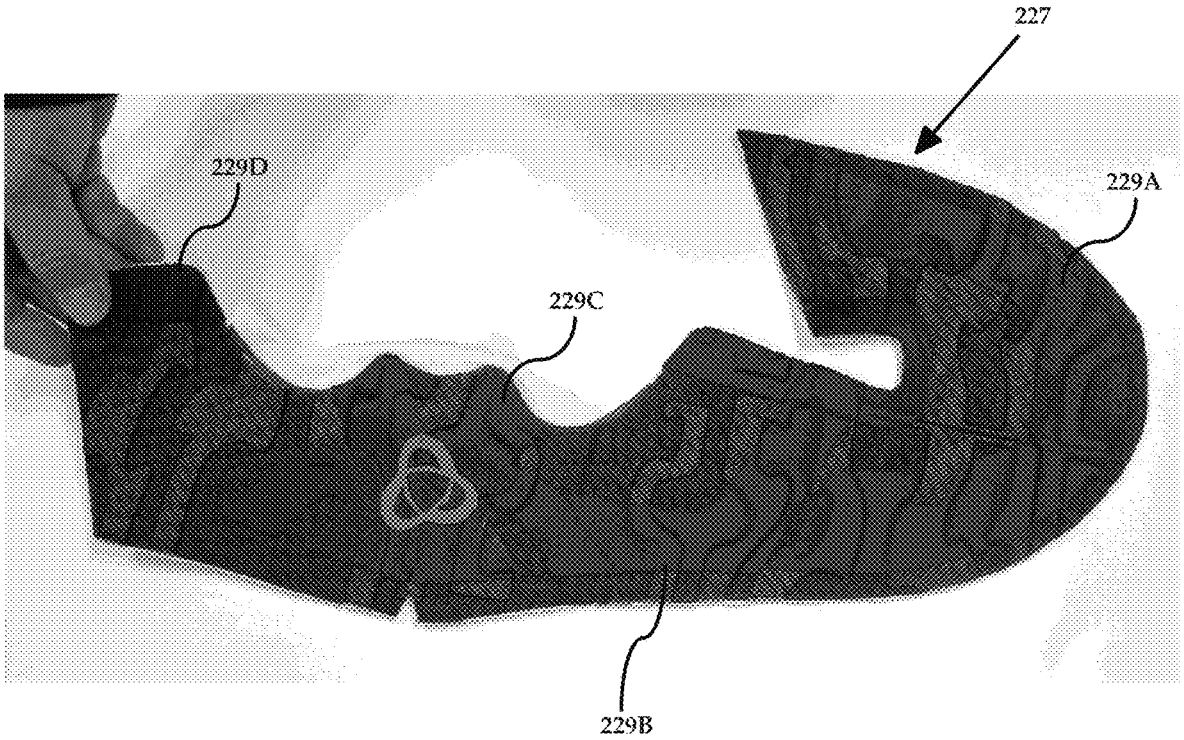
FIG. 112 shows side view of shoe upper assembly.
Figure 113:
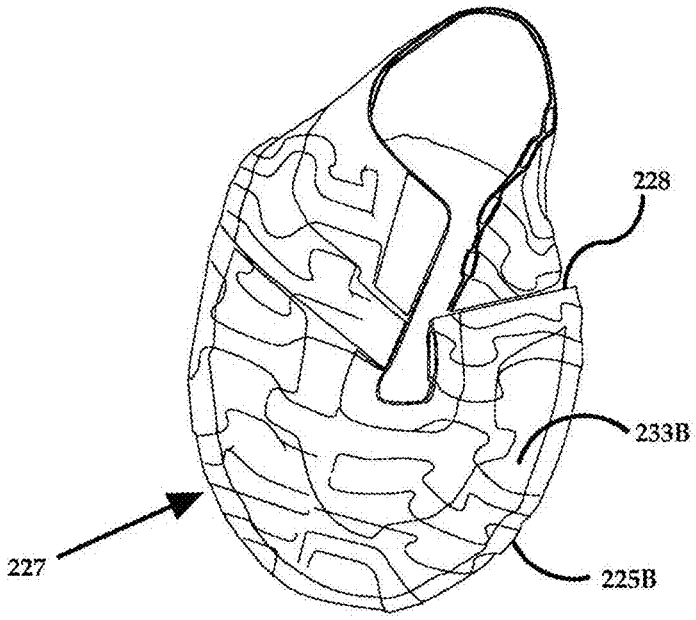
FIG. 113 shows front view of shoe upper assembly.
Figure 114:
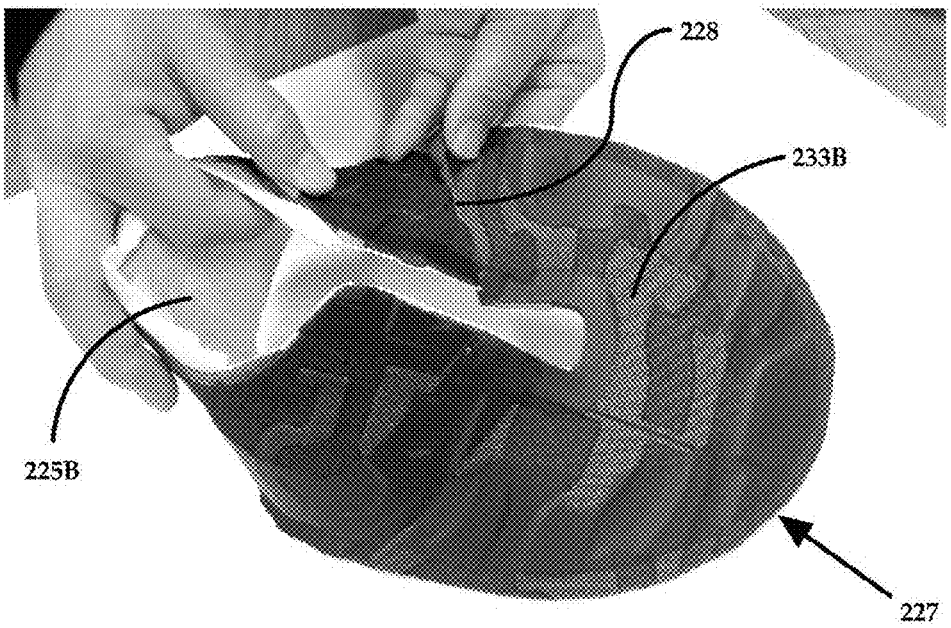
FIG. 114 shows front view of shoe upper assembly folded and joined along upper assembly seam.
Figure 115:
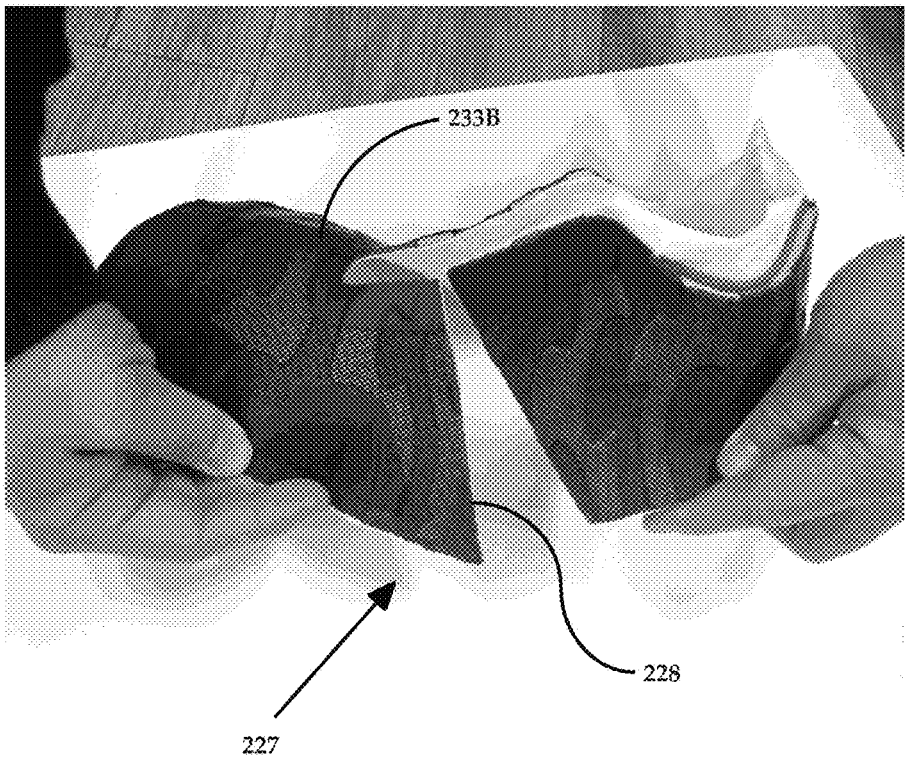
FIG. 115 shows side view of shoe upper assembly folded and joined along upper assembly seam.
Figure 116:
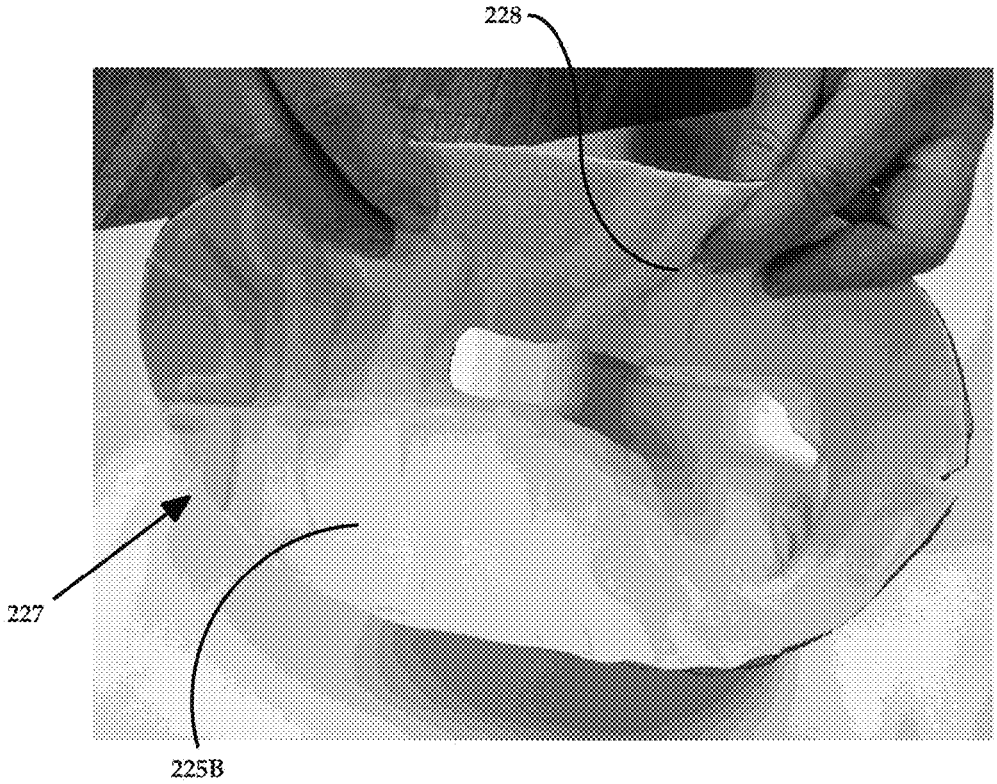
FIG. 116 shows inside view of shoe upper assembly folded and joined along upper assembly seam.

FIGS. 112 and 113 depict the resulting shoe upper assembly 227.

As depicted in FIGS. 113 through 116, shoe upper assembly 227 is folded and joined along upper assembly seam 228. The seam may optionally be bonded, sewn, glued, welded, or taped over with a partial layer or a strip made of a reinforcing material (such as, by way of example only, thermoplastic).

Figure 117:
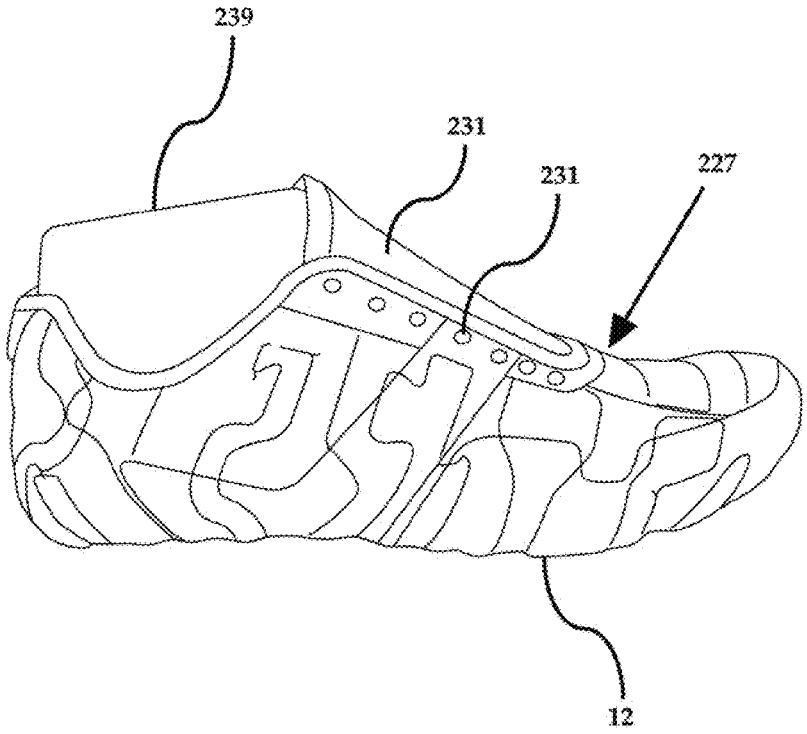
FIG. 117 shows side view of shoe last or a suitable mold inserted into the folded shoe upper assembly.
Figure 118:
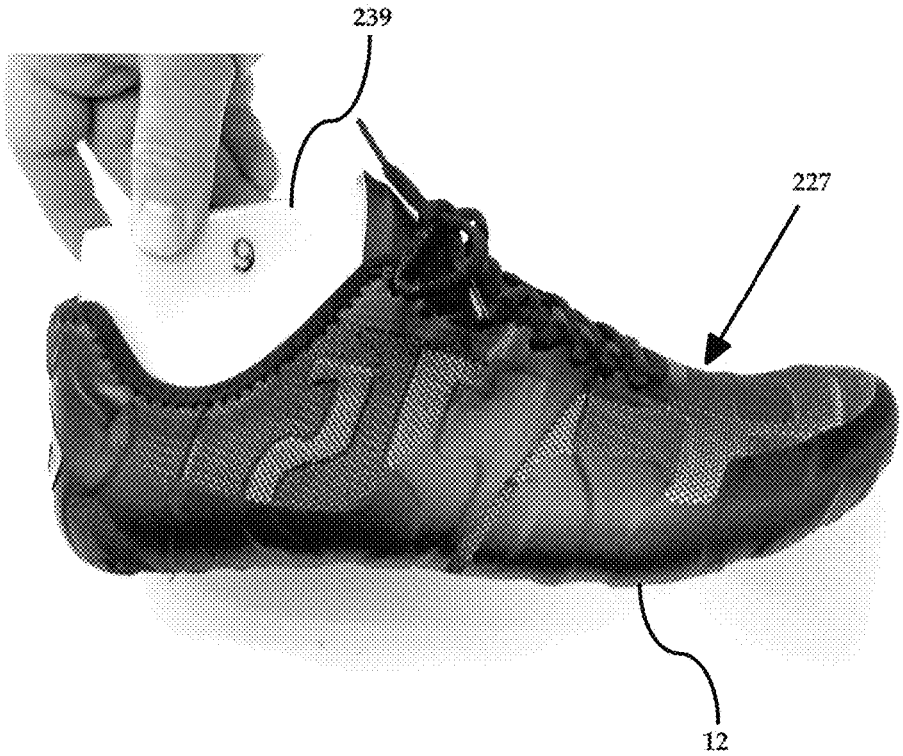
FIG. 118 shows side view of shoe last or a suitable mold inserted into the folded shoe upper assembly.
Figure 119:
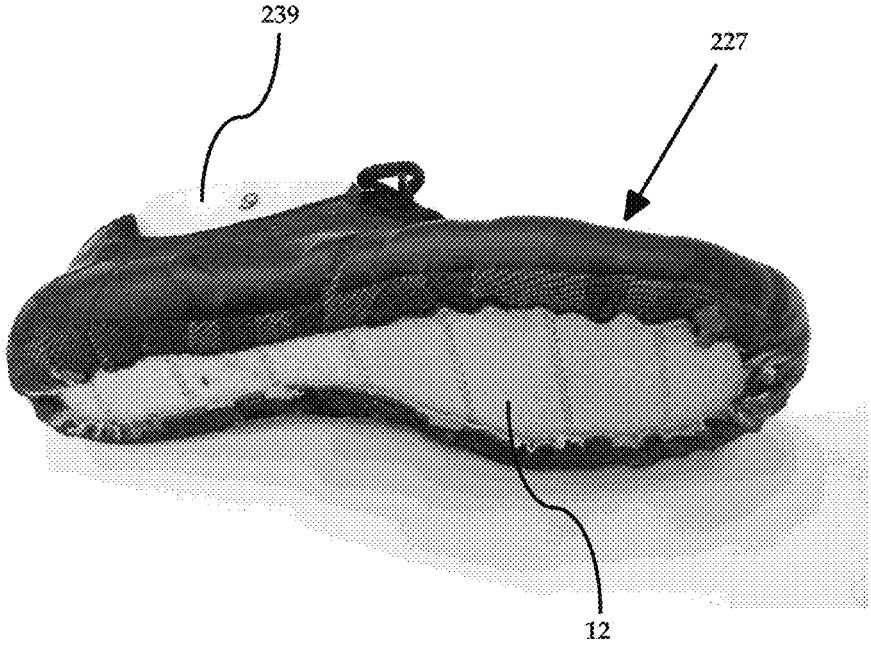

As depicted in FIGS. 117 through 119, a shoe last 239 or a suitable mold may optionally be inserted into the folded shoe upper assembly 227 to further shape the shoe body structure. Optionally, a tongue element 231 may be bonded, heat-press bonded, or stitched to the shoe upper assembly 227, and eyelet holes 231 may be perforated or punched through, as shown in FIG. 117. Also optionally, inner sole board 12 may be bonded, glued, stitched, or welded to the folded shoe upper assembly 227, as depicted in FIG. 119.

Figure 120:
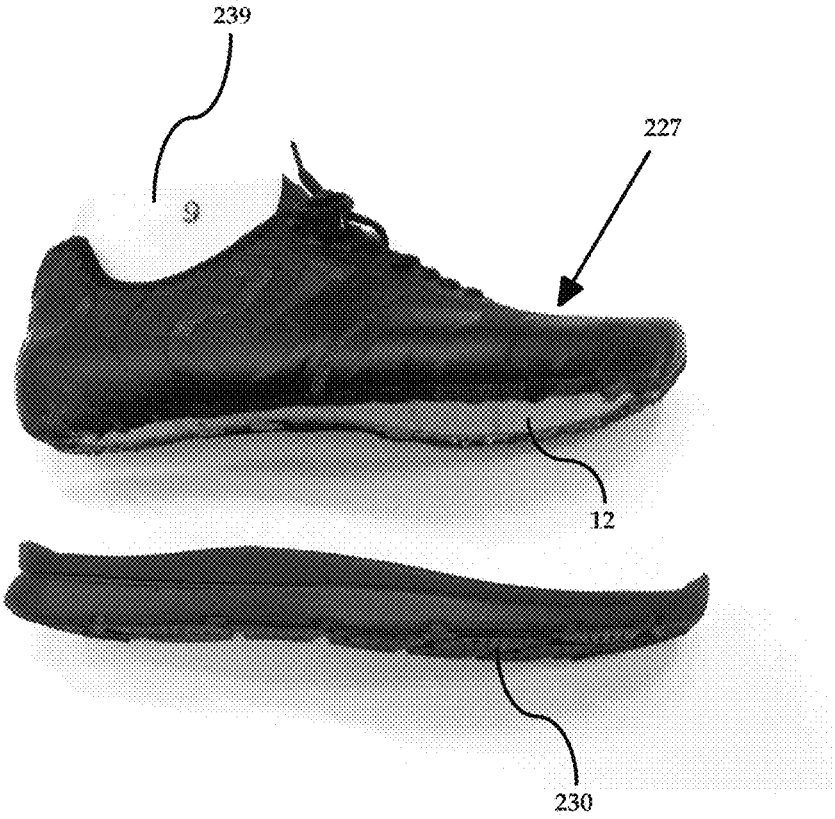

FIG. 120 depicts the folded shoe upper assembly 227 positioned in relation to an outsole element 230.

Figure 121:
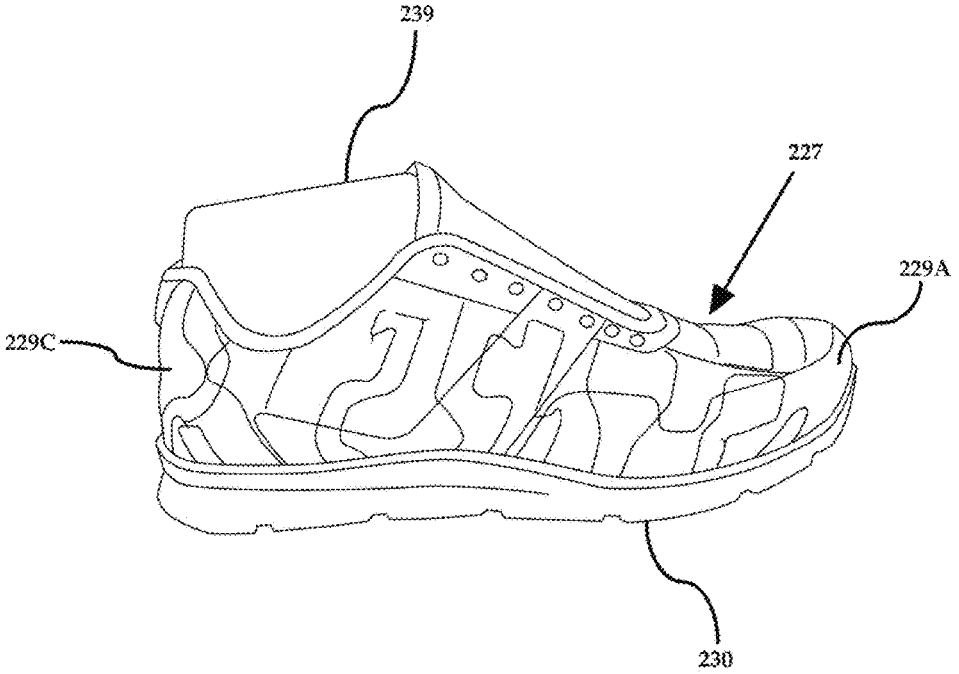
Figure 122:
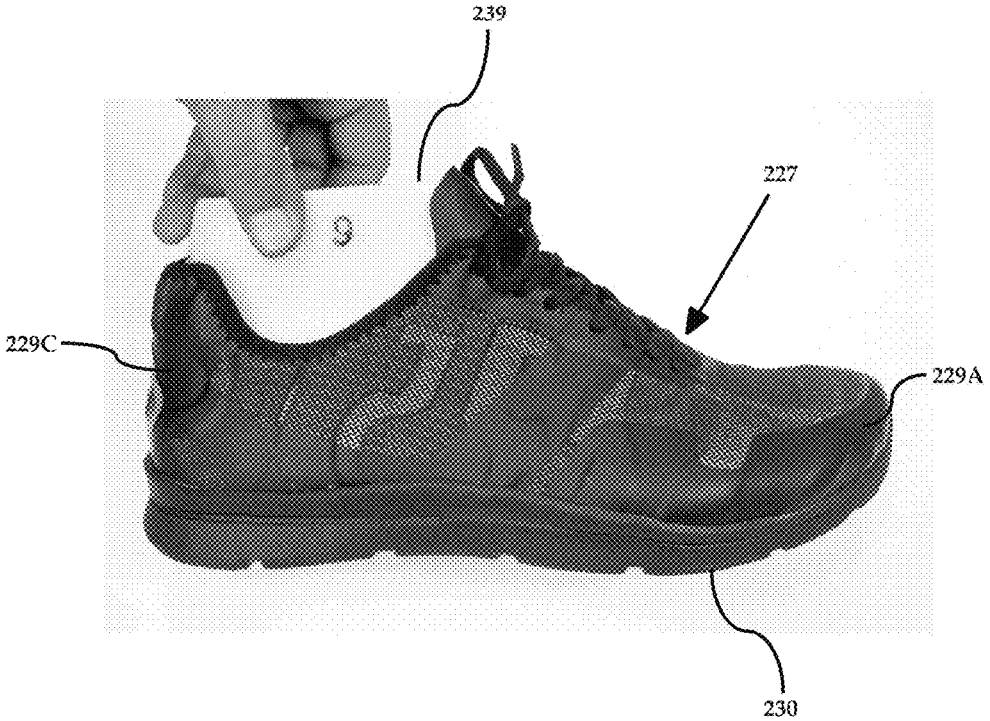

As depicted in FIGS. 121 and 122, the folded shoe upper assembly 227 may optionally be glued, bonded, welded, stitched, or sewn to outsole element 230, completing the assembly of the shoe.

Those skilled in the art will recognize, or be able to ascertain using no more than routine experimentation, many equivalents to the specific embodiments of the invention specifically described herein. Such equivalents are intended to be encompassed in the scope of the claims.

What is claimed is:

1. An athletic shoe comprising:

a unibody shoe upper comprising a pre-cut assembly including:

a plurality of elements pre-cut, layered on top of one another and adhered together to form a continuous composite structure having a stacked arrangement, the continuous composite structure being disposed in a folded configuration having the shape of a footwear with edge portions of the continuous composite structure joined together at a seam to form a permanent shape, the continuous composite structure including:

1) a first layer comprising a first partial layer element;

2) a second layer comprising a first full layer element positioned next to the first partial layer element, the first full layer element including a fabric or mesh material and being larger in overall dimension than the first partial layer element;

3) a third layer comprising an array of individual cushioning pod elements forming a cushioning padding element, the cushioning padding element being stacked onto the first full layer element and being constructed from a different material than the fabric or mesh material of the first full layer element; and 4) a fourth layer comprising an insole element stacked onto the cushioning padding element; and wherein the first full layer element includes at least one pod fitting aperture sized and positioned to engage a corresponding cushioning pod element.

2. The shoe of claim 1, wherein the unibody shoe upper has non-uniformity such that a first region of the unibody shoe upper is different than a second region of the unibody shoe upper.

3. The shoe of claim 2, wherein the non-uniformity is in thickness, texture, stiffness, hardness, color, breathability, shock absorption, resistance to abrasion and/or flexibility.

4. The shoe of claim 1, further comprising a fifth layer comprising a second full layer element.

5. The shoe of claim 4, wherein the second full layer element is made of fabric or mesh.

6. The shoe of claim 4, wherein the second full layer element is made of ethylene vinyl acetate (VA) foam, olefin or polyolefin foam, polyurethane (PU) foam, urethane based foam, thermoplastic foam, or elastomer.

7. The shoe of claim 1, further comprising an outsole assembly constructed separately from the unibody shoe upper and configured to be attached to the continuous composite structure having the permanent shape.

8. The shoe of claim 7, wherein the outsole assembly comprises:

sole pod elements;

an outsole layer that is in contact with the bottom of the upper;

a midsole; and/or an outsole.

9. The shoe of claim 1, wherein the cushioning padding element comprises a foam material.

10. The shoe of claim 1, wherein the plurality of elements is adhered together with a hot-melt adhesive.

11. The shoe of claim 1, wherein the plurality of elements comprising the continuous composite structure have different thicknesses and/or performance characteristics.

12. The shoe of claim 1, wherein the first full layer element comprises a locking pod aperture (25) configured to engage a locking pod element (22) positioned on the cushioning padding element (20).

13. The shoe of claim 1, wherein the insole element has at least one aperture formed in a bottom surface thereof, said aperture being sized and positioned to engage a corresponding cushioning pod element.

14. The shoe of claim 1, wherein the first partial layer element has an extension forming a side element that covers the seam when folded.

* * * * *